US006137976A

United States Patent [19]

Itaya et al.

[11] Patent Number: 6,137,976

[45] **Date of Patent: *Oct. 24, 2000**

[54] IMAGE FORMATION APPARATUS USING A LIQUID DEVELOPING AGENT

[75] Inventors: Masahiko Itaya, Akishima; Tai Hasegawa, Tokyo; Tsutomu Sasaki, Chiba, all of Japan

[73] Assignee: Research Laboratories of Australia PTY Ltd., Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/692,094

[22] Filed: Aug. 7, 1996

Related U.S. Application Data

[63] Continuation-in-part of application No. PCT/JP95/00170, Feb. 8, 1995.

[30] Foreign Application Priority Data

| | | | |
|---|---|---|---|
| Feb. 8, 1994 | [JP] | Japan | 6-035402 |
| Apr. 8, 1994 | [JP] | Japan | 6-093955 |
| Oct. 14, 1994 | [JP] | Japan | 6-275628 |

[51] Int. Cl.[7] ..... G03G 15/10

[52] U.S. Cl. ..... 399/233; 399/239; 399/302

[58] Field of Search ..... 399/233, 239, 399/240, 249, 299, 302, 308

[56] References Cited

U.S. PATENT DOCUMENTS

| | | | |
|---|---|---|---|
| 3,084,043 | 4/1963 | Gundlach | 399/152 X |
| 3,741,639 | 6/1973 | Snelling | 399/131 |
| 3,910,231 | 10/1975 | Inoue et al. | 399/233 X |

(List continued on next page.)

FOREIGN PATENT DOCUMENTS

| | | |
|---|---|---|
| 53-57039 | 5/1978 | Japan . |
| 55-164852 | 12/1980 | Japan . |
| 59-37577 | 3/1984 | Japan . |
| 1-250976 | 10/1989 | Japan . |
| 3-35562 | 4/1991 | Japan . |
| 3-242667 | 10/1991 | Japan . |
| 4-94988 | 3/1992 | Japan . |
| 5-297726 | 11/1993 | Japan . |
| 5-346740 | 12/1993 | Japan . |
| 95-08792 | 3/1995 | Japan . |
| 7-152257 | 6/1995 | Japan . |

*Primary Examiner*—Fred L. Braun

*Attorney, Agent, or Firm*—Evenson, McKeown, Edwards & Lenahan, P.L.L.C.

[57] ABSTRACT

A multi-color image formation apparatus that has multiple developed image formation devices, each corresponding to one color. Each of the developed image formation devices has a photosensitive member, charging apparatus that charges the photosensitive member, exposure apparatus that exposes the charged photosensitive member, and developing apparatus that supplies highly viscous and highly concentrated color liquid developing agent to the surface of the latent image on the photosensitive member. Each of the developed image formation devices is provided with transfer apparatus that sequentially transfers the developed images, each of which has been formed on the surface of the latent imgae on one of the photosensitive members, to the paper transported by the transfer belt and thereby forms a color image on the paper. An electrostatic latent image is formed on a photosensitive member such that a developed image corresponding to the desired print image remains on the developing agent bearing member. The highly viscous and highly concentrated liquid developing agent that has been applied to the developing belt is removed at the positions corresponding to the electrostatic latent image and the normal developed image remaining on the developing belt is transferred to the paper the developed image is not spread during pressure transfer and the surface energy of the image bearing member is lower than that of the thin layer of liquid developer agent

62 Claims, 25 Drawing Sheets

U.S. PATENT DOCUMENTS

| | | | |
|---|---|---|---|
| 4,594,305 | 6/1986 | Vollmann et al. | 430/115 |
| 4,690,539 | 9/1987 | Radulski et al. | 399/237 |
| 4,748,474 | 5/1988 | Kurematsu et al. | 399/159 |
| 4,761,357 | 8/1988 | Tavernier et al. | 399/239 X |
| 4,918,487 | 4/1990 | Coulter | 399/240 |
| 4,942,475 | 7/1990 | Uematsu et al. | 399/240 |
| 5,132,743 | 7/1992 | Bujese et al. | 399/237 X |
| 5,365,324 | 11/1994 | Gu et al. | 399/299 |
| 5,432,591 | 7/1995 | Geleynse | 399/249 |
| 5,442,426 | 8/1995 | Yamamura et al. | 399/249 X |
| 5,477,313 | 12/1995 | Kuramochi et al. | 399/239 |
| 5,493,373 | 2/1996 | Gundlach et al. | 399/302 |
| 5,585,900 | 12/1996 | Lior et al. | 399/233 |

IMAGE FORMATION APPARATUS USING A LIQUID DEVELOPING AGENT

CROSS-REFERENCE TO RELATED APPLICATION

This is a Continuation-in-Part of copending application No. PCT/JP95/00170 with an international filing date of Feb. 8, 1995.

FIELD OF THE INVENTION

This invention relates to image formation apparatus that uses a liquid developing agent to make a visible image from an electrostatic latent image formed by electrophotography, electrostatic recording, ionography, or other methods, and then transfers the visible image to a substrate.

In particular, this invention relates to the developing transfer process in multi-color image formation apparatus that uses the newly developed highly concentrated liquid developing agents that have high viscosity.

BACKGROUND OF THE INVENTION

In the related art, liquid developing agents and powder developing agents are used as the developing agent that makes visible images from electrostatic latent images but, when high quality images are required from electrostatic recording apparatus, a liquid developing agent is usually used. This is because the diameter of the toner particles in liquid developing agent is from 0.1 to 0.5 $\mu$m, compared with toner particle diameters of 7 to 10 $\mu$m in powder developing agents. Accordingly, the image resolution obtainable using liquid developing agents is higher than when a powder developing agent is used. In addition, powders generally flow less well than liquids. Thus, powder developing agents are more difficult to stir than liquid developing agents. Accordingly, uniform developing over wide areas is difficult to obtain if a powder developing agent is used.

Multi-color image formation apparatus in the related art is provided with one image bearing member and four developing agent bearing members, one each for the four developing agents, yellow, magenta, cyan, and black. The developing agent applied on each of the developing agent bearing members is supplied to the surface of the latent image on the image bearing member, thereby forming a developed image on the image bearing member. The developed image formed on the image bearing member is transferred to the substrate positioned on the charged transfer member which has an electric charge of opposite polarity to the toner. This type of image formation process performed for the yellow, magenta, cyan, and black developing agents in sequence results in formation of a color image on the substrate.

Image formation apparatus in the related art uses toner, that is, charged developing particles, to develop electrostatic latent images on an electrostatic latent image bearing member, then transfers the normal developed image that has been formed on the electrostatic latent image bearing member to the substrate. The method used to transfer the normal developed image that has been formed on an electrostatic latent image bearing member to the substrate is the method wherein a transfer member that has an electric charge of opposite polarity to the toner is made to contact the electrostatic latent image bearing member through the medium of the substrate such that electrostatic force is used to transfer the image to the substrate, thereby forming the image.

However, the multi-color image formation apparatus in the related art performs the above image formation processes sequentially for the yellow, magenta, cyan, and black developing agents in order to form color images. This makes it difficult to achieve high image printing speeds. In addition, the low-viscosity liquid developing agent usually used in the electrostatic recording and similar apparatus in the related art consists of IsoparG (registered trademark of the Exxon Corporation), an organic solvent, in which toner is mixed at a proportion of about 1 to 2% by weight. It is desirable to use a more highly concentrated liquid developing agent than that used in the apparatus of the related art and to reduce the volatility of the solvent to allow production of safer and simpler multi-color image formation apparatus, but this type of apparatus cannot be found in the related art. Moreover, the ideal method of forming multi-color images on a substrate when using a highly concentrated and highly viscous liquid developing agent (a liquid developing agent with a high viscosity of 100 to 10,000 mPa•s in which toner is dispersed at high concentrations in the non-conductive liquid) which adheres more strongly to the image bearing member was heretofore unknown.

The ideal method for transferring a developed image to the substrate to form an image without image inaccuracies occurring was heretofore unknown.

In addition, for the above apparatus in the related art, large quantities of liquid developing agent are required due to the low proportion of toner, and the IsoparG used as the non-conductive liquid (carrier liquid) is highly volatile and emits an unpleasant odour. Therefore, the apparatus in the related art causes an unpleasant work environment and environmental problems.

DISCLOSURE OF THE INVENTION

The aim of this invention is to provide multi-color image formation apparatus capable of high-speed image printing and capable of forming high-resolution multi-color images on the substrate.

Another aim of this invention is to provide an image formation method and image formation apparatus that can transfer developed images to the substrate and form images without the occurrence of image inaccuracies.

Yet another aim of this invention is to provide an electrostatic latent image liquid developing apparatus and liquid developing method that enable images of high resolution to be obtained easily from apparatus of reduced size while reducing pollution and improving the work environment.

To meet the above aims, the multi-color image formation apparatus of this invention comprises a multi-color image formation apparatus having multiple developed image formation stations, each of the developed image formation stages comprising an image bearing member, an electrostatic latent image formation stage that forms an electrostatic latent image on said image bearing member, and a developing stage that supplies a highly viscous color liquid developing agent by means of a developing agent bearing member to the surface of a latent image on said image bearing member, the highly viscous color liquid developing agent having a viscosity from 100 to 10,000 mPa•s and having charged developing particles dispersed at a high concentration in a non-conductive liquid, so as to form on the latent image on the image bearing member a developed image corresponding to one color, and a transfer stage that sequentially transfers the respective developed images to a substrate transported by a transfer member, and thereby forming a multi-color image on said substrate.

A transfer member formed from a flexible thin sheet-type element or as an elastic cylindrical shape is preferred.

In other multi-color image formation apparatus of this invention, a first-stage transfer step and a second-stage transfer step are provided instead of the above transfer step. The first-stage transfer step performs an initial transfer in which the developed images, each formed on the surface of the latent image on the image bearing member provided for one of the above multiple developed image formation steps, are transferred sequentially to an intermediate transfer member to form a full-color developed image. The second-stage transfer step transfers to the substrate the full-color developed image that has been formed on the intermediate transfer member.

Yet another multi-color image formation apparatus of this invention provides a multi-color image formation apparatus having multiple developed image formation stations, each of the developed image formation stations comprising an image bearing member, an electrostatic latent image formation stage that forms an electrostatic latent image on said image bearing member, and a developing stage that supplies a highly viscous color liquid developing agent by means of a developing agent bearing member to the surface of a latent image on said image bearing member, the highly viscous color liquid developing agent having a viscosity from 100 to 10,000 mPa•s and having charged developing particles dispersed at a high concentration in a non-conductive liquid, so as to form on the surface of the latent image on the image bearing member a developed image corresponding to one color, the multi-color image formation apparatus further comprising a first-stage transfer stage that sequentially transfers the respective developed images to an intermediate transfer member, and thereby forming a multi-color developed image on said intermediate transfer member, and a second-stage transfer stage that transfers the multi-color developed image formed on said intermediate transfer member to a substrate.

The sequential second-stage transfer steps transfer to the transported substrate the developed images that were transferred to the intermediate transfer members by the first-stage transfer steps and thereby form a multi-color image on said substrate.

An intermediate transfer member formed from a flexible thin sheet-type element or as an elastic cylindrical shape is preferred.

It is desirable that the multi-color image formation apparatus of this invention be provided with a pre-wetting mechanism that applies to the image bearing members a pre-wet liquid that is a chemically inactive dielectric liquid with good release properties.

The pre-wetting mechanism may apply the pre-wet liquid to the image bearing members by means of at least one roller.

The multi-color image formation apparatus of this invention is provided with electrostatic latent image bearing members, developing agent bearing members, an electrostatic latent image formation step that forms an electrostatic latent image on an electrostatic latent image bearing member such that a developed image corresponding to the desired print image remains on a developing agent bearing member, a developing step that supplies to the surface of the latent image on the electrostatic latent image bearing member the liquid developing agent that has been applied to the developing agent bearing member and that uses the portion of the liquid developing agent remaining on the developing agent bearing member to form the developed image on the developing agent bearing member, and a transfer step that transfers the developed image that has been formed on the developing agent bearing member to the substrate. The highly viscous liquid developing agent has a viscosity from 100 to 10,000 mPa•s and contains toner, or charged developing particles, distributed at a high concentration in a non-conductive liquid.

In addition, provision of a pre-wetting step in which a pre-wet liquid, namely a chemically inactive dielectric liquid that has good release properties, is applied to said electrostatic latent image bearing members is desirable.

For the above transfer step, provision of a first-stage transfer step that transfers a normal developed image that has been formed on a developing agent bearing member to an intermediate transfer member and provision of a second-stage transfer step that transfers to the substrate the normal developed images that have been transferred to the intermediate transfer member are also desirable.

The above developing agent bearing members should be formed from a flexible element.

Further, it is desirable that said flexible element be a belt element.

In another form the invention is said to reside in an image formation device provided with an electrostatic latent image bearing member, a developing agent bearing member, an electrostatic latent image formation stage that forms an electrostatic latent image on said electrostatic latent image bearing member, a developing stage that supplies to the surface of the latent image on said electrostatic latent image bearing member a highly viscous liquid developing agent, having a viscosity from 100 to 10,000 mPa•s and having charged developing particles dispersed at a high concentration in a non-conductive liquid, that has been applied to said developing agent bearing member, such that a developed image that corresponds to the desired print image remains on the developing agent bearing member and a transfer stage that transfers to a substrate said developed image that has been formed on said developing agent bearing member.

In an alternative form the invention is said to reside in an electrostatic latent image liquid developing apparatus that develops the electrostatic latent image formed on an image bearing member by means of a toner including charged developing particles, provided with a developing stage that brings a developing agent bearing member on which a highly viscous liquid developing agent, having a viscosity from 100 to 10,000 mPa•s and having the toner dispersed at a high concentration in a non-conductive liquid, has been applied into contact with said image bearing member through the medium of said liquid developing agent and thereby supplies the toner to the surface of said latent image on said image bearing member, and having a release layer that has a lower surface energy than the surface energy of said liquid developing agent formed on the surface of said image bearing member.

Use of a fluorocarbon resin to form the release layer on the above image bearing members is desirable.

The release layer on said image bearing members may be formed from silicone.

It is desirable that the non-conductive liquid in the liquid developing agent used in the multi-color image formation apparatus of this invention have a viscosity from 0.5 to 1,000 mPa•s, an electric resistance of $10^{12}\Omega$ cm or more, a surface tension of 21 dyne/cm or less, and a boiling point of 100° C. or more.

Silicone fluid may be used as the non-conductive liquid in said liquid developing agent.

In addition, it is desirable that said liquid developing agent contains toner with an average particle size of 0.1 to 5 μm and at a concentration of from 5 to 40% by weight.

The multi-color image formation apparatus of this invention forms a developed image in each of the desired colors, such as yellow, magenta, cyan, and black, on the corresponding image bearing members and sequentially transfers the developed images formed on the image bearing members to the substrate and thereby can achieve high-speed image printing. In addition, since the toner is dispersed at a high concentration and only a thin layer of liquid is used for the developing process, the volume of liquid can be much lower than for the low-concentration liquid developing agent used in the related art. If the viscosity of the liquid developing agent exceeds 10,000 mPa•s, it is difficult to stir the toner into the non-conductive liquid and manufacture of the liquid developing agent becomes problematic. Therefore, liquid developing agents with viscosities over 10,000 mPa•s are impractical for cost reasons. If the viscosity of the liquid developing agent is lower than 100 mPa•s, the toner concentration is low and disperses poorly. Therefore, a thin layer of developing liquid cannot be used for the developing process. The layer of liquid developing agent can be thin when the toner concentration is high, but a thick layer is required when the concentration is low. Moreover, the layer must be thin when the viscosity is high. If the layer is more than 40 μm, the toner adheres excessively, producing image noise. If the layer is less than 5 μm, solid black images do not print evenly.

If a transfer member formed from a thin sheet-type element is used, the contact pressure can be distributed when a developed image formed on the surface of a latent image on an image bearing member touches the substrate. Thus, the occurrence of inaccuracies in the developed image can be prevented and the developed image can be transferred to the substrate without the image spreading. If an elastic cylindrical shape is used as the transfer member, the contact pressure can be distributed in the same way as when a flexible belt is used as the transfer member and the transfer member can be rotated at high speeds to obtain even higher image printing speeds.

In other multi-color image formation apparatus of this invention, the developed images, each formed on one of the image bearing members, are transferred sequentially to an intermediate transfer member. A first-stage transfer step that forms a full-color image on the intermediate transfer member and a second-stage transfer step that transfers to the substrate the full-color image formed on the intermediate transfer member are provided. As a result, paper alignment and other concerns that apply when the developed images formed on the image bearing members are transferred directly to the substrate need not be considered. Thus, in addition to the operational characteristics described above for the image formation apparatus of this invention, proper registration of the color image transferred to the substrate is simplified.

If an intermediate transfer member formed from a thin sheet-type element is used, the contact pressure can be distributed when a developed image formed on the surface of a latent image on an image bearing member touches the intermediate transfer member. Thus, the occurrence of inaccuracies in the developed image can be prevented and the first-stage transfer of the developed images to the intermediate transfer member can be performed without the images spreading. If an elastic cylindrical shape is used as the intermediate transfer member, the contact pressure can be distributed in the same way as when a flexible belt is used as the intermediate transfer member and the intermediate transfer member can be rotated at high speeds to obtain even higher image printing speeds.

If the multi-color image formation apparatus of this invention is provided with a pre-wetting step that applies pre-wet liquid, which is a chemically inactive dielectric liquid that has good release properties, to the image bearing members, the adhesion of toner to the non-image parts on the image bearing members can be prevented.

In addition, if the pre-wetting step applies the pre-wet liquid to an image bearing member by means of at least one roller, the quantity of pre-wet liquid required on the image bearing member can be supplied even when the image bearing member is rotated at high speeds.

A pre-wet liquid with good release properties and good insulating properties can be obtained by using a liquid wherein the viscosity is from 0.5 to 5 mPa•s, the electric resistance is $10^{12}\Omega$ cm or more, the boiling point is from 100 to 250° C., and the surface tension is 21 dyne/cm or less. Since the pre-wet liquid is absorbed by the paper or other medium during the transfer process, the liquid must be vaporised during fusing. Accordingly, a viscosity of from 0.5 to 5 mPa•s is desirable because this vaporises easily. If the viscosity is higher than 5 mPa•s, the liquid does not vaporise easily. If the viscosity is less than 0.5 mPa•s, the liquid becomes highly volatile and must be handled as a dangerous substance, making the liquid unsuitable. If the boiling point of the pre-wet liquid is less than 100° C., higher quantities of vapour occur. This causes problems related to storage methods for the pre-wet liquid, necessitates a tightly sealed structure for the apparatus as a whole, and makes it difficult to improve the work environment. If the boiling point is higher than 250° C., the paper curls during fixing and, therefore, the pre-wet liquid cannot be used. In addition, large amounts of energy are required for heating, which increases costs. If the electric resistance is lower than $10^{12}\Omega$ cm, the insulating property deteriorates and the liquid cannot be used as a pre-wet liquid. Therefore, it is desirable that the electric resistance value be as high as possible. If the surface tension is higher than 21 dyne/cm, the wettability deteriorates and the intimacy of the contact with the liquid developing agent deteriorates. Accordingly, it is desirable that the surface tension value be as low as possible.

A highly viscous liquid developing agent for the multi-color image formation apparatus of this invention can be obtained by use of a liquid developing agent in which the viscosity of the non-conductive liquid is from 0.5 to 1,000 mPa•s, the electric resistance is $10^{12}\Omega$ cm or more, the surface tension is 21 dyne/cm or less, and the boiling point is 100° C. or more. Since the layer of liquid developing agent formed on the surface of the developing agent bearing members is thin, the amount of non-conductive liquid contained in the liquid developing agent that adheres to the surface of the latent images on the image bearing members is extremely small. Since only very small amounts of non-conductive liquid are absorbed by the paper or other medium during the transfer process, the problems that can be caused by the adherence of the non-conductive liquid to the paper or other medium when the viscosity is 1,000 mPa•s or less do not arise. However, the liquid becomes more highly volatile if the viscosity is lower than 0.5 mPa•s. Therefore, special handling as a dangerous substance is required, making the liquid unsuitable at these viscosities. If the boiling point of the non-conductive liquid is lower than 100° C., higher quantities of vapour occur. This causes problems related to storage methods for the developing agent, necessitates a tightly sealed structure for the apparatus as a whole, and makes it difficult to improve the work environment. If the electric resistance is lower than $10^{12}\Omega$ cm, the insulating property deteriorates. This causes toner conductivity problems which prevent use of the liquid as a developing agent. Therefore, it is desirable that the electric resistance value be as high as possible. If the surface tension is higher than 21 dyne/cm, the wettability deteriorates and the intimacy of the contact with the pre-wet liquid deteriorates. Accordingly, it is desirable that the surface tension value be as low as possible.

A liquid developing agent in which the toner is dispersed at a high concentration in the non-conductive liquid can be obtained by using toner with an average particle diameter of 0.1 to 5 $\mu$m at concentrations of 5 to 40% by weight. The resolution improves in roughly inverse proportion to the size of the toner particle diameter. Normally, the toner on the printed paper exists as aggregates of 5 to 10 layers. Thus, resolution deteriorates if the average particle diameter of the toner is over 5 $\mu$m. If the average particle diameter of the toner is less than 0.1 $\mu$m, the physical adhesive strength is high and the toner does not release easily during transfer.

The multi-color image formation method of this invention forms a developed image on an electrostatic latent image bearing member such that a developed image corresponding to the desired print image remains on a developing agent bearing member and forms a developed image corresponding to the desired print image on the developing agent bearing member. In addition, since a highly viscous liquid developing agent in which the toner is dispersed at a high concentration is used, the volume of liquid can be extremely small compared with the low-concentration liquid developing agent used in the related art. Since the toner in a developed image formed on a developing agent bearing member does not easily spread, transfer of the developed image to the substrate enables images with very few inaccuracies to be formed on the substrate. Note that, if the viscosity of the liquid developing agent exceeds 10,000 mPa•s, it is difficult to stir the toner into the non-conductive liquid and manufacture of the liquid developing agent becomes problematic. Therefore, liquid developing agents with viscosities over 10,000 mPa•s are impractical for cost reasons. If the viscosity of the liquid developing agent is lower than 100 mPa•s, the toner concentration is low and disperses poorly. Therefore, a thin layer of developing liquid cannot be used for the developing process. The layer of liquid developing agent can be thin when the toner concentration is high, but a thick layer is required when the concentration is low. Moreover, the layer must be thin when the viscosity is high. If the layer is more than 40 $\mu$m, excess toner migrates and causes image inaccuracies in the normal developed images formed on the developing agent bearing members, producing image noise. If the layer is less than 5 $\mu$m, solid black images do not print evenly.

In addition, if a chemically inactive dielectric liquid that has good release properties is applied to an electrostatic latent image bearing member before the developing process starts, the toner on a developing agent bearing member can be prevented from migrating to the parts on the electrostatic latent image bearing member where electrostatic latent image is not formed.

Furthermore, if the transfer process provides a first-stage transfer process that transfers the developed images formed on the developing agent bearing members to the intermediate transfer member and a second-stage transfer process that transfers to the substrate the developed images that have been transferred to the intermediate transfer member, control of the transfer position and the application process can be simplified and image noise can be reduced.

If developing agent bearing members formed from a flexible element are used, the contact pressure can be distributed when a liquid developing agent layer applied to a developing agent bearing member touches an electrostatic latent image bearing member. Thus, the occurrence of inaccuracies in the developed images formed on the developing agent bearing members can be prevented.

A highly viscous liquid developing agent can be obtained using a non-conductive liquid with the characteristics described above. Since the layer of liquid developing agent formed on the surface of a developing agent bearing member is thin, the amount of non-conductive liquid contained in the liquid developing agent layer is extremely small. Since only very small amounts of non-conductive liquid are absorbed by the paper or other medium during the transfer process, the problems that can be caused by the adherence of the non-conductive liquid to the paper or other medium when the viscosity is 1,000 mPa•s or less do not arise. However, the liquid becomes more highly volatile if the viscosity is lower than 0.5 mPa•s. Therefore, special handling as a dangerous substance is required, making the liquid unsuitable at these viscosities. If the boiling point of the non-conductive liquid is lower than 100° C., higher quantities of vapour occur. This causes problems related to storage methods for the developing agent, necessitates a tightly sealed structure for the apparatus as a whole, and makes it difficult to improve the work environment. If the electric resistance is lower than $10^{12}\Omega$ cm, the insulating property deteriorates. This causes toner conductivity problems which prevent use of the liquid as a developing agent. Therefore, it is desirable that the electric resistance value be as high as possible. If the surface tension is higher than 21 dyne/cm, the wettability deteriorates. Accordingly, it is desirable that the surface tension value be as low as possible.

A liquid developing agent in which the toner is dispersed at a high concentration in the non-conductive liquid can be obtained by using toner with an average particle diameter of 0.1 to 5 $\mu$m at concentrations of 5 to 40% by weight. The resolution improves in roughly inverse proportion to the size of the toner particle diameter. Normally, the toner on the printed paper exists as aggregates of 5 to 10 layers. Thus, resolution deteriorates if the average particle diameter of the toner is over 5 $\mu$m. If the average particle diameter of the toner is less than 0.1 $\mu$m, the physical adhesive strength is high and the toner does not release easily during transfer.

The liquid development type of multi-color image formation apparatus in this invention uses a liquid developing agent in which the particle diameter is smaller than for powder developing agents and therefore can obtain higher image resolutions than when powder developing agents are used. In addition, since the toner is distributed at a high concentration in the liquid developing agent, the quantity of liquid can be extremely small compared with the low-concentration liquid developing agents used in the related art. Furthermore, a release layer that has a lower surface energy than the surface energy of the liquid developing agent is formed on the surfaces of the image bearing members. Use of these image bearing members weakens the physical adhesive force between the liquid developing agent and the image bearing members and thereby can prevent adhesion of toner to the non-image parts on the image bearing members. As a result, the occurrence of image noise can be prevented. Note that, if the viscosity of the liquid developing agent exceeds 10,000 mPa•s, it is difficult to stir the toner into the non-conductive liquid and manufacture of the liquid developing agent becomes problematic. Therefore, liquid developing agents with viscosities over 10,000 mPa•s are impractical for cost reasons. If the viscosity of the liquid developing agent is lower than 100 mPa•s, the toner concentration is low and disperses poorly, and developing is not possible using a thin layer of liquid developing agent.

A highly viscous liquid developing agent can be obtained using a non-conductive liquid that has the characteristics described above. Since only a thin layer of liquid developing agent is formed on the developing agent bearing members, the amount of non-conductive liquid contained in the liquid developing agent is extremely small. As a result, the liquid developing agent applied to the surface of the latent images on the image bearing members contains extremely small amounts of non-conductive liquid and only very small amounts of non-conductive liquid are absorbed by the paper or other medium during the transfer process. Therefore, the problems that can be caused by the adherence of the non-conductive liquid to the paper or other medium when the viscosity is 1,000 mPa•s or less do not arise. However, the liquid becomes more highly volatile if the viscosity is lower than 0.5 mPa•s. Therefore, special handling as a dangerous substance is required, making the liquid unsuitable at these viscosities. If the boiling point of the non-conductive liquid is lower than 100° C., higher quantities of vapour occur. This causes problems related to storage methods for the developing agent, necessitates a tightly sealed structure for the apparatus as a whole, and makes it difficult to improve the work environment. If the electric resistance is lower than $10^{12}\Omega$ cm, the insulating property deteriorates. This causes toner conductivity problems which prevent use of the liquid as a developing agent. Therefore, it is desirable that the electric resistance value be as high as possible. If the surface tension is higher than 21 dyne/cm, the wettability deteriorates. Accordingly, it is desirable that the surface tension value be as low as possible.

The electrostatic latent image liquid developing apparatus of claim 3 uses a non-conductive liquid that has silicone fluid as the main component, and thereby a non-conductive liquid that has the characteristics described in claim 2 can be obtained.

A liquid developing agent in which the toner is dispersed at a high concentration in the non-conductive liquid can be obtained by using toner with an average particle diameter of 0.1 to 5 $\mu$m at concentrations of 5 to 40% by weight. The resolution improves in roughly inverse proportion to the size of the toner particle diameter. Normally, the toner on the printed paper exists as aggregates of 5 to 10 layers. Thus, resolution deteriorates if the average particle diameter of the toner is over 5 $\mu$m. If the average particle diameter of the toner is less than 0.1 $\mu$m, the physical adhesive strength is high and the toner does not release easily during transfer.

In addition, image bearing members that have weak physical adhesive force in relation to the liquid developing agent can be obtained by use of image bearing members that have a release layer formed from a fluorocarbon resin.

Alternatively, image bearing members that have weak physical adhesive force in relation to the liquid developing agent can be obtained by use of image bearing members that have a release layer formed from silicone.

DESCRIPTION OF THE PREFERRED EMBODIMENTS

The first embodiment of this invention is explained below with reference to FIGS. 1 to 5.

Figure 1:
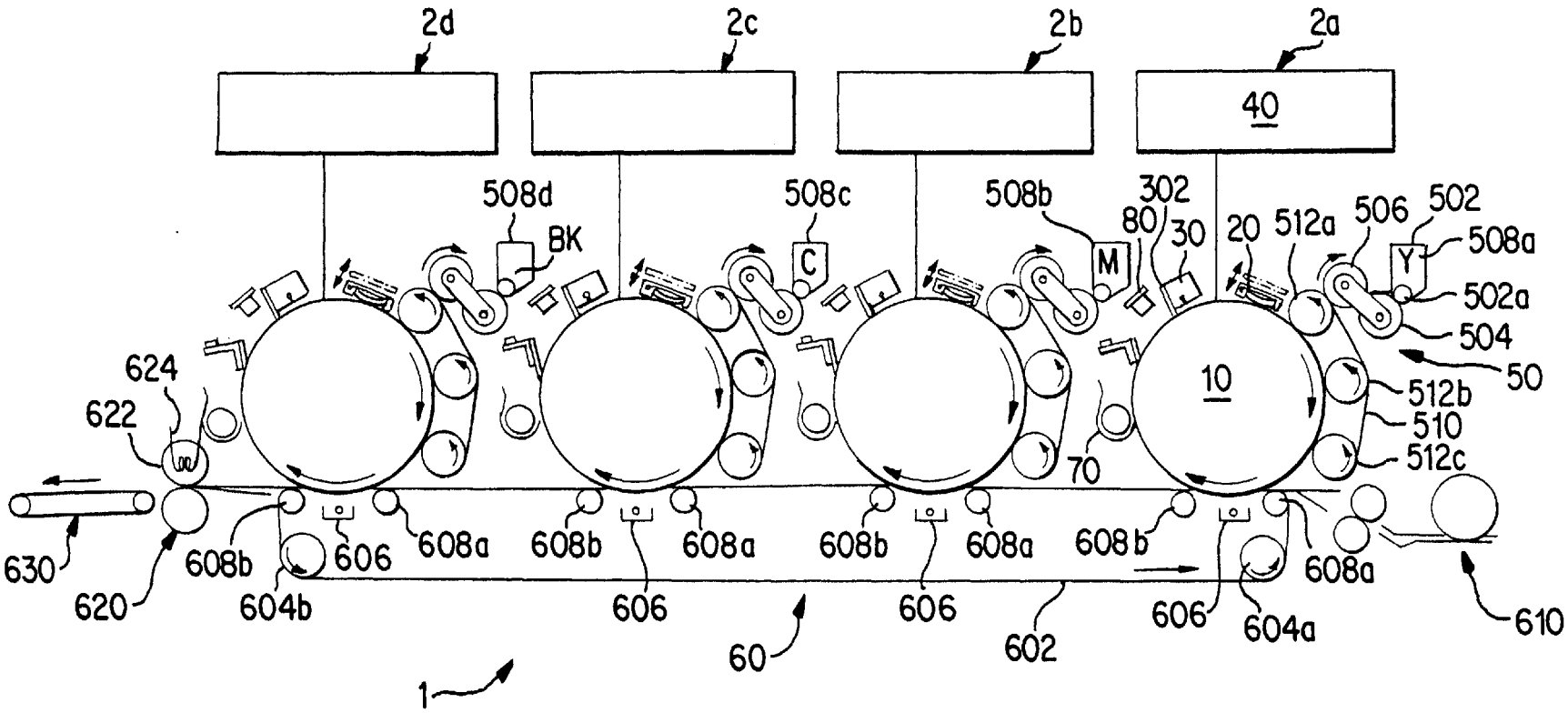
FIG. 1 is an overview of the structure of the multi-color image formation apparatus in the first embodiment of this invention.
Figure 2:
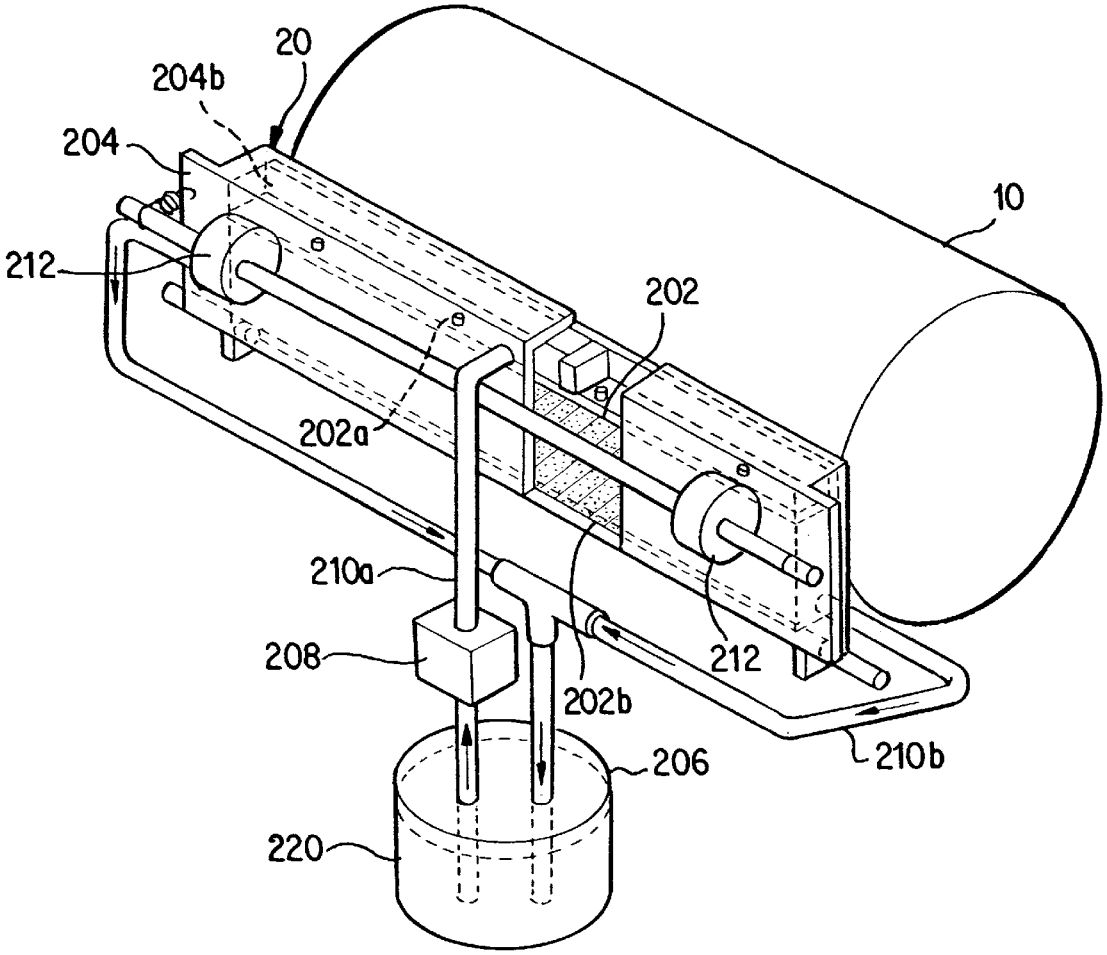
FIG. 2 is an oblique view outlining pre-wet apparatus that can be used by the multi-color image formation apparatus shown in FIG. 1.
Figure 4A:
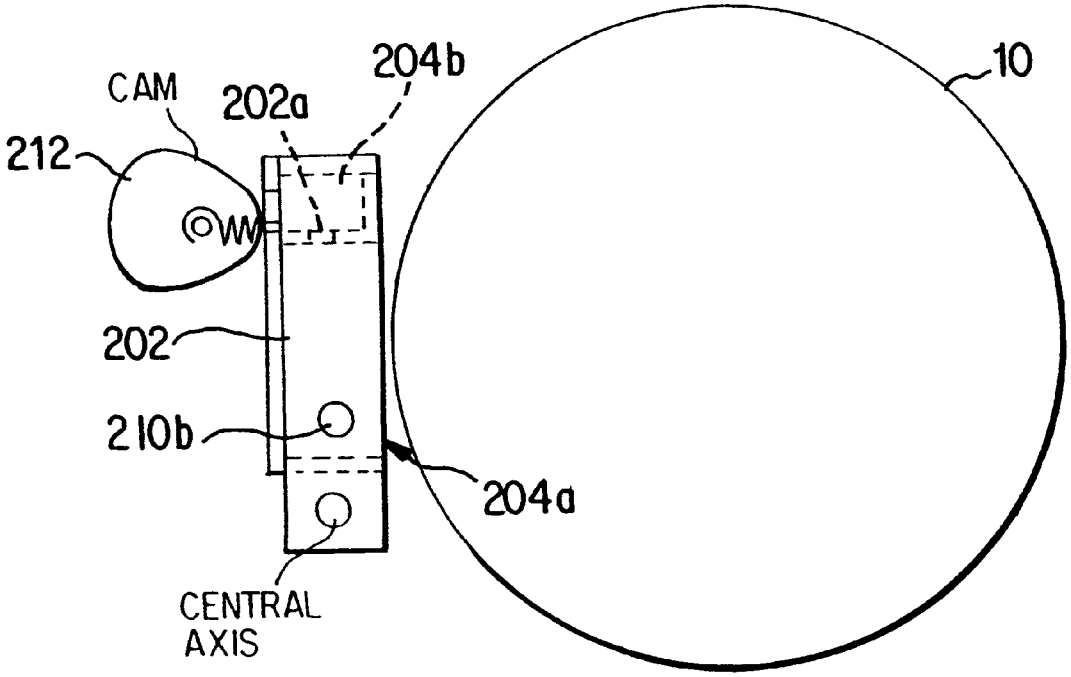
FIGS. 4(A) and 4(B) show the operation of the pre-wet liquid apparatus shown in FIG. 2.
Figure 4B:
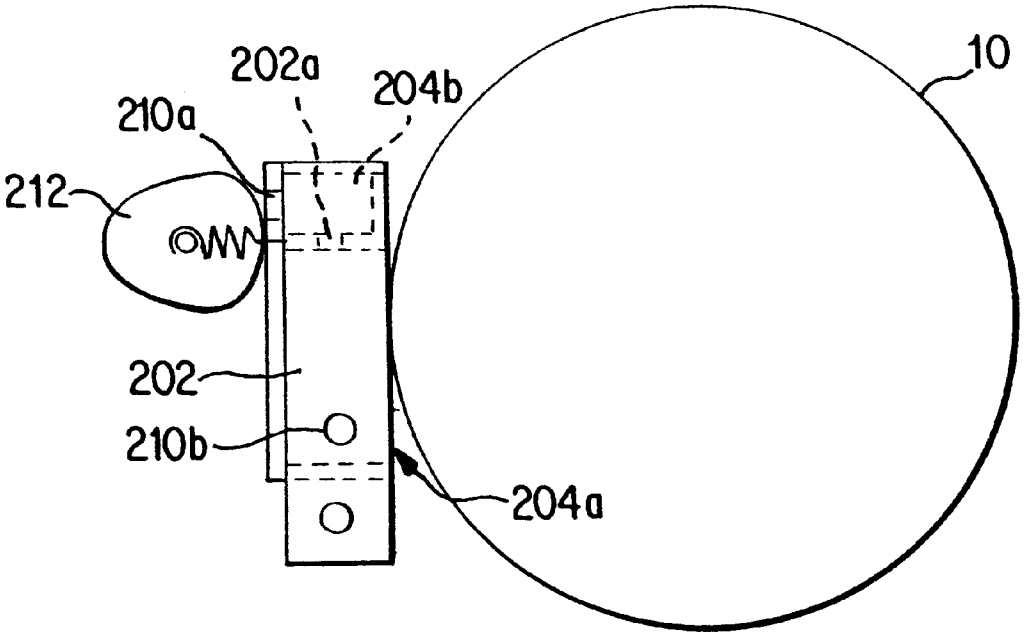
Figure 5:
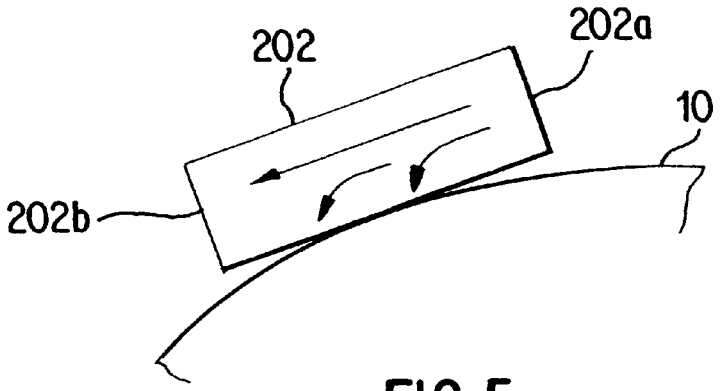
FIG. 5 shows the flow of the pre-wet liquid when a pre-wet liquid supply element is in contact with a photosensitive member.

FIG. 1 is an overview of the structure of the multi-color image formation apparatus that is the first embodiment of this invention, FIG. 2 is an oblique view outlining pre-wet apparatus that can be used by the multi-color image formation apparatus shown in FIG. 1, FIG. 3 shows the operation of the multi-color image formation apparatus shown in FIG. 1, FIG. 4 shows the operation of the pre-wet liquid apparatus shown in FIG. 2, and FIG. 5 shows the flow of the pre-wet liquid when the pre-wet liquid supply element is in contact with the photosensitive member.

Multi-color image formation apparatus 1, which is the first embodiment of this invention, shown in FIG. 1, is provided with developed image formation devices 2*a,* 2*b,* 2*c,* and 2*d* that form developed images corresponding to the yellow, magenta, cyan, and black developing agents, transfer apparatus 60, paper supply apparatus 610, fusing apparatus 620, and paper eject apparatus 630.

Each of the developed image formation devices is provided with a photosensitive member 10, which is the image bearing member, pre-wet apparatus 20 that applies pre-wet liquid to photosensitive member 10, charging apparatus 30 that gives an electric charge to photosensitive member 10, exposure apparatus 40 that exposes the image on photosensitive member 10, developing apparatus 50 that makes a visible image from an electrostatic latent image by means of supplying toner to the parts on photosensitive member 10 where the electrostatic latent image is formed, cleaning apparatus 70 that removes the toner remaining on photosensitive member 10, and charge removal apparatus 80 that neutralizes the charged photosensitive member 10. Note that light-obstructing plate 302 is fitted to the surface of charging apparatus 30 on the side where charge removal apparatus 80 is installed to prevent the charging apparatus from being affected by the charge removal apparatus. Each of the developed image formation devices in the above structure forms a developed image of the corresponding color on a photosensitive member 10. Transfer apparatus 60 sequentially transfers to the specified paper the developed image formed on photosensitive member 10 of each of the developed image formation devices. Paper supply apparatus 610 transports the specified paper to the transfer member of transfer apparatus 60. Fusing apparatus 620 fixes to the paper the developed image transferred by transfer apparatus 60. Paper eject apparatus 630 ejects externally the paper to which the developed image has been fixed.

The related technology used for the electrophotographic type of printers in related art can, in most cases, be used for photosensitive member 10, charging apparatus 30, exposure apparatus 40, cleaning apparatus 70, charge removal apparatus 80, paper supply apparatus 610, fusing apparatus 620, and paper eject apparatus 630. Therefore, explanations are omitted for the above types of apparatus, but the main parts of this invention, that is, pre-wet apparatus 20, developing apparatus 50, and transfer apparatus 60 are explained below.

Pre-wet apparatus 20, shown in FIG. 2, is provided with plate-shaped pre-wet liquid supply element 202 that is approximately as long as the width of the image created on photosensitive member 10, casing 204 that houses pre-wet liquid supply element 202, tank 206 that stores pre-wet liquid 220, pump 208 that draws up pre-wet liquid 220 that is stored in tank 206, tubes 210*a* and 210*b,* and positioning apparatus 212.

A continuously porous material that has a three-dimensional mesh structure in which the pores are continuous, such as Bell-eta (registered trademark of Kanebo, Ltd.) can be used as pre-wet liquid supply element 202. The amount of pre-wet liquid 220 that can be retained by Bell-eta is limited to the capacity of the pores. When the supply of pre-wet liquid 220 exceeds the capacity of the pores, pre-wet liquid 220 can be released uniformly in a perpendicular direction in relation to the direction of flow of pre-wet liquid 220. The side of casing 204 that faces photosensitive member 10 is provided with aperture 204*a* that allows the lower side of pre-wet liquid supply element 202 to contact photosensitive member 10, as shown in FIG. 4. Tube 210*a* carries the pre-wet liquid 220 that is drawn up by pump 208 to supply side 202*a* of pre-wet liquid supply element 202. Note that empty space 204*b* is formed between casing 204 and supply side 202*a* of pre-wet liquid supply element 202. Pre-wet liquid 220 accumulates in empty space 204*b* before being supplied from supply side 202*a.* Tube 210*b* carries the pre-wet liquid 220 that is released from release side 202*b* of pre-wet liquid element 202 to tank 206. When an external signal is not input, positioning apparatus 212 holds pre-wet liquid supply element 202 in the separated position from photosensitive member 10, as shown in FIG. 4(A). When an external signal is input, pre-wet liquid supply element 202 contacts photosensitive member 10, as shown in FIG. 4(B).

Developing apparatus 50 is provided with developing belt 510, which is the developing agent bearing member, drive rollers 512*a,* 512*b,* and 512*c* that provide the rotational drive for developing belt 510 and that support developing belt 510 such that part of the belt contacts photosensitive member 10, tank 502 that stores liquid developing agent 508, supply roller 502*a* provided at the release aperture of tank 502, transport roller 504 provided such that it contacts supply roller 502*a,* application roller 506 provided such that it contacts transport roller 504 and developing belt 510, a regulatory mechanism (not shown in the drawings) such as a blade or roller that regulates the thickness of the layer of the liquid developing agent 508 applied to developing roller 510, and a scraper blade that, after the developing process, scrapes off the liquid developing agent 508 that is adhering to developing belt 510.

Liquid developing agent 508*a* contains yellow toner and is stored in tank 502 of developed image formation device 2*a*, liquid developing agent 508*b* contains magenta toner and is stored in tank 502 of developed image formation device 2*b*, liquid developing agent 508*c* contains cyan toner and is stored in tank 502 of developed image formation device 2*c*, and liquid developing agent 508*d* contains black toner and is stored in tank 502 of developed image formation device 2*d*.

Supply roller 502*a* is rotated in the opposite direction to the direction of rotation of transport roller 504, thereby supplying the liquid developing agent 508 that is stored in tank 502 to transport roller 504. Transport roller 504 is rotated in the opposite direction to the direction of rotation of application roller 506, thereby transporting to the surface of application roller 506 the liquid developing agent 508 that has been supplied by supply roller 502*a*. Application roller 506 is rotated in the opposite direction to the direction of rotation of developing belt 510, thereby applying to the surface of developing belt 510 the liquid developing agent 508 that has been transported by transport roller 504. Rollers are used to supply liquid developing agent 508 to developing belt 510 because a highly viscous liquid developing agent in which toner is dispersed at a high concentration is used in this embodiment, as described later. Consequently, small quantities of liquid developing agent must be applied thinly and evenly to the surface of developing belt 510. Note that transport roller 504 that is provided between supply roller 502*a* and application roller 506 need not be only one roller. Multiple rollers may be provided.

Developing belt 510 is rotated in the opposite direction to the direction of rotation of photosensitive member 10 by drive rollers 512*a*, 512*b*, and 512*c* and thereby supplies to the surface of the latent image on photosensitive member 10 the liquid developing agent 508 that has been applied by application roller 506. A flexible belt-type element is used as developing belt 510. For example, a metal belt such as a seamless nickel belt, a resin belt such as a polyimide film belt or PET film belt, or a rubber belt can be used. This allows the tension of developing belt 510 to be adjusted and the contact pressure between the liquid developing agent layer formed on developing belt 510 and the pre-wet liquid layer formed on photosensitive member 10 to be distributed such that a minute gap is formed between photosensitive member 10 and developing belt 510 through the medium of the liquid developing agent layer and the pre-wet liquid layer. As a result, the liquid developing agent layer and pre-wet liquid layer can be made to touch while maintaining a two-layer structure that allows the two layers to be distinguished from each other.

Note that developing belt 510 must be formed such that an electrical developing bias can be applied. Thus, if a resin or rubber belt is used, a conductive process for the belt surface or addition of minute conductive particles to the belt raw material is required in order to lower the electric resistance value. If the belt itself is conductive, rubber rollers that have a sufficiently low electric resistance value to allow application of a developing bias may be used for drive rollers 512*a*, 512*b*, and 512*c*. If a conductive process is performed for the surface of the belt, a conductor is disposed such that it touches the surface of the belt and the developing bias is applied to the conductor.

Transfer apparatus 60 is provided with transfer belt 602, which is the transfer member, drive rollers 604*a* and 604*b* that provide the rotational drive for transfer belt 602, support rollers 608*a* and 608*b* that support transfer bell 602 such that part of the belt contacts each of the photosensitive members 10 provided by the developed image formation devices and that are connected to an earth that neutralizes the charge on transfer belt 602, corona discharge device 606 that, at the transfer points between transfer belt 602 and each of the photosensitive members 10 provided by the developed image formation devices, gives to transfer belt 602 an electric charge of opposite polarity to the toner, and a scraper blade (not illustrated) that scrapes off toner that has adhered to transfer belt 602.

Transfer belt 602 is rotated in the opposite direction to the direction of rotation of the photosensitive members 10 by drive rollers 604*a* and 604*b*. As a result, the paper that is transported over transfer belt 602 by paper supply apparatus 610 is fed in sequence between transfer belt 602 and each of the photosensitive members 10 provided by the developed image formation devices. A flexible belt-type element is used as transfer belt 602. For example, a metal belt such as a seamless nickel belt, a resin belt such as a polyimide film belt or PET film belt, or a rubber belt can be used. This allows the contact pressure to be distributed when the paper on transfer belt 602 touches the developed images formed on the photosensitive members 10.

A value of from $10^4$ to $10^{11}\Omega$ cm is desirable as the electric resistance value of transfer belt 602. If the electric resistance value is $10^4\Omega$ cm or less, there is a possibility that the paper fed between the photosensitive members 10 and transfer belt 602 may also become charged by the corona discharge device 606. Since the resistance value of the paper varies greatly ($10^9$ to $10^{13}\Omega$ cm) in accordance with the paper type and the humidity, if the charge does reach the paper, the change in the resistance value of the paper inappropriately affects the transfer to the paper of the developed images formed on the photosensitive members 10. If the electric resistance value is increased to $10^{11}\Omega$ cm or higher, the charge on transfer belt 602 becomes too small, the electrostatic force between transfer belt 602 and the developed images formed on the photosensitive members 10 becomes too weak, and insufficient toner is transferred to the paper. Note that, to achieve the above electric resistance values for transfer belt 602 when a resin or rubber belt is used, the electric resistance value must be lowered by, for example, a conductive process being applied to the belt surface or addition of minute conductive particles to the raw material of the belt. If a metal belt is used, it is desirable that the surface of the belt be coated with a resistance layer that has the required electric resistance value.

A fluorocarbon resin coating is applied to the surface of transfer belt 602. This improves the release properties of the transfer belt in relation to the toner and makes it easier for the scraper blade to scrape off the toner adhering to transfer belt 602, thereby preventing transfer belt 602 from becoming dirty.

The image formation raw materials used in the first embodiment of this invention are explained next. The liquid developing agent 508 used in the first embodiment is comprised of toner and a carrier liquid. The toner is comprised of a an epoxy or similar resin as a binder, an electric charge control agent that gives a specific charge to the toner, color pigment, a dispersing agent that disperses the toner evenly, and so on. The composition of the toner is basically the same as the toner used in the liquid developing agents in the related art, but the formulae for the regulation of the electric charge characteristics and dispersion have been changed to suit silicone fluid. If the average particle diameter of the toner is reduced, the resolution improves but the physical adhesive force also increases. This makes the toner difficult to release during transfer. Thus, the average particle diameter of the toner used in the first embodiment is regulated such that most particles are about 2 to 4 $\mu$m in order to improve ease of transfer.

The viscosity of liquid developing agent 508 is determined by the types and concentrations of the carrier liquid, resin, color pigment, electric charge control agent, and other components that are used. For the first embodiment, various viscosities in the range from 50 to 6,000 mPa•s and various toner concentrations in the range from 5 to 40% by weight were tested.

A liquid with high electric resistance, such as dimethyl polysiloxane fluid or a cyclic polydimethylsiloxane fluid, is used as the carrier liquid. Note that, since the layer of liquid developing agent formed on developing belt 510 is formed as a thin film, the carrier liquid contained in the layer of liquid developing agent is only an extremely small amount. Therefore, the amount of carrier liquid included in the layer of liquid developing agent supplied to the surface of the latent image on photosensitive member 10 is also extremely small. As a result, only extremely small amounts of carrier liquid are absorbed by the paper or other substrate during transfer. Therefore, if the viscosity is 1,000 mPa•s or less, remaining carrier liquid usually cannot be seen on the paper or other substrate after fusing. Experiments performed by the inventors showed that, after fusing, remaining carrier liquid could not be seen on the paper when either DC344 from Dow Corning Corporation of America with a viscosity of 2.5 mPa•s or DC345 from Dow Corning Corporation of America with a viscosity of 6.5 mPa•s were used as the carrier liquid for the image printing tests. However, the developing apparatus must have a tightly sealed structure due to the high volatility of these liquids. Further image printing tests were performed using KF-96-20 from Shin-Etsu Silicone Co., Ltd. with a viscosity of 20 mPa•s as the carrier liquid. After fusing, remaining carrier liquid could not be seen on the paper and, furthermore, the volatility is low enough that the developing apparatus does not need a tightly sealed structure. DC344, DC345, and KF-96-20 are all in general use in cosmetic products, have low toxicity, and are extremely safe. There are many types of similar carrier liquids containing silicone fluid or similar components, including KF9937, from Shin-Etsu Silicone Co., Ltd. Any of these may be selected as long as they meet the electric resistance, vapour characteristic, surface tension, safety, and other requirements.

Experiments performed by the inventors showed that fogging and adhesion of clusters of toner can occur if the surface tension is too high. Experiments showed that image quality problems occur if the surface tension is over 21 dyne/cm.

To avoid stability problems with the electric charge of the toner, an electric resistance value of $10^{14}\Omega$ cm or more is desirable and a minimum value of $10^{12}\Omega$ cm or more is required. On the basis of the results of these experiments, an example in which DC345, which is inexpensive and easy to obtain, is used is given in the explanation of the first embodiment.

A liquid which does not cause inaccuracies in the electrostatic latent images formed on the image bearing members, that vaporises easily during fusing, and that does not cause fogging or adhesion of clusters of toner is required as the pre-wet liquid. Examples include DC344, DC200-0.65, DC200-1.0, and DC200-2.0 from Dow Corning Corporation of America and KF96L-1 and KF9937 from Shin-Etsu Silicone Co., Ltd. Generally, selection of a silicone fluid that vaporises easily is desirable.

Experiments performed by the inventors showed that developing, transfer, and fusing dries the liquid without any problems occurring if the viscosity of the liquid is in the range from 0.5 to 3 mPa•s. However, with viscosities from about 5 to 6 mPa•s, both time and heat tend to be required to dry the liquid during fusing. A viscosity of 10 mPa•s is not normally used because too much energy is required for drying. If the viscosity is reduced to 0.5 mPa•s or less, the liquid becomes more volatile and is not suitable due to the applicability of constraints on handling dangerous substances. In addition, a liquid with a boiling point of 250° C. or less is desirable because the paper is affected by application of heat.

The surface tension should be as low as possible in order to avoid an adhesive force between the developing agent and the image bearing members, to improve the release properties and prevent the image becoming dirty, and to improve the resolution in the image quality. Experiments performed by the inventors showed that the limit is about 20 to 21 dyne/cm and that a value below this must be selected.

If the electric resistance is too low, the charge of the latent image leaks and the image fades. Therefore, a liquid with an electric resistance that is as high as possible must be used. Experiments showed that an electric resistance of about $10^{14}\Omega$ cm or more is desirable and a minimum value of $10^{12}\Omega$ cm is required.

The operation of multi-color image formation apparatus 1 of this embodiment is explained next.

Note that the timing for the operations described above, from charging through to charge neutralization, takes into account the peripheral speed of transfer belt 602 such that the developed images, each formed on the photosensitive member 10 of one of the developed image formation devices, are transferred to the paper sequentially at the positions that will provide proper registration. The transfer sequence is developed image formation device 2*a,* developed image formation device 2*b,* developed image formation device 2*c,* then developed image formation device 2*d.* The timing for the operation of the developed image formation devices may also be determined by use of a sensor that detects the movement of the paper positioned on transfer belt 602.

Figure 3A:
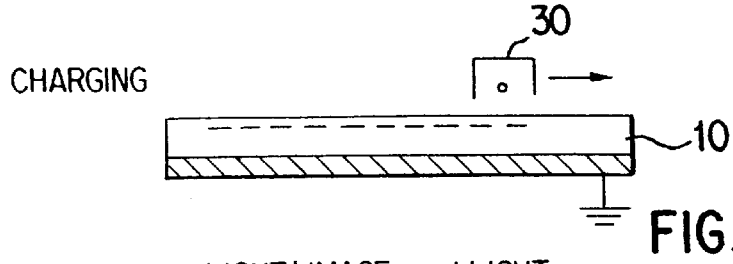
FIGS. 3(A)–3(F) show the operation of the multi-color image formation apparatus shown in FIG. 1.
Figure 3B:
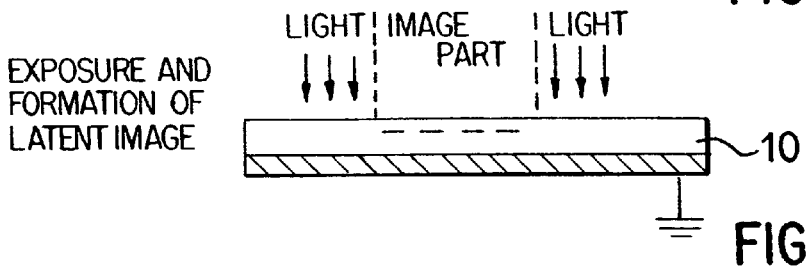

First, as shown in FIG. 3(A), the surface of photosensitive member 10 is charged by charging apparatus 30. Generally, a corona discharge device is used as charging apparatus 30. Next, the image on the charged photosensitive member 10 is exposed by, for example, a laser scanner to form an electrostatic latent image on the surface of photosensitive member 10. The parts hit by the light from the laser scanner are made conductive and therefore lose the electrical charge, as shown in FIG. 3(B). The parts not hit by the light remain as an electrically charged image, that is, as an electrostatic latent image.

Figure 3C:
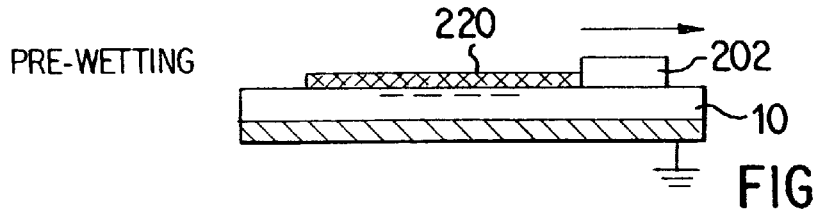

Then, as shown in FIG. 3(C), pre-wet apparatus 20 applies the above pre-wet liquid 220 to photosensitive member 10. When an external signal is input, pre-wet apparatus 20 moves pre-wet liquid supply element 202 into contact with photosensitive member 10. Pre-wet liquid 220 is circulated continuously inside pre-wet liquid supply element 202 by means of pump 208. The pre-wet liquid 220 that exceeds the capacity of the pores in the Bell-eta used as pre-wet liquid supply element 202 is released from release side 202*b* of pre-wet liquid supply element 202, as shown in FIG. 5, and also from the lower surface of pre-wet liquid supply element 202. This provides a uniform application of the pre-wet liquid to photosensitive member 10 without causing damage to photosensitive member 10.

Figure 3D:
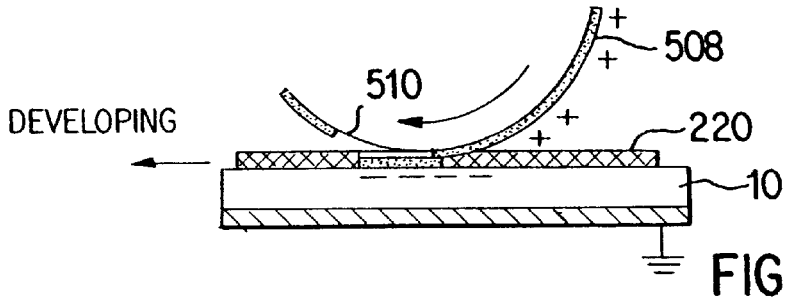

Next, developing apparatus 50 makes the electrostatic latent image into a visible image. The liquid developing agent 508 that is stored in tank 502 is supplied to transport roller 504 by supply roller 502*a*. The liquid developing agent 508 that is supplied from transport roller 504 is transported to application roller 506 then applied to developing belt 510. A blade, roller, or other regulatory means regulates the thickness of the layer of liquid developing agent 508 applied to developing belt 510 such that a thin film is formed on developing belt 510. The thin layer of liquid developing agent formed on developing belt 510 in this way is brought close to the electrostatic latent image formed on the surface of photosensitive member 10, as shown in FIG. 3(D), such that electrostatic force migrates the charged toner to photosensitive member 10 and forms a developed image on photosensitive member 10.

Figure 3E:
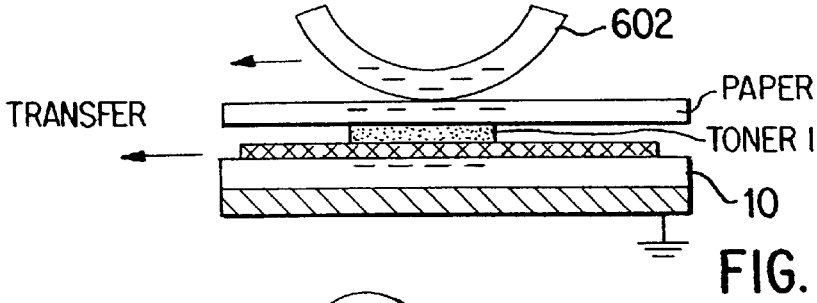

Next, transfer apparatus 60 transfers the developed image from photosensitive member 10 to the paper which is the substrate. Corona discharge device 606 charges transfer belt 602 with a charge of opposite polarity to the toner. Hence, as shown in FIG. 3(E), the developed image formed on photosensitive member 10 is transferred to the paper my means of the electrostatic force generated between the toner and transfer belt 602. Cleaning apparatus 70 then removes the liquid developing agent 508 remaining on photosensitive member 10, and charge removal apparatus 80 neutralises the charge on photosensitive member 10.

Figure 3F:
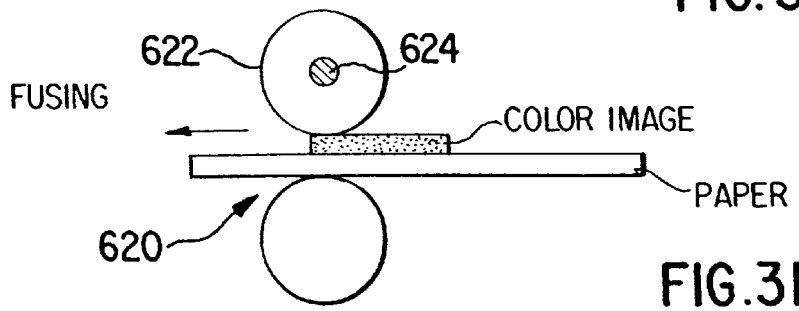

Multi-color image formation apparatus 1 of this embodiment performs the above operations, from charging to charge neutralization, sequentially for developed image formation device 2*a,* developed image formation device 2*b,* developed image formation device 2*c,* then developed image formation device 2*d.* The timing of these operations is such that the developed images formed on the photosensitive members 10 are transferred to the paper sequentially at the positions that will provide proper registration. Thus, yellow, magenta, cyan, and black developed images are sequentially transferred to the paper to form a color image on the paper. Fusing heater 624 that is provided within fuser roller 622 of fusing apparatus 620 thermally fuses the transferred toner and fixes it to the paper, as shown in FIG. 3(F). Then, the paper to which the color image is fixed is ejected externally by paper eject apparatus 630.

Figure 6:
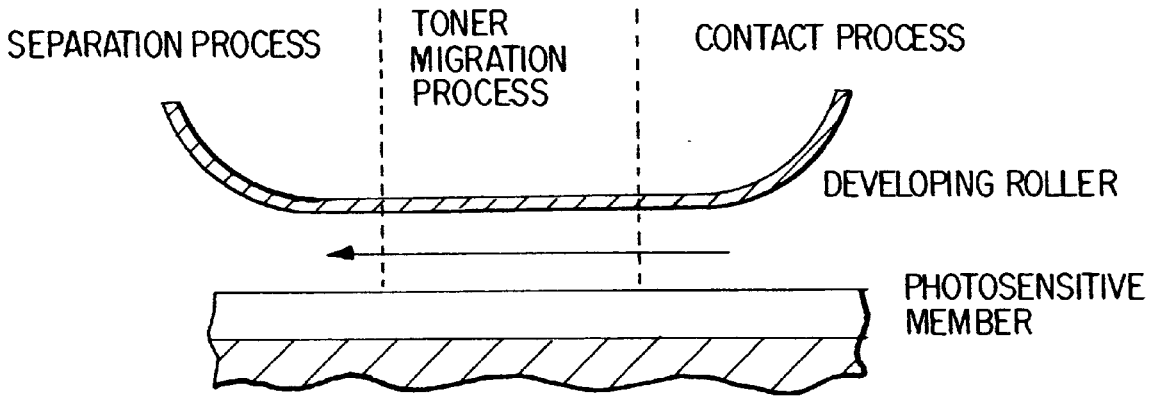
FIG. 6 shows the overall developing process.
Figure 7:
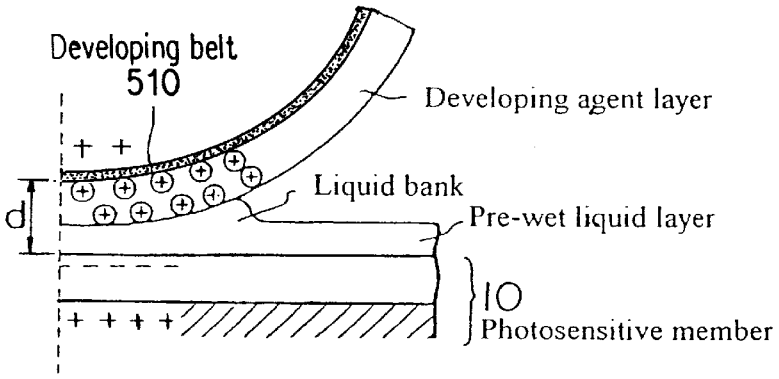
FIG. 7 shows details of the contact process.
Figure 8:
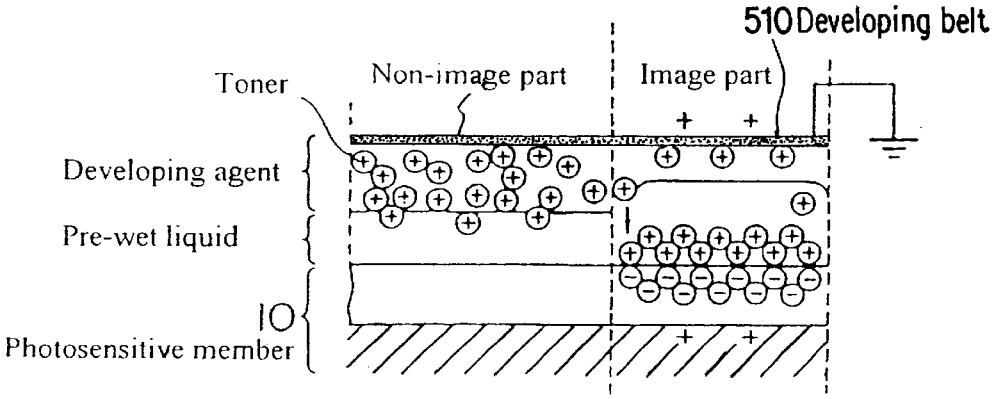
FIG. 8 shows details of the toner migration process.
Figure 9:
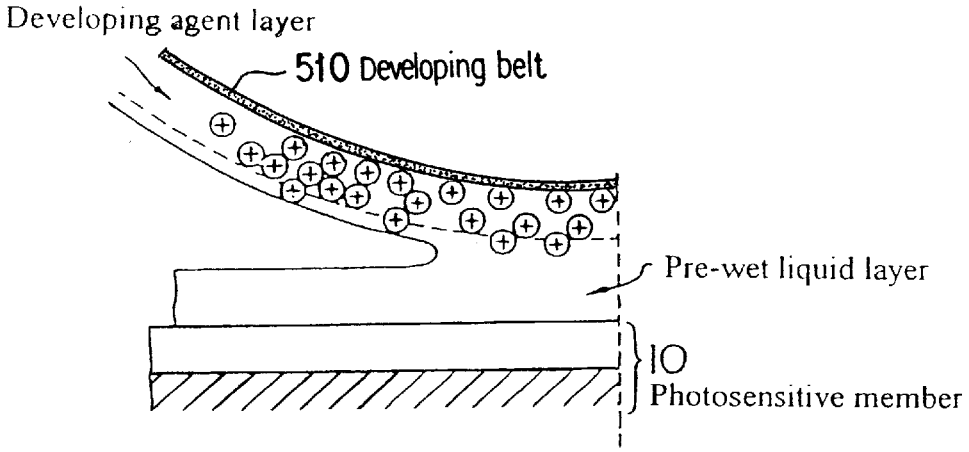
FIG. 9 shows the separation process at non-image parts.
Figure 10:
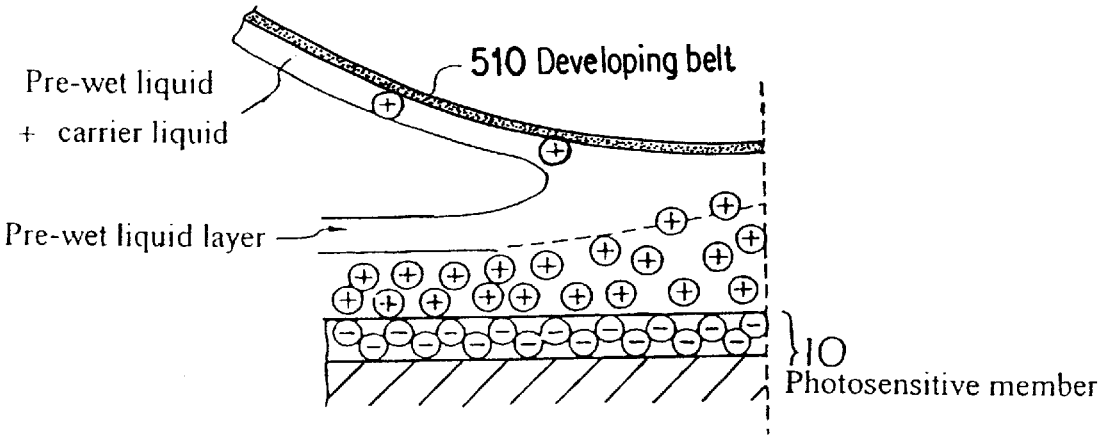
FIG. 10 shows the separation process at image parts.

FIGS. 6 to 10 explain the details of the developing process in the first embodiment of this invention. FIG. 6 shows the overall developing process, FIG. 7 shows the details of the contact process, FIG. 8 shows the details of the toner migration process, FIG. 9 shows the separation process at the non-image parts, and FIG. 10 shows the separation process at the image parts. Unlike developing processes in the related art, the developing process of this embodiment can be thought of as consisting of the following three processes, as shown in FIG. 6: the contact process in which the developing belt contacts the photosensitive member and the liquid developing agent contacts the pre-wet liquid layer; the toner migration process in which the liquid developing agent layer and the pre-wet liquid layer make soft contact, allowing the toner to migrate; and the separation process in which the developing belt separates from the photosensitive member and the toner adhering to the developing belt separates from the toner adhering to the photosensitive member.

Developing belt 510 is constructed as a flexible belt-type element. This allows the tension of developing belt 510 to be adjusted such that the contact force is distributed when the liquid developing agent layer on developing belt 510 and the pre-wet liquid layer on photosensitive member 10 touch, as shown in FIG. 7. Thus the layer of highly viscous liquid developing agent, comprised of a carrier liquid and toner, and the pre-wet liquid layer form a soft contact. During the contact process, a minute gap d is formed between developing belt 506 and photosensitive member 10 by means of the liquid developing agent layer and the pre-wet liquid layer. Note that some of the pre-wet liquid, which has the lower viscosity of the two liquids, is pushed out to produce a liquid bank of pre-wet liquid.

During the toner migration process, the electrical field formed between the electric charge on photosensitive member 10 and developing belt 510 causes the toner at the image parts to migrate, as shown in FIG. 8, to the latent image surface through the medium of the pre-wet liquid layer, mainly by means of the Coulomb force. At the non-image parts, the surface of photosensitive member 10 and the liquid developing agent layer are basically separated by the pre-wet liquid layer and, therefore, unnecessary toner does not adhere to the surface of photosensitive member 10.

During the separation process, the liquid developing agent layer basically remains on developing belt 510 at the non-image parts, as shown in FIG. 9. When the pre-wet liquid layer and the liquid developing agent layer separate at their interface into two layers, part of the pre-wet liquid layer, which has the lower viscosity, is transferred to the liquid developing agent layer to achieve the separation. Accordingly, the separation point for the two layers can be seen as being a point within the pre-wet liquid layer. At the image parts, the toner that has migrated to the surface of photosensitive member 10 pushes the pre-wet liquid layer away such that the pre-wet liquid layer is located on top of the toner layer and the separation is made at a point within that pre-wet liquid layer, as shown in FIG. 10. Some of the carrier liquid that remains on developing belt 510 after the toner has migrated and some of the pre-wet liquid form a layer. The pre-wet liquid remaining on photosensitive member 10 can be moved easily during the subsequent transfer process by the electrostatic force of the toner.

Figure 11:
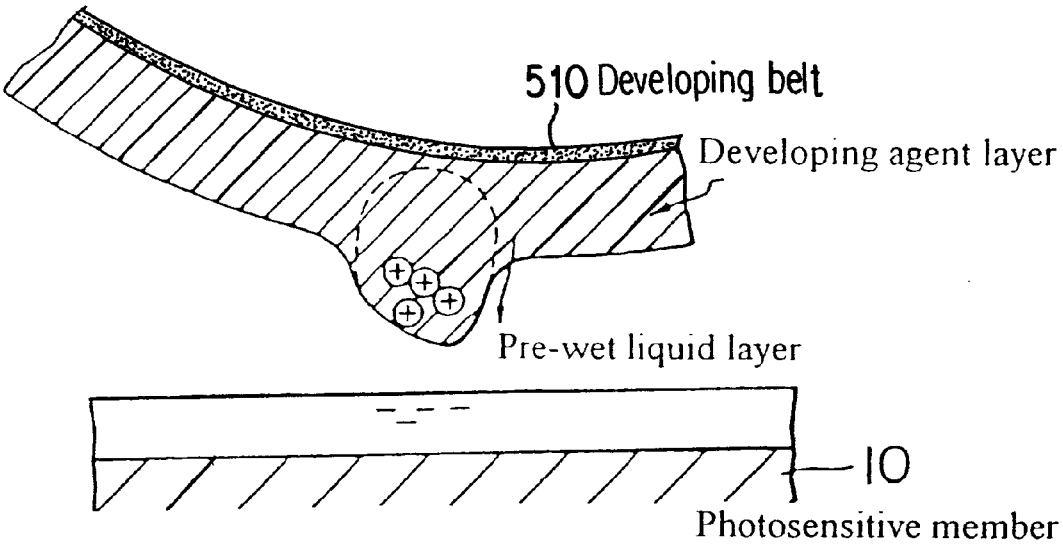
FIG. 11 shows the significance of applying the liquid developing agent as a thin layer.

FIG. 11 shows the significance of the liquid developing agent being in the form of a thin film. If the layer of liquid developing agent applied to developing belt 510 is too thick, the high viscosity of liquid developing agent 508 causes excessive toner adherence, which produces image noise. This is because the excessive viscosity between the toner selection that should be moved from developing belt 510 to the surface of photosensitive member 10 by the electrostatic force forms a cluster with the surrounding toner and the cluster moves to photosensitive member 10. To suppress the formation of such clusters, the value of the minimum layer thickness of liquid developing agent layer that will provide good developing results must be determined.

Figure 12:
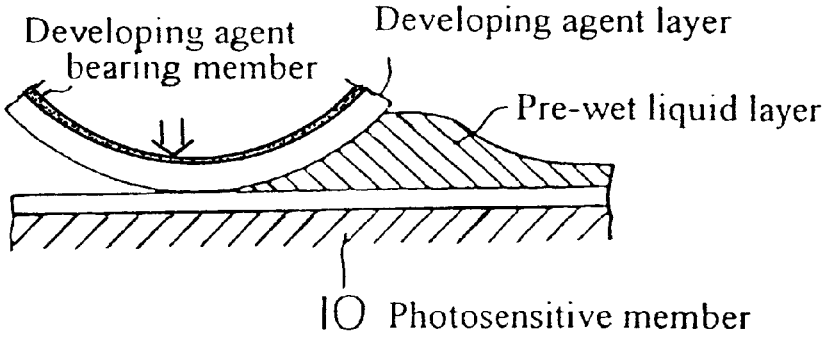
FIG. 12 shows details of a hard contact made between a developing roller and a photosensitive member.
Figure 13:
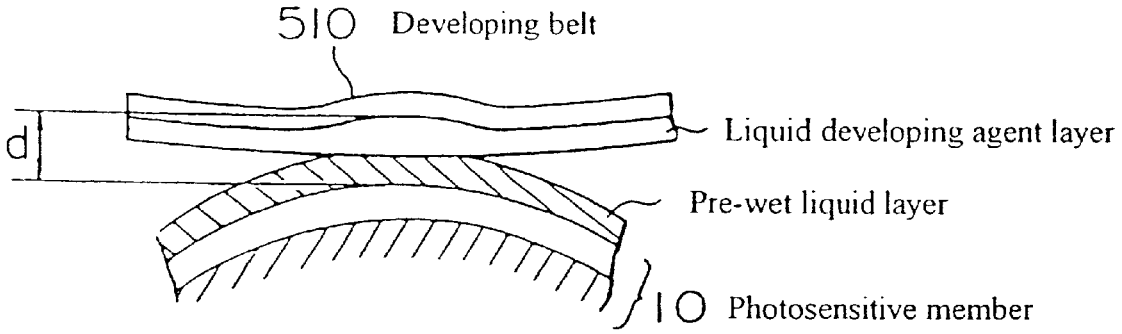
FIG. 13 shows the soft contact achieved in this invention.

FIG. 12 shows how hard contact is made between a developing roller formed from a rigid body, used as a developing agent bearing member, and a photosensitive member, and FIG. 13 shows the soft contact achieved in this embodiment. As explained above, the function of the pre-wet liquid layer during the developing process is of major importance to image formation in this embodiment. Accordingly, maintenance of the two-layer structure of the pre-wet liquid layer and the liquid developing agent layer is an important pre-condition of the developing process. If a developing roller and a photosensitive member are brought into hard contact as shown in FIG. 12, the two-layer structure cannot be maintained. Therefore, in this embodiment, developing belt 510 formed from a flexible belt-type element is used as the developing agent bearing member. The tension of developing belt 510 is adjusted such that the contact force is distributed when the liquid developing agent layer on developing belt 510 and the pre-wet liquid layer on photosensitive member 10 touch. As a result, the liquid developing agent layer and pre-wet liquid layer can be made to touch while maintaining a two-layer structure, and minute gap d is formed between developing belt 510 and photosensitive member 10 through the medium of the liquid developing agent layer and the pre-wet liquid layer.

Next, optimization of the liquid developing agent layer thickness, pre-wet layer thickness, and the developing gap is explained. The liquid developing agent layer must be thin if the viscosity of the liquid developing agent is 50 to 100 mPa•s or higher, and particularly so if the viscosity is 500 mPa•s or higher. The ideal layer thickness is just a little thicker than the layer thickness that can supply the toner developing capacity (that is, the concentration when a single color is applied to a large area) required during developing. This is because, when a highly viscous liquid developing agent is used, the electrostatically selected toner brings excess toner along with it when migrating to the photosensitive member during developing due to the viscosity of the liquid. This results in the adhesion of superfluous toner and causes images to become dirty. The experiments performed by the inventors concerning developing agents with high toner concentrations showed that good images can be obtained using layer thicknesses starting from 5 $\mu$m, or using up to about 40 $\mu$m for comparatively lower toner concentrations. In addition, if a developing agent with a toner concentration of 20 to 30% by weight is used, good image quality can be obtained using toner layer thicknesses of about 8 to 20 $\mu$m.

The optimum value for the thickness of the pre-wet liquid layer depends on the viscosity and surface tension of the selected pre-wet liquid. If the layer is too thin, the highly viscous liquid developing agent adheres to the photosensitive member in a disorderly manner, which causes images to become dirty. The optimum value can be confirmed if the images become cleaner as the quantity of pre-wet liquid is increased. As the quantity of pre-wet liquid is increased even further, the latent image electric charge flows causing the clarity and resolution to deteriorate, the toner spreads during developing, and the image tends to fade. In experiments in which DC344 was used, good results were obtained with thicknesses of 30 $\mu$m or less, and even better results with thicknesses of 20 $\mu$m or less. With liquids with even lower viscosities, good results can be obtained with both thinner and thicker layers. The range of optimum values tends to be narrower with more highly viscous liquids.

As with the developing methods in related art, the image quality attributes of resolution and the uniformity of the density in solid parts improves as the gap between the photosensitive member and the developing belt is made smaller. When powder developing agents are used, the toner to be used for developing is freed from the developing agent bearing member or carrier particles by mechanical impact and electrostatic force. However, in the highly viscous liquid developing agent used in the first embodiment, the adhesive force between the toner particles is too strong to allow use of this type of developing. In other words, developing does not take place through the medium of an air space between the liquid developing agent layer and the photosensitive member. Rather, contact between developing belt 510 and the liquid developing agent layer, between the liquid developing agent layer and the pre-wet liquid layer, and between the pre-wet liquid layer and the photosensitive member is mandatory. Therefore, developing gap d must be no larger than the sum of the thicknesses of the developing agent layer and the pre-wet liquid layer, but large enough to avoid disturbing the layers. In this embodiment, the tension of developing belt 510 is set in accordance with differences in the developing agent viscosity and the toner concentration such that, when the pre-wet liquid layer on photosensitive member 10 and the liquid developing agent layer on developing belt 510 touch, gap d is from 8 $\mu$m to 50 $\mu$m.

Table 1 shows the results of image printing experiments performed under the above conditions. These results indicate that the most suitable viscosity ranges for the developing agent and the pre-wet liquid in the developing method of this embodiment are developing agent viscosity values from 100 mPa•s to 6,000 mPa•s and pre-wet liquid viscosity values from 0.5 to 5 mPa•s. The image quality is affected by the thickness of the layer of liquid developing agent on the developing belt, the thickness of the pre-wet liquid layer, the developing gap, and other factors, but even if the various developing conditions are optimised, the general trends shown in Table 1 apply, and the test results confirm that the optimum characteristics for the liquid developing agent are within the ranges shown in Table 1. The Dow Corning DC200 series was used as the pre-wet liquid silicone fluid, and Dow Corning DC345 was used as the carrier liquid in the developing agent.

TABLE 1

| | | Toner concentration | Viscosity of pre-wet liquid (mPa · s) | | | | |
|---|---|---|---|---|---|---|---|
| | (mPa · s) | (% by wt) | 0.6 5 | 1.5 | 3.0 | 5.0 | 10 |
| Viscosity of developing agent | 50 | 5 | Image density tends to be low, and the uniformity of the toner distribution deteriorates slightly | | | | Vaporisation of fluid remaining on the paper is too slow to be practical |
| | 100 | 10 | Density tends to be slightly low | | | Vaporisation of fluid remaining on the paper is slow (practical limit) | |
| | 500 | 20 | Good quality images (both density and resolution) can be obtained | | | | |
| | 1,000 | 22 | | | | | |
| | 2,000 | 25 | | | | | |
| | 3,000 | 30 | | | | | |
| | 6,000 | 40 | | | | | |

The first embodiment of this invention is provided with developed image formation device 2*a* that forms yellow developed images, developed image formation device 2*b* that forms magenta developed images, developed image formation device 2*c* that forms cyan developed images, and developed image formation device 2*d* that forms black developed images. A developed image of the corresponding color, yellow, magenta, cyan, or black, is formed on the photosensitive member 10 of each of the developed image formation devices, and the developed images formed on these photosensitive members 10 are transferred sequentially to the substrate, thereby enabling high-speed image printing.

In addition, in the first embodiment of this invention, silicone fluid is used as the carrier liquid in the liquid developing agent. In comparison with the carrier liquids in the related art, silicone fluid has the advantages described below.

In the liquid developing agents in related art, IsoparG (registered trademark of the Exxon Corporation) is generally used as the carrier liquid. Since the resistance value for Isopar is not as high as for silicone fluid, the toner charge properties deteriorate as the toner concentration is increased, that is as the space between particles becomes smaller. Accordingly, the toner concentration levels in Isopar are limited. In contrast, the silicone fluid used in this embodiment has a sufficiently high resistance value to allow increases in the toner concentration. Generally, the toner disperses well in Isopar and, therefore, the toner particles tend to repel each other even when the toner concentration is 1 to 2% by weight, allowing uniform toner dispersion. In contrast, toner does not disperse well in silicone fluid at concentrations of 1 to 2% by weight and precipitates easily. However, if the toner concentration is increased to a level from 5 to 40% by weight, the toner becomes tightly packed and disperses evenly. Thus, a highly viscous liquid developing agent in which the toner is very densely dispersed is used in this embodiment. As a result, the volume of developing liquid can be greatly reduced in comparison with the low-concentration liquid developing agents in the related art, and reduction in the size of the developing apparatus can be achieved. Furthermore, since the liquid developing agent used in this embodiment is a highly viscous liquid, handling and storage is easier than with the low-viscosity liquid developing agents and powder developing agents of related art.

The Isopar used in the liquid developing agents in the related art is highly volatile and releases an unpleasant odour, as mentioned above. This adversely affects the work environment and causes environmental problems. In contrast, the silicone fluid used in this embodiment is a safe liquid, as amply evidenced by its use in cosmetic products, and is odourless. Thus, use of this embodiment can improve the work environment and avoid environmental problems.

In addition, in the first embodiment of this invention, use of transfer belt 602 formed from a flexible belt-type element as the transfer member enables the contact pressure to be distributed when the developed images, each formed on the surface of the electrostatic latent image on a photosensitive member 10, touch the paper used as the substrate. This prevents the occurrence of image inaccuracies and allows the developed images to be transferred to the paper without the image spreading.

Further, in the first embodiment, use of developing belt 510 formed from an elastic belt-type element as the developing agent bearing member allows the tension of developing belt 510 to be adjusted and allows the contact force to be distributed when the liquid developing agent layer formed on developing belt 510 touches the pre-wet liquid layer formed on photosensitive member 10. As a result, the liquid developing agent layer and pre-wet liquid layer can maintain a two-layer structure when they are brought into contact during the developing process. This can prevent the occurrence of inaccuracies in the pre-wet liquid layer and, consequently, prevent adhesion of toner to the non-image parts on the photosensitive member and prevent the occurrence of image inaccuracies.

Figure 14:
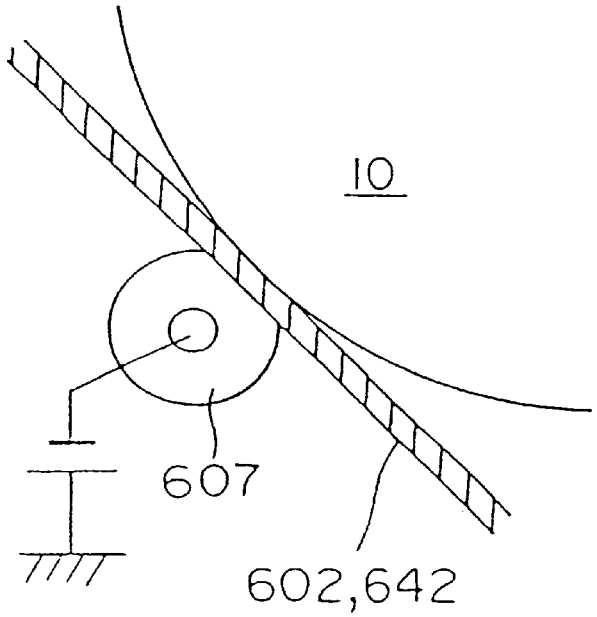
FIG. 14 shows a modified example of transfer apparatus that can be used by the multi-color image formation apparatus shown in FIG. 1.

Note that the transfer apparatus explained in the above description of the first embodiment uses corona discharge device 606 to charge transfer belt 602 with a charge of opposite polarity to the toner and thereby transfers to the paper the developed images, each formed on the surface of the latent image on a photosensitive member 10, but this invention is not restricted in this matter. The transfer apparatus may, for example, use rubber rollers that have low electric resistance values and to which minute conductive particles have been added as the support rollers 608*a* and 608*b* that support transfer belt 602. A bias voltage is then applied to these support rollers in order to apply the bias voltage to transfer belt 602 and transfer the developed images. Alternatively, as shown in FIG. 14, conductive sponge roller 607 may press from the back of transfer belt 602 at the points of transfer between transfer belt 602 and the photosensitive members 10 to give an appropriate degree of pushing force and a bias voltage may be applied to sponge roller 607 in order to transfer the developed images. In this case support rollers 608*a* and 608*b* are not earthed.

The above description of the first embodiment describes use of transfer belt 602, formed from a flexible belt-type element, as the transfer member, but this invention is not restricted in this matter. The transfer member may be an elastic cylindrical member. In addition, if the image bearing members are formed as flexible belt-type elements, a roller formed from a metal or other conductive material may be used as the transfer member. Furthermore, the transfer apparatus is not restricted to one transfer member. Multiple transfer members may be provided, one for each of the photosensitive members provided for the developed image formation steps, and a transport belt or similar may transport the paper between each of the transfer members.

The second embodiment of this invention is explained next, with reference to FIG. 15.

Figure 15:
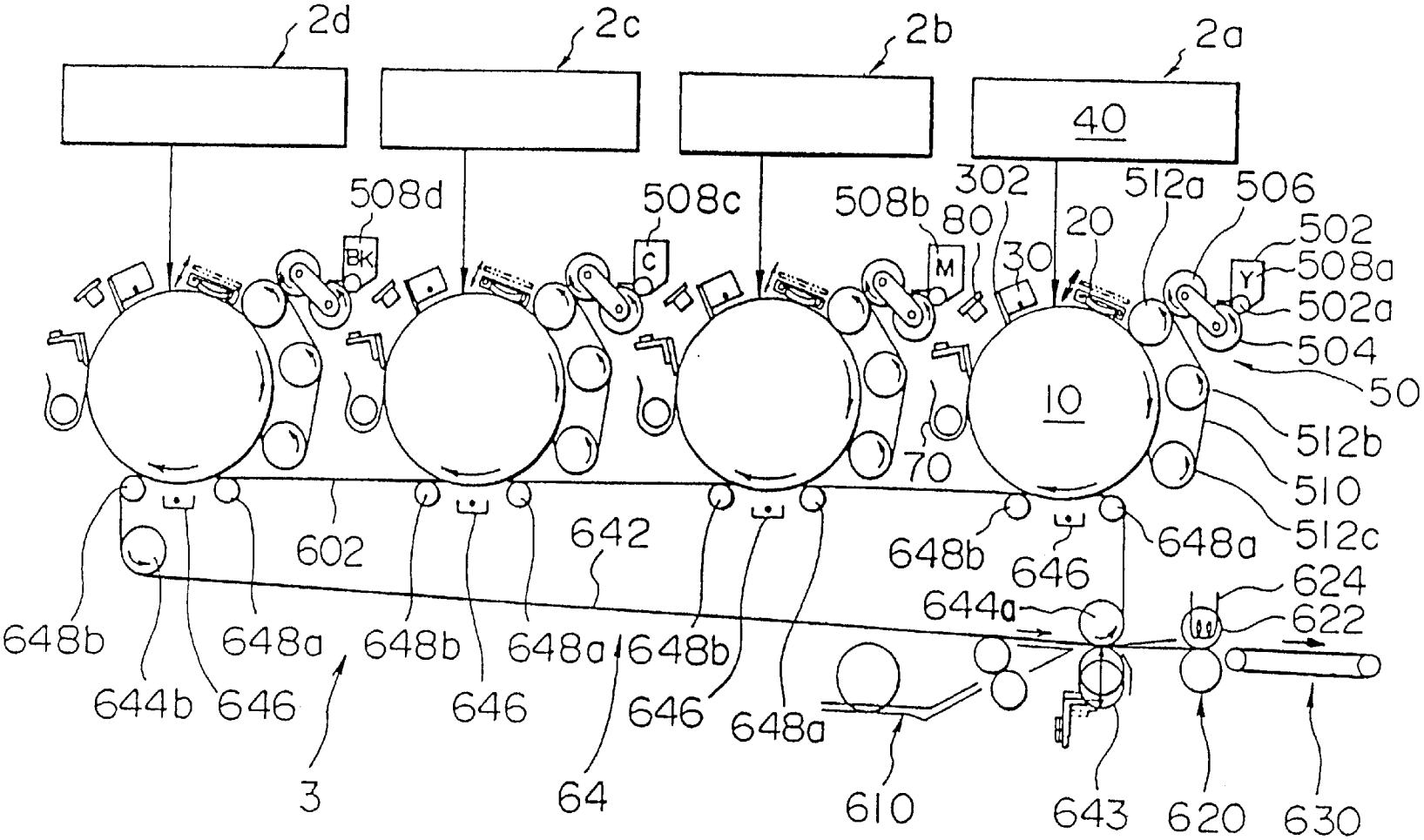
FIG. 15 is an overview of the structure of the multi-color image formation apparatus in the second embodiment of this invention.

FIG. 15 is an overview of the structure of the multi-color image formation apparatus that is the second embodiment of this invention. Note that the components in the multi-color image formation apparatus shown in FIG. 15 that have the same function as components in the first embodiment are given the same or related reference numbers and detailed explanations for those functions are omitted.

The difference between multi-color image formation apparatus 3 that is the second embodiment of this invention and multi-color image formation apparatus 1 that is the first embodiment is that transfer apparatus 64 replaces transfer apparatus 60, as shown in FIG. 15. Transfer apparatus 64 is provided with intermediate transfer belt 642, which is the intermediate transfer member for the first-stage transfer step, drive rollers 644*a* and 644*b* that provide rotational drive for intermediate transfer belt 642, support rollers 648*a* and 648*b* that support intermediate transfer belt 642 such that part of the belt contacts the photosensitive member 10 provided for each of the developed image formation devices and that are earthed to neutralise the charge on intermediate transfer belt 642, corona discharge device 646 that applies a charge of opposite polarity to the toner to intermediate transfer belt 642 at the points of contact between intermediate transfer belt 642 and each of the photosensitive members 10 provided by the developed image formation devices, and second-stage transfer roller 643, which is the second-stage transfer member for the second-stage transfer step, provided such that it can be moved away from intermediate transfer belt 642.

Intermediate transfer belt 642 is rotated in the opposite direction to the direction of rotation of the photosensitive members 10 by drive rollers 644*a* and 644*b*. A flexible belt element is used as intermediate transfer belt 642. For example, a metal belt such as a seamless nickel belt, a resin belt such as a polyimide film belt or PET film belt, or a rubber belt can be used. This allows the contact pressure to be distributed when intermediate transfer belt 642 touches the developed image formed on each of the photosensitive members 10. Note that, if a resin or rubber belt is used, a conductive process for the belt surface or addition of minute conductive particles to the belt raw material is required in order to provide the required electric resistance value. If a metal belt is used, it is desirable to coat the belt surface with a resistance layer.

A surface layer of teflon, silicone, or other material that has good release properties is formed on intermediate transfer belt 642. This weakens the physical adhesive force between the toner and intermediate transfer belt 642 and facilitates migration of the toner to the paper.

Second-stage transfer roller 643 rotates in the opposite direction to the direction of rotation of intermediate transfer belt 642 such that the paper transported by paper supply apparatus 610 is fed between intermediate transfer belt 642 and second-stage transfer roller 643. At this time, second-stage transfer roller 643 is pressed against intermediate transfer belt 642 through the medium of the paper. Second-stage transfer roller 643 is connected to power supply apparatus (not illustrated), which applies a second-stage transfer bias to second-stage transfer roller 643.

A fluorine coating is given to the surface of second-stage transfer roller 643. This provides good release properties in relation to the toner, facilitates removal of toner that has adhered to second-stage transfer roller 643, and can prevent second-stage transfer roller 643 from becoming dirty.

By means of the structure described above, transfer apparatus 64 first sequentially transfers to intermediate transfer belt 642 the developed images, each formed on the photosensitive member provided for one of the developed image formation devices, timing the transfers to achieve proper registration, and thereby forms a full-color developed image on intermediate transfer belt 642. Next, the full-color developed image formed on intermediate transfer belt 642 is transferred to the paper in the second-stage transfer by means of the pushing force of second-stage transfer roller 643 against intermediate transfer belt 642 and by the electromagnetic force generated by the second-stage transfer bias applied to second-stage transfer roller 643. In this way, a color image is formed on the paper. Note that the other operations of multi-color image formation apparatus 3 of the second embodiment are the same as for the first embodiment and, therefore, details of these are omitted.

In the second embodiment of this invention, the developed images, each formed on the photosensitive member 10 provided for one of the developed image formation devices, are transferred sequentially to intermediate transfer belt 642 and thereby form a full-color developed image on intermediate transfer belt 642. Since the second-stage transfer then transfers to the substrate the full-color developed image that has been formed on intermediate transfer belt 642, paper alignment and similar matters do not require as much consideration as when the developed images, each formed on one of the photosensitive members, are sequentially transferred directly to paper. Thus, it is easier to achieve proper registration when the color image is transferred to the paper. Other results are the same as for the first embodiment.

Note that, in the second embodiment described above, the transfer apparatus uses corona discharge device 646 to charge intermediate transfer belt 642 with an electric charge of opposite polarity to the toner and thereby transfers the developed images, each formed on the surface of the latent image on one of the photosensitive members 10, to intermediate transfer belt 642 in the first-stage transfer, but this invention is not restricted in this matter. The transfer apparatus may, for example, use rubber rollers that have low electric resistance values and to which minute conductive particles have been added as support rollers 648*a* and 648*b* that support intermediate transfer belt 642. A bias voltage may then be applied to support rollers 648*a* and 648*b* in order to apply the bias voltage to intermediate transfer belt 642 and transfer the developed image. Alternatively, as shown in FIG. 14, conductive sponge roller 607 may press from the back of intermediate transfer belt 642 at the points of transfer between intermediate transfer belt 642 and the photosensitive members 10 to give an appropriate degree of pushing force and a bias voltage may be applied to sponge roller 607 in order to achieve the first-stage transfer of the developed image. In this case, support rollers 648*a* and 648*b* are not earthed.

The above description of the second embodiment describes use of intermediate transfer belt 642, formed from a flexible belt-type element, as the intermediate transfer member, but this invention is not restricted in this matter. The intermediate transfer member may be an elastic cylindrical member. In addition, if the image bearing members are formed as flexible belt-type elements, a drum formed from a metal or other conductive material may be used as the intermediate transfer member.

In addition, the above description of the second embodiment describes transfer apparatus in which the full-color developed image formed on intermediate transfer belt 642 is transferred to the paper in the second-stage transfer by means of the pushing force of second-stage transfer roller 643 against intermediate transfer belt 642 and by the electromagnetic force generated by the second-stage transfer bias applied to second-stage transfer roller 643, but this invention is not restricted in this matter. Any transfer apparatus that can perform the second-stage transfer of the full-color developed image formed on intermediate transfer belt 642 to the paper may be used. For example, if a fusing heater is provided inside second-stage transfer roller 643 and/or drive roller 644*a* and heat is applied to the toner on intermediate transfer belt 642, the image can be fixed to the paper at the same time as the second-stage transfer step transfers the full-color developed image formed on intermediate transfer belt 642 to the paper.

For the first and second embodiments described above, developed image formation device 2*a* that forms yellow developed images, developed image formation device 2*b* that forms magenta developed images, developed image formation device 2*c* that forms cyan developed images, and developed image formation device 2*d* that forms black developed images have been described, but this invention is not restricted in this matter. The multi-color image formation apparatus of this invention may, depending on requirements, provide only two or three developed image formation devices that each form a developed image of a specified color on a photosensitive member 10.

For the pre-wet apparatus in the first and second embodiments described above, apparatus that uses pre-wet liquid supply element 202 to apply pre-wet liquid 220 to the surface of the photosensitive members 10 was described, but this invention is not restricted in this matter. Any pre-wet apparatus that can evenly apply a fixed quantity of pre-wet liquid to the surface of a photosensitive member may be used. For example, the pre-wet liquid may be discharged from multiple radial nozzles and applied, a roller may be used to apply the pre-wet liquid, or a sponge roller may be used to apply the pre-wet liquid.

Further, for the developing agent bearing members in the first and second embodiments described above, use of developing belt 510 formed from a flexible belt-type element was explained, but this invention is not restricted in this matter. Each of the developing agent bearing members may be a conductive developing roller formed from a metal or other rigid element or from an elastic element. However, if a developing roller formed from a rigid element is used, a member formed from a flexible belt-type element must be used as the image bearing member or the developing roller must be positioned such that minute gap d is formed between the developing roller and the photosensitive member such that the two-layer structure of the liquid developing agent layer formed on the developing roller and the pre-wet liquid layer formed on the photosensitive member is maintained when the layers touch.

The third embodiment of this invention is explained next with reference to FIGS. 16 and 17.

Figure 16:
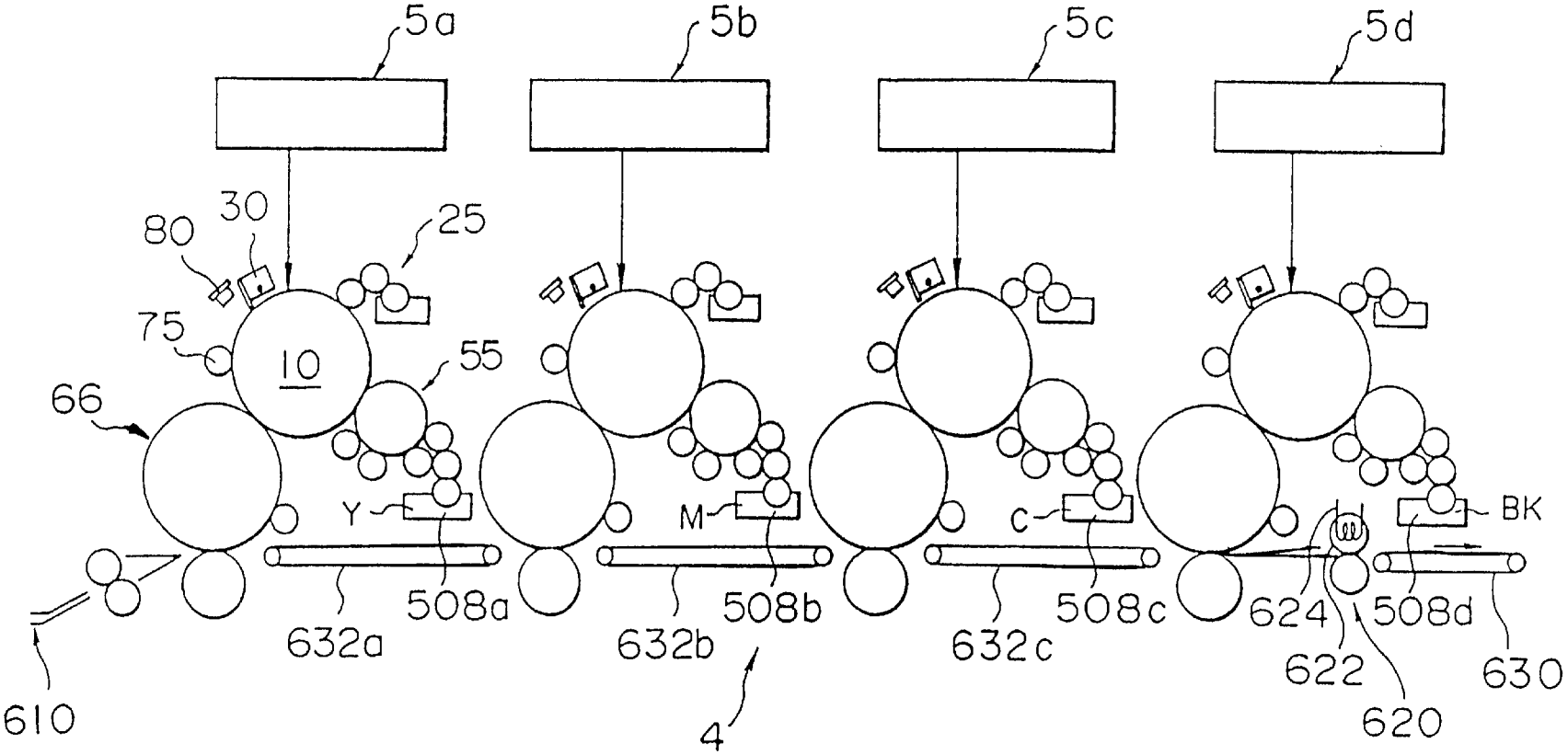
FIG. 16 is an overview of the structure of the multi-color image formation apparatus in the third embodiment of this invention.
Figure 17:
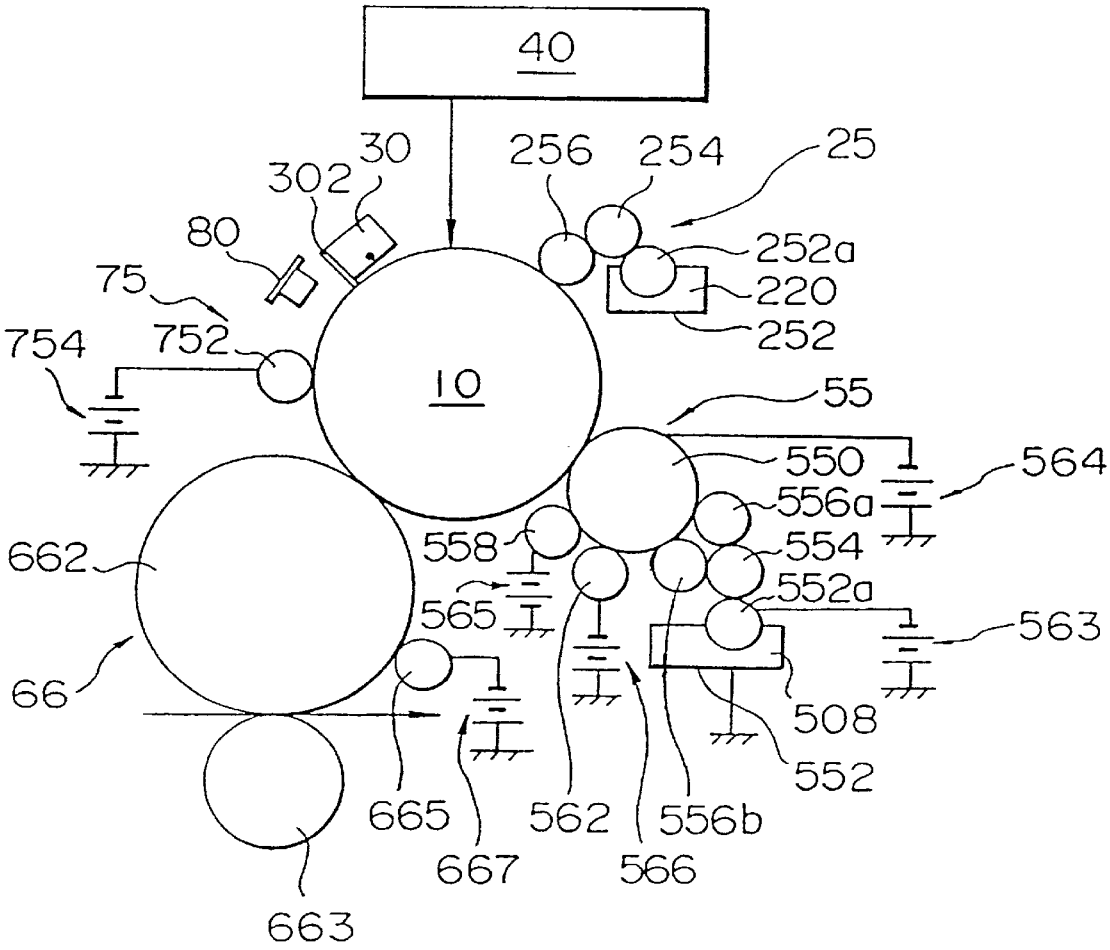
FIG. 17 is an overview of the structure of an image formation device that can be used by the multi-color image formation apparatus shown in FIG. 16.

FIG. 16 is an overview of the structure of the multi-color image formation apparatus that is the third embodiment of this invention, and FIG. 17 is an overview of the structure of an image formation device that can be used by the multi-color image formation apparatus shown in FIG. 16. Note that the components of the multi-color image formation apparatus of this embodiment that have the same function as components in the first embodiment are given the same or related reference numbers and detailed explanations for those functions are omitted.

Multi-color image formation apparatus 4, which is the third embodiment of this invention, is provided with image formation devices 5*a,* 5*b,* 5*c,* and 5*d* (hereafter referred to simply as image formation devices), each of which forms an image corresponding to yellow, magenta, cyan, or black developing agent on the substrate, paper supply apparatus 610, fusing apparatus 620, transport devices 632*a,* 632*b,* and 632*c,* and paper eject apparatus 630, as shown in FIG. 16.

Each image formation device, as shown in FIG. 17, is provided with photosensitive member 10 as the image bearing member, pre-wet apparatus 25 that applies pre-wet liquid to photosensitive member 10, charging apparatus 30 that charges photosensitive member 10, exposure apparatus 40 that exposes the image on photosensitive member 10, developing apparatus 55 that supplies toner to the parts of photosensitive member 10 where an electrostatic latent image is formed and thereby makes a visible image from the electrostatic latent image, transfer apparatus 66 that transfers the developed image formed on photosensitive member 10 to the specified paper, cleaning apparatus 75 that removes the toner remaining on photosensitive member 10, and charge removal apparatus 80 that neutralizes the charge on the charged photosensitive member 10. Paper supply apparatus 610 supplies the specified paper to image formation device 5*a*. Fusing apparatus 620 fixes the developed image that has been transferred to the paper. Transport apparatus 632*a* transports the paper from image formation device 5*a* to image formation device 5*b*. Transport apparatus 632*b* transports the paper from image formation device 5*b* to image formation device 5*c*. Transport apparatus 632*c* transports the paper from image formation device 5*c* to image formation device 5*d*. Paper eject apparatus 630 ejects externally the paper to which the toner has been fixed.

Photosensitive member 10, charging apparatus 30, exposure apparatus 40, charge removal apparatus 80, paper supply apparatus 610, fusing apparatus 620, and paper eject apparatus 630 are the same as components in the first embodiment. In addition, the technology used in paper supply apparatus 610 and paper eject apparatus 630 can be applied in transport apparatus 632*a* to 632*c*. Therefore, explanations of the above components are omitted and the main parts of this embodiment, pre-wet apparatus 25, developing apparatus 55, transfer apparatus 66, and cleaning apparatus 75, are explained below.

Pre-wet apparatus 25 of this embodiment is provided with tank 252 that stores the pre-wet liquid 220 described for the first embodiment, supply roller 252*a* disposed such that it is partly immersed in the pre-wet liquid 220 in tank 252, transport roller 254 disposed such that it contacts supply roller 252*a,* and application roller 256 disposed such that it contacts transport roller 254 and photosensitive member 10.

Supply roller 252*a* rotates in the opposite direction to the direction of rotation of transport roller 254 and thereby supplies the pre-wet liquid 220 stored in tank 252 to transport roller 254. Transport roller 254 rotates in the opposite direction to the direction of rotation of application roller 256 and thereby transports to application roller 256 the pre-wet liquid 220 that was supplied by supply roller 252*a*. Application roller 256 rotates in the opposite direction to the direction of rotation of photosensitive member 10 and thereby applies pre-wet liquid 220 to the surface of photosensitive member 10. In this way, a thin layer of pre-wet liquid is formed on photosensitive member 10. Rollers are used to supply pre-wet liquid 220 to photosensitive member 10 because, if photosensitive member 10 is rotated at higher speeds than in the related art, the rotation speed of the rollers can be increased in order to enable supply of the desired quantity of pre-wet liquid 220 to the surface of photosensitive member 10. Thus, high-speed image printing can be achieved. Note that the transport roller provided between supply roller 502*a* and application roller 506 need not be restricted to one roller. Multiple transport rollers may be provided. Alternatively, if a thin uniform layer of pre-wet liquid 220 can be applied to the surface of photosensitive member 10, a transport roller is not necessarily required.

Note that it is desirable to use rollers that have good lyophilic properties as supply roller 252*a,* transport roller 254, and application roller 256 in order to apply pre-wet liquid 220 to the surface of photosensitive member 10 as a thin uniform layer. Various rollers that have good lyophilic properties are available, such as ceramic rollers (manufactured by Nippon Steel Corporation) in which alumina and titania are the main components and for which a special surface process is performed, and BEET (manufactured by Miyagawa Roller Corporation) formed from a synthetic resin.

Developing apparatus 55 of this embodiment is provided with developing roller 550 as the developing agent bearing member, tank 552 that is formed from a metal or other conductive element and that stores the liquid developing agent 508 that is described in detail under the first embodiment, supply roller 552*a* disposed such that it is partly immersed in the liquid developing agent 220 in tank 552, transport roller 554 disposed such that it contacts supply roller 552*a,* application rollers 556*a* and 556*b* disposed such that they contact transport roller 554 and developing roller 550, first removal roller 558 that removes the pre-wet liquid adhering to developing roller 550, and second removal roller 562 that removes the liquid developing agent adhering to developing roller 550.

Tank 552 of image formation device 5*a* stores liquid developing agent 508*a* containing yellow toner, tank 552 of image formation device 5*b* stores liquid developing agent 508*b* containing magenta toner, tank 552 of image formation device 5*c* stores liquid developing agent 508*c* containing cyan toner, and tank 552 of image formation device 5*d* stores liquid developing agent 508*d* containing black toner.

Supply roller 552*a* rotates in the opposite direction to the direction of rotation of transport roller 554 and thereby draws up the liquid developing agent 508 stored in tank 552 and supplies it to transport roller 554. Power supply apparatus 563 is connected to supply roller 552*a* and tank 552 is earthed. Developing apparatus 563 applies a bias voltage to supply roller 552*a* and the electric field generated between the supply roller and tank 552 is used to regulate the quantity of liquid developing agent 508 that is drawn up.

Transport roller 554 rotates in the opposite direction to the direction of rotation of application rollers 556*a* and 556*b* and thereby transports to application rollers 556*a* and 556*b* the liquid developing agent 508 that was supplied by supply roller 552*a*. Note that a bias voltage may be applied to transport roller 554 and this bias may be used to regulate the quantity of liquid developing agent 508 transported to application rollers 556*a* and 556*b*.

Application rollers 556*a* and 556*b* rotate in the opposite direction to the direction of rotation of developing roller 550 and thereby apply to the surface of developing roller 550 the liquid developing agent 508 that has been transported by transport roller 554. The reason for using the two application rollers 556*a* and 556*b* is to make the thin layer of liquid developing agent 508 on the developing roller more uniform. Since application rollers 556*a* and 556*b* touch developing roller 550, it is desirable that the rollers themselves have a high resistance. Good results can be obtained if, for example, the electric resistance of the application rollers is about $10^{10}$ to cm $10^{13}\Omega$ cm when a developing roller with an electric resistance value of about $10^{3}\Omega$ cm is selected. Note that a bias voltage may be applied to application rollers 556*a* and 556*b* and this bias may be used to regulate the quantity of liquid developing agent 508 applied to developing roller 550. However, in order to facilitate the movement of liquid developing agent 508 from application rollers 556*a* and 556*b* to developing roller 550, the bias voltage applied to application rollers 556*a* and 556*b* should be smaller than the developing bias voltage applied to developing roller 550. The number of application rollers need not necessarily be two, but may be one or three or more. The number of application rollers should be determined on the basis of the required image quality.

Table 2 shows examples of the relationships between the bias voltages and the quantity of coating when the liquid developing agent is applied to the developing roller when the toner has a positive charge.

TABLE 2

| | |
|---|---|
| Developing roller | Developing bias example: −150 V |
| Application rollers | If higher than −150 V: Applied quantity increases<br>If lower than −150 V: Applied quantity decreases |

TABLE 2-continued

| | |
|---|---|
| Transport roller | If higher than the voltage applied to the application rollers: Transported quantity increases<br>If lower than the voltage applied to the application rollers: Transported quantity decreases<br>(If supplied from the supply roller: Transport roller voltage < Supply roller voltage) |
| Supply roller | Instantaneous supply: Bias is applied only at time of supply, and tank is always earthed |

Table 3 shows examples of the relationships between the bias voltages and the quantity of coating when the liquid developing agent is applied to a developing roller or developing belt in image formation apparatus that performs inverted developing.

TABLE 3

| | |
|---|---|
| Developing roller | Developing bias example: 500 V |
| Application rollers | If higher than 500 V: Applied quantity increases<br>If lower than 500 V: Applied quantity decreases |
| Transport roller | If higher than the voltage applied to the application rollers: Transported quantity increases<br>If lower than the voltage applied to the application rollers: Transported quantity decreases<br>(If supplied from the supply roller: Transport roller voltage < Supply roller voltage) |
| Supply roller | Instantaneous supply: Bias is applied only at time of supply, and tank is always earthed |

Developing roller 550 is positioned such that it contacts photosensitive member 10 and rotates in the opposite direction to the direction of rotation of photosensitive member 10 and thereby transports to the surface of the latent image on photosensitive member 10 the liquid developing agent 508 that has been applied by application rollers 556*a* and 556*b*. Developing roller 550 has a core formed as a rigid body of stainless steel or similar, an elastic layer formed around the periphery of the core, and a surface layer formed on the surface of the elastic layer. As a result, the pushing force of developing roller 550 against photosensitive member 10 is regulated, the contact pressure is distributed when the liquid developing agent layer formed on developing roller 550 touches the pre-wet liquid layer formed on photosensitive member 10, and a minute gap is formed between developing roller 550 and photosensitive member 10 through the medium of the liquid developing agent layer and the pre-wet liquid layer. Therefore, the liquid developing agent layer formed on developing roller 550 and the pre-wet liquid layer formed on photosensitive member 10 can be made to touch while maintaining a two-layer structure that allows the two layers to be distinguished from each other. Note that the preferred degree of hardness for developing roller 550 is from 5 to 60 degrees JIS-A. If the hardness is less than 5 degrees JIS-A, the roller is too soft and does not easily hold the required shape. If the hardness is greater than 60 degrees JIS-A, the roller is too hard and it becomes necessary to mount developing roller 550 in such a way that a minute gap is formed between developing roller 550 and photosensitive member 10. This is necessary in order to maintain the two-layer state of the liquid developing agent layer on developing roller 550 and the pre-wet liquid layer on photosensitive member 10 when the two layers touch, but complicates the mounting of developing roller 550.

The material used to form the elastic surface on developing roller 550 may be a foam-type material such as polystyrene, polyethylene, polyurethane, polyvinyl chloride, or nitrile butadiene rubber (NBR), or a rubber material with a low degree of hardness such as silicone rubber or urethane rubber. However, if rubber materials are usually used in their elastic deformed state over a period of years, the change in shape may become permanent such that the material does not return to the original shape of the roller. Therefore, if possible, use of a foam-type material is preferred as the material that forms the elastic surface. Note that a rubber element may be used to form the elastic layer around the core, and a further elastic layer may be formed from a foam-type material on the surface of that layer. The surface layer of developing roller 550 is formed from a conductive material that is not caused to swell by the silicone fluid that is the carrier liquid in liquid developing agent 508. An electric resistance value of about $10^3\Omega$ cm is desirable for the conductive material to allow an electrical developing bias to be applied to developing roller 550 by power supply apparatus 564, as shown in FIG. 17. Various methods can be used to form the surface layer. For example, a coating of a synthetic rubber compound in which conductive particles, such as carbon black, are dispersed can be formed on the surface of the flexible layer. Or, the flexible surface may be covered with a heat-shrink tube and heat may be applied to shrink the tube. Alternatively, an elastic material may be poured into a conductive tube and the foam formation process for the elastic material may take place inside the tube such that the elastic layer is formed inside the surface layer. A resin tube, such as a polyimide, polycarbonate, or nylon may be used as the conductive tube, or a nickel or other type of metal tube may be used. A resin tube, such as perfluoroalkoxy resin (PFA) or polytetrafluoroethylene (PTFE) may be used as a conductive heat-shrink tube. For the above tubes, endless tubes without joins are preferred. Note that a surface layer need not be formed on the surface of the elastic layer if the elastic layer is formed from an elastic material such as urethane rubber that is not made to swell by silicone fluid. However, it is necessary that developing roller 550 have the required electric resistance value, that is, about $10^3\Omega$ cm, such that an electrical developing bias can be applied by power supply apparatus 564, as shown in FIG. 17. This value can be obtained by performing a conductive process on the surface of the elastic layer or by adding minute conductive particles to the material from which the elastic layer is formed.

First removal roller 558 is positioned such that it contacts developing roller 550 and rotates in the opposite direction to the direction of rotation of developing roller 550. As shown in FIG. 17, power supply apparatus 565 charges first removal roller 558 with a charge of the same polarity as the toner. This enables the liquid developing agent remaining on developing roller 550 after the end of the developing process and the pre-wet liquid 220 that has moved from photosensitive member 10 to the developing roller to be separated from each other such that only the pre-wet liquid 220 adheres to first removal roller 558 and is removed from developing roller 550.

Second removal roller 562 is positioned such that it contacts developing roller 550 and rotates in the opposite direction to the direction of rotation of developing roller 550. As shown in FIG. 17, power supply apparatus 566 charges second removal roller 562 with a charge of the opposite polarity to the toner. This causes the liquid developing agent remaining on developing roller 550 after the end of the developing process to adhere to the surface of second removal roller 562 and removes the liquid developing agent from developing roller 550.

Transfer apparatus 66 of this embodiment is provided with intermediate transfer drum 662 as the intermediate transfer member, second-stage transfer roller 663, which is the second-stage transfer medium, positioned such that it can be separated from intermediate transfer drum 662, and removal roller 665 that removes the toner remaining on intermediate transfer drum 662.

Intermediate transfer drum 662 rotates in the opposite direction to the direction of rotation of photosensitive member 10. At the point of transfer from photosensitive member 10 to intermediate transfer drum 662, power supply apparatus or a corona discharge device (not illustrated) charges intermediate transfer drum 662 with a charge of opposite polarity to the toner. In this way, electrostatic force is used to achieve the first-stage transfer which transfers the developed image from photosensitive member 10 to intermediate transfer drum 662. Intermediate transfer drum 662 has a core formed from a rigid body such as stainless steel, an elastic layer formed around the periphery of the core, and a surface layer formed on the surface of the elastic layer. Therefore, the contact pressure can be distributed when intermediate transfer drum 662 touches the developed image formed on photosensitive member 10 and disturbance of the developed image on photosensitive member 10 can be prevented. Note that the preferred degree of hardness of intermediate transfer drum 662 is from 5 to 50 degrees JIS A and, if possible, from 15 to 40 degrees JIS-A. If the hardness is less than 5 degrees JIS-A, the roller is too soft and does not easily hold the required shape. If the hardness is greater than 50 degrees JIS-A, the roller is too hard and the developed image may be squashed when intermediate transfer drum 662 touches the developed image formed on photosensitive member 10.

The material used to form the elastic surface on intermediate transfer drum 662 may be a foam-type material such as polystyrene, polyethylene, polyurethane, polyvinyl chloride, or nitrile butadiene rubber (NBR), or a rubber material with a low degree of hardness such as silicone rubber or urethane rubber. However, if rubber materials are usually used in their elastic deformed state over a period of years, the change in shape may become permanent such that the material does not return to the original shape of the roller. Therefore, if possible, use of a foam-type material is preferred as the material that forms the elastic surface. Note that a rubber element may be used to form the elastic layer around the core, and a further elastic layer may be formed from a foam-type material on the surface of that layer.

The surface layer of intermediate transfer drum 662 is formed from a conductive material that is not caused to swell by the silicone fluid that is the carrier liquid in liquid developing agent 508. Various methods can be used to form the surface layer. For example, the surface of the elastic layer may be coated with a synthetic rubber compound or covered by a tube. An endless resin tube, such as a polyimide or polyethylene terephthalate (PET) tube, without any joins is preferred. Note that, if the elastic layer is formed from a rubber material that is not caused to swell by silicone fluid, such as urethane rubber or fluorosilicone rubber, the end surfaces of intermediate transfer drum 662 need not be covered with the same material as the surface layer but, if the elastic layer is formed from a foam-type material or other material that is caused to swell by silicone fluid, the end surfaces of intermediate transfer drum 662 must be covered by the same material as the surface layer.

The preferred value for the electric resistance of intermediate transfer drum 662 is from $10^4$ to $10^{11}\Omega$ cm and, if possible, $10^6$ to $10^9\Omega$ cm. If the electric resistance value is less than $10^4\Omega$ cm, sudden electric discharges from intermediate transfer drum 662 to photosensitive member 10 will occur when intermediate transfer drum 662 is charged, photosensitive member 10 will be damaged, and transfer will be poor. If the electric resistance value is higher than $10^{11}\Omega$ cm, intermediate transfer drum 662 will have insufficient charge, the electrostatic force between intermediate transfer drum 662 and the developed image formed on photosensitive member 10 will be too weak, and insufficient toner will be transferred. To achieve the above electric resistance values for intermediate transfer drum 662, the electric resistance value must be lowered by, for example, a conductive process being applied to the surface of intermediate transfer drum 662 or by addition of minute conductive particles to the material that forms the surface layer.

A glossy surface that has good release properties is preferred for intermediate transfer drum 662. This allows the intermediate transfer drum to release the toner well and therefore facilitates the movement of the developed image from intermediate transfer drum 662 to the paper. Therefore, it is desirable that the material used to form the surface layer of intermediate transfer drum 662 be latex or a resin tube that gives the surface good release properties, such as perfluoroalkoxy resin (PFA), polytetrafluoroethylene (PTFE), ethyl-tetrafluoroethylene (ETFE), or fluorinated ethylene propylene resin (FEP).

Second-stage transfer roller 663 rotates in the opposite direction to the direction of rotation of intermediate transfer drum 662 such that the paper transported by paper supply apparatus 610 and by transport apparatus 632*a* to 632*c* is fed between the intermediate transfer drums 662 and second-stage transfer rollers 663. At this time, second-stage transfer roller 663 is pressed against intermediate transfer drum 662 through the medium of the paper. The elastic layer formed on the surface of intermediate transfer drum 662 improves the intimacy of the contact between the intermediate transfer member and the substrate such that good transfer is achieved regardless of depressions and protrusions in the substrate. Second-stage transfer roller 663 is connected to power supply apparatus (not illustrated), which applies a second-stage transfer bias voltage to second-stage transfer roller 663.

A fluorocarbon resin coating is given to the surface of second-stage transfer roller 663. This provides good release properties in relation to the toner, facilitates removal of toner that has adhered to second-stage transfer roller 663, and can prevent second-stage transfer roller 643 from becoming dirty.

Removal roller 665 is positioned such that it contacts intermediate transfer drum 662 and rotates in the opposite direction to the direction of rotation of intermediate transfer drum 662. As shown in FIG. 17, power supply apparatus 667 charges removal roller 665 with a charge of the opposite polarity to the toner. Thus the liquid developing agent remaining on intermediate transfer drum 662 after the end of the second-stage transfer process is caused to adhere to the surface of removal roller 665 and is removed from intermediate transfer drum 662.

Cleaning apparatus 75 of this embodiment is provided with removal roller 752 and power supply apparatus 754 that is connected to removal roller 752. Removal roller 752 is disposed such that it contacts photosensitive member 10 and rotates in the opposite direction to the direction of rotation of photosensitive member 10. Power supply apparatus 754 applies a voltage to removal roller 752 to give removal roller 752 a charge of opposite polarity to the toner and thereby remove the remaining toner from photosensitive member 10.

The operation of multi-color image formation apparatus 4 of this embodiment is explained next.

Note that the timing for the operations from charging to charge neutralization, described later, takes into account the speed of movement of the paper such that the developed images, each formed on the intermediate transfer drum 662 provided by one of the image formation devices, are transferred to the paper sequentially at the positions that will provide proper registration. The transfer sequence is image formation device 4*a,* image formation device 4*b,* image formation device 4*c,* then image formation device 4*d.* The timing for the operation of the image formation devices may also be determined by use of a sensor that detects the movement of the paper.

First, charging apparatus 30 charges the surface of photosensitive member 10, then exposure apparatus 40 exposes the image on the charged photosensitive member 10. Next, pre-wet apparatus 25 applies pre-wet liquid 220 to photosensitive member 10. The pre-wet liquid 220 that is stored in tank 252 is drawn up by supply roller 252*a* and supplied to transport roller 254. The pre-wet liquid 220 that has been supplied to transport roller 254 is transported to application roller 256 then applied to photosensitive member 10. The application of pre-wet liquid 220 by means of rollers in this way forms a thin film of pre-wet liquid on photosensitive member 10.

Next, developing apparatus 55 makes a visible image from the electrostatic latent image. The liquid developing agent 508 that is stored in tank 552 is drawn up by supply roller 552*a* and supplied to transport roller 554. The liquid developing agent 508 that has been supplied to transport roller 554 is transported to application rollers 556*a* and 556*b* then applied to developing roller 550. The application of liquid developing agent 508 by means of rollers in this way forms a thin film of liquid developing agent on developing roller 550. Next, a soft contact is achieved between the liquid developing agent layer on developing roller 550 and the pre-wet liquid layer on photosensitive member 10. This brings the liquid developing agent close to the electrostatic latent image that has been formed on the surface of photosensitive member 10 and the electrostatic force migrates the charged toner to photosensitive member 10 to form a developed image on photosensitive member 10.

Transfer apparatus 66 then transfers to the paper the developed image that has been formed on photosensitive member 10. First, in the first-stage transfer, the electrostatic force generated between the toner and intermediate transfer drum 662, which has been given an electric charge of opposite polarity to the toner by corona discharge or by application of a bias voltage, transfers the developed image formed on photosensitive member 10 to intermediate transfer drum 662. Next, in the second-stage transfer, the developed image transferred to intermediate transfer drum 662 in the first-stage transfer is transferred to the paper that is fed between intermediate transfer drum 662 and second-stage transfer roller 663. This transfer is achieved by means of the pushing force of second-stage transfer roller 663 against intermediate transfer drum 662 and by the electrostatic force generated by the second-stage transfer bias applied to second-stage transfer roller 663. Cleaning apparatus 70 removes the liquid developing agent 508 remaining on photosensitive member 10, then charge removal apparatus 80 neutralizes the charge on photosensitive member 10.

Multi-color image formation apparatus 4 of the third embodiment performs the above operations, from charging to charge neutralization, sequentially for image formation device 4*a,* image formation device 4*b,* image formation device 4*c,* then image formation device 4*d.* The timing of these operations is such that the developed images that have been transferred to each of the intermediate transfer drums 662 in the first-stage transfer are transferred to the paper sequentially in the second-stage transfer at the positions that will provide proper registration. Thus, yellow, magenta, cyan, and black developed images are sequentially transferred to the paper to form a color image on the paper. Fusing heater 624 that is provided within fuser roller 622 of fusing apparatus 620 thermally fuses the color image that has been formed on the paper and fixes it to the paper, as shown in FIG. 16. Then, the paper to which the color image is fixed is ejected externally by paper eject apparatus 630.

Use of the elastic intermediate transfer drum 662 as the intermediate transfer member in the third embodiment of this invention allows the contact force to be distributed when intermediate transfer drum 662 touches the developed image formed on the surface of the latent image on photosensitive member 10. Thus, disturbance of the developed image can be prevented such that the first-stage transfer can be achieved without the developed image spreading on intermediate transfer drum 662.

In addition, in the third embodiment of this invention, the pre-wet liquid 220 that is stored in tank 252 is applied to photosensitive member 10 by means of supply roller 252*a,* transport roller 254, and application roller 256. As a result, if photosensitive member 10 is rotated at higher speeds than in the related art, the rotation speed of the rollers can be increased in order to enable an even application of the desired quantity of pre-wet liquid 220 to the surface of photosensitive member 10. Thus, high-speed image printing can be achieved. In addition, use of rollers that have good lyophilic properties as supply roller 252*a,* transport roller 254, and application roller 256 enables pre-wet liquid 220 to be applied to photosensitive member 10 as an even thinner uniform layer.

Furthermore, in the third embodiment of this invention, use of the elastic developing roller 550 as the developing agent bearing member allows the pushing force of developing roller 550 against photosensitive member 10 to be regulated and allows the contact force to be distributed when the liquid developing agent layer formed on developing roller 550 touches the pre-wet liquid layer formed on photosensitive member 10. As a result, the liquid developing agent layer and pre-wet liquid layer can maintain a two-layer structure when they are brought into contact during the developing process. This can prevent the occurrence of inaccuracies in the pre-wet liquid layer and, consequently, prevent adhesion of toner to the non-image parts on the photosensitive member and prevent the occurrence of image inaccuracies. Other benefits are the same as for the first embodiment.

Note that the above description of the third embodiment describes provision of image formation device 4*a* that forms a yellow developed image on the substrate, image formation device 4*b* that forms a magenta developed image on the substrate, image formation device 4*c* that forms a cyan developed image on the substrate, and image formation device 4*d* that forms a black developed image on the substrate, but this invention is not restricted in this matter. Only two or three image formation devices may be provided, as required, to form images of the desired color on the substrate.

For the pre-wet apparatus in the third embodiment described above, apparatus that applies pre-wet liquid 220 to photosensitive member 10 by means of supply roller 252*a,* transport roller 254, and application roller 256 is described, but this invention is not restricted in this matter. Any pre-wet apparatus that can apply a fixed quantity of pre-wet liquid evenly to the surface of photosensitive member 10 may be used. For example, a pre-wet liquid supply element formed from a continuously porous element, as described for the first and second embodiments, may be used to apply the pre-wet liquid. Alternatively, the pre-wet liquid may be discharged from multiple radial nozzles and applied, or a sponge roller may be used to apply the pre-wet liquid.

Further, for the developing agent bearing member in the third embodiment described above, use of elastic developing roller 550 was explained, but this invention is not restricted in this matter. The developing agent bearing member may be a developing belt formed from a flexible belt-type element, as described for the first and second embodiments, or a developing roller formed from a metal or other rigid element. However, if a developing roller formed from a rigid element is used, a member formed from a flexible belt-type element must be used as the image bearing member or the developing roller must be positioned such that minute gap d is formed between the developing roller and the photosensitive member such that the two-layer structure of the liquid developing agent layer formed on the developing roller and the pre-wet liquid layer formed on the photosensitive member is maintained when the layers touch.

The intermediate transfer member used in the third embodiment described above is the elastic cylindrical intermediate transfer drum 662, but this invention is not restricted in this matter. The intermediate transfer member may be formed from a flexible belt-type element or, if the image bearing member is formed from a flexible belt-type element, a drum formed from metal or other conductive material may be used as the intermediate transfer member.

This invention is not restricted to the embodiments described above. Many modifications are possible within the scope of the main elements. For example, for the above embodiments, apparatus that uses an organic photosensitive member as the image bearing member has been explained, but this invention is not restricted in this matter. The image bearing member may be any of the photosensitive members used with the Carlson method, may be the type of member used with ionographic or similar methods in which an insulating layer is formed on a conductive body that forms the electrostatic latent image directly, or may be the type of electrostatic recording paper used with electrostatic plotters.

In the embodiments described above, the exposure apparatus exposes the image on the image bearing member, and then the pre-wet apparatus applies pre-wet liquid to the image bearing member, but this invention is not restricted in this matter. The pre-wet liquid may be applied any time before the developing process starts. For example, the pre-wet apparatus may apply the pre-wet liquid to the image bearing member, and then the exposure apparatus may expose the image on the image bearing member. In addition, provided that the viscosity of the pre-wet liquid is from 0.5 to 5 mPa•s, the electric resistance is $10^{12}\Omega$ cm or more, the boiling point is from 100 to 250° C., and the surface tension is 21 dyne/cm or less, silicone need not be the main component. Furthermore, if the surface of the image bearing member is coated with a material that has good release properties, pre-wet apparatus is not particularly necessary.

The description of the supply of liquid developing agent to the developing agent bearing member by the developing apparatus in the above embodiments explains the use of rollers as the means of applying liquid developing agent to the developing agent bearing member, but this invention is not restricted in this matter. Any means that can form a thin layer of liquid developing agent on the developing agent bearing member can be used to supply the liquid developing agent to the developing agent bearing member. For example, a bellows pump may be used to apply the liquid developing agent directly to the developing agent bearing member, then a regulatory blade or regulatory roller may be used to regulate the thickness of the layer and form the layer of liquid developing agent on the developing agent bearing member.

In addition, this invention is not restricted to the embodiments described above. If the thickness of the layer of liquid developing agent is from 5 to 40 $\mu$m, the viscosity of the highly viscous developing agent may be 10,000 mPa•s. Currently, if a highly viscous developing agent has a viscosity of 6,000 mPa•s or more, the carrier liquid and toner are difficult to stir. Therefore, such viscosities are considered unsuitable for cost reasons. However, developing agents with viscosities over 6,000 mPa•s may be used if they can be obtained cheaply. Use of viscosities in excess of 10,000 mPa•s is not realistic. The carrier liquid in the liquid developing agent is not restricted to silicone fluid.

Figure 18:
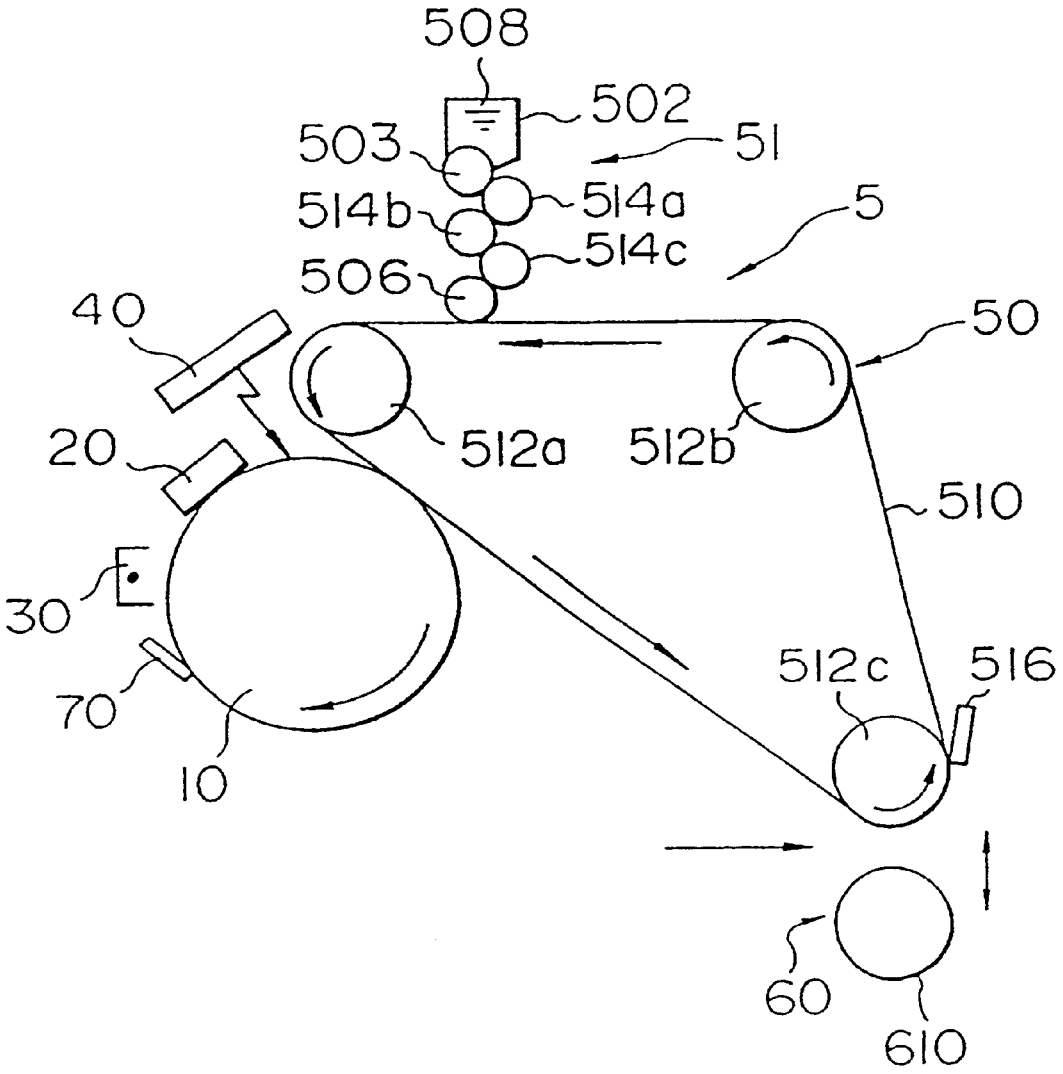
FIG. 18 is an overview of the structure of the image formation device in the fourth embodiment of this invention.

The fourth embodiment of this invention is explained below with reference to FIGS. 18, 2 to 5, and 19. FIG. 18 is an overview of the structure of the image formation device that is the fourth embodiment of this invention and FIG. 19 shows the operation of the image formation device shown in FIG. 18.

Image formation device 5 that is the fourth embodiment of this invention, as shown in FIG. 18, is provided with photosensitive member 10 that is the electrostatic latent image bearing member, pre-wet apparatus 20 that applies pre-wet liquid to photosensitive member 10, charging apparatus 30 that charges photosensitive member 10, exposure apparatus 40 that exposes the inverted electrostatic latent image on photosensitive member 10, developing apparatus 50 that supplies to the parts of photosensitive member 10 where an inverted electrostatic latent image is formed the liquid developing agent that has been applied to the developing belt 510 that is the developing agent bearing member, transfer apparatus 60 that transfers the normal developed image from developing belt 510 to the specified paper and that, at the same time, fixes the image to the paper, cleaning apparatus 70 that removes the toner remaining on photosensitive member 10, and charge removal apparatus 80 that neutralizes the charge on the charged photosensitive member 10.

Pre-wet apparatus 20, charging apparatus 30, exposure apparatus 40, cleaning apparatus 70, and charge removal apparatus 80 are the same as components in the first embodiment. Therefore, explanations of the above components are omitted and the main parts of this embodiment, developing apparatus 50 and transfer apparatus 60 are explained.

Developing apparatus 50 is provided with developing belt 510, which is the developing agent bearing member, drive rollers 512*a,* 512*b,* and 512*c* that provide the rotational drive for developing belt 510 and that also support developing belt 510 such that part of the belt contacts photosensitive member 10, developing cartridge 51 that supplies liquid developing agent 508 to developing belt 510, and scraper blade 516 that scrapes off the liquid developing agent 508 adhering to developing belt 510.

Developing cartridge 51 is provided with tank 502 that stores liquid developing agent 508, application roller 506 that applies liquid developing agent 508 to developing belt 510, release roller 503 that is disposed at the release aperture of tank 502, and transport rollers 514*a,* 514*b,* and 514*c*.

Release roller 503 is disposed such that it contacts transport roller 514*a* and rotates in the opposite direction to the direction of rotation of transport roller 514*a,* thereby transporting to transport roller 514*a* the liquid developing agent 508 that is stored in tank 502. Transport roller 514*a* is disposed such that it contacts transport roller 514*b* and rotates in the opposite direction to the direction of rotation of transport roller 514*b,* thereby transporting to transport roller 514*b* the liquid developing agent 508 that has been supplied by release roller 504. Transport roller 514*b* is disposed such that it contacts transport roller 514*c* and rotates in the opposite direction to the direction of rotation of transport roller 514*c,* thereby transporting to transport roller 514*c* the liquid developing agent 508 that has been supplied by transport roller 514*a*. Transport roller 514*c* is disposed such that it contacts application roller 506 and rotates in the opposite direction to the direction of rotation of application roller 506, thereby transporting to application roller 506 the liquid developing agent 508 that has been supplied by transport roller 514*b*. Application roller 506 is disposed such that it contacts developing belt 510 and rotates in the opposite direction to the direction of rotation of developing belt 510, thereby applying to the surface of developing belt 510 the liquid developing agent 508 that has been supplied by transport roller 514*c*.

The reason that release roller 503, transport rollers 514*a,* 514*b,* and 514*c,* and application roller 506 are used to supply liquid developing agent to developing belt 510 is that, since the liquid developing agent 508 used in the fourth embodiment contains toner dispersed at a high concentration, as described later, this is an advantageous means of applying a small quantity of developing agent thinly and evenly to the surface of developing belt 510.

Developing belt 510 is rotated in the opposite direction to the direction of rotation of photosensitive member 10 by drive rollers 512*a,* 512*b,* and 512*c* and thereby supplies to the surface of the latent image on photosensitive member 10 the liquid developing agent 508 that has been applied by application roller 506. A flexible belt material, such as a seamless nickel belt or a polyimide or other resin belt, is used as developing belt 510. Use of this type of flexible belt material enables distribution of the contact force when the liquid developing agent layer formed on developing belt 510 and the pre-wet liquid layer formed on photosensitive member 10 touch. As a result, the two-layer structure of the liquid developing agent layer formed on developing belt 510 and the pre-wet liquid layer formed on photosensitive member 10 can the maintained when the two layers touch and the two layers can be separated at a point within the pre-wet liquid layer. Note that developing belt 510 must be formed such that a developing bias can be applied. Accordingly, if a resin belt is used, minute conductive particles must be added to lower the electric resistance value or a conductive process must be applied to the surface of the belt. If the belt itself is conductive, rubber rollers that have low electric resistance values and to which minute conductive particles have been added may be used for drive rollers 512*a,* 512*b,* and 512*c* such that a developing bias can be applied. If a conductive process is applied to the surface of the belt, a conductor is disposed such that it touches the surface of the belt and the developing bias is applied through the medium of the conductor.

The image formation devices 5, described above, may be arranged in parallel in the multi-color image formation apparatus and the number of image formation devices 5 may be reduced if less colors are required.

Transfer apparatus 60 is provided with transfer roller 610, which is the transfer member. Transfer roller 610 is rotated in the opposite direction to the direction of rotation of developing belt 510. As a result, the specified paper is fed between transfer roller 610 and developing belt 510 and transfer roller 610 is pushed against developing belt 510 through the medium of the paper. The developed image transferred to the paper is fixed to the paper by heating. Note that a fusing heater can be disposed inside drive roller 512*c* to provide a structure that allows the image to be fixed during the transfer process. In addition, a fusing heater may be disposed inside transfer roller 610 to provide a heightened thermal effect during fusing.

Figure 19A:
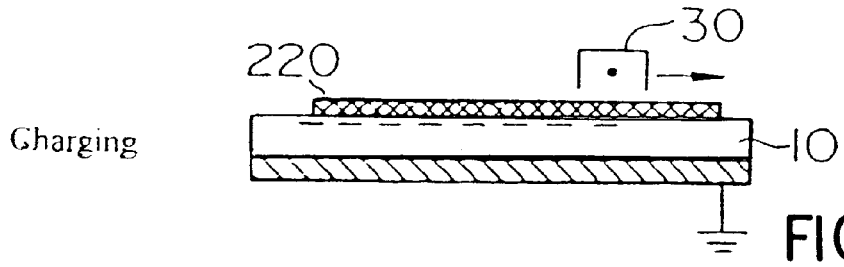
FIGS. 19(A)–19(E) show the operation of the image formation device in the fourth embodiment of this invention.

The operation of the image formation device that is the fourth embodiment of this invention is explained next. Firstly, as shown in FIG. 19(A), the surface of photosensitive member 10 is charged by charging apparatus 30. Generally, a corona discharge device is used as charging apparatus 30.

Figure 19B:
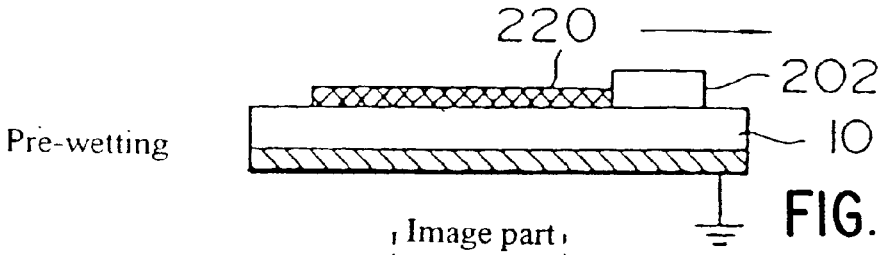

Then, pre-wet apparatus 20 applies the pre-wet liquid 220 described above to photosensitive member 10, as shown in FIG. 19(B). When an external signal is input, pre-wet apparatus 20 moves pre-wet liquid supply element 202 into contact with photosensitive member 10. Pre-wet liquid 220 is circulated continuously inside pre-wet liquid supply element 202 by means of pump 208. The pre-wet liquid 220 that exceeds the capacity of the pores in the Bell-eta used as pre-wet liquid supply element 202 is released from release side 202*b* of pre-wet liquid supply element 202, as shown in FIG. 5, and also from the lower surface of pre-wet liquid supply element 202. This provides a uniform application of the pre-wet liquid to photosensitive member 10 without causing damage to photosensitive member 10.

Figure 19C:
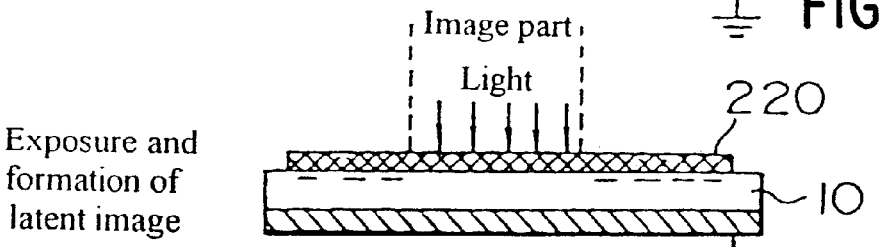

Then, the inverted image on charged photosensitive member 10 is exposed. Contrary to the situation shown in FIG. 3(B), a laser scanner or similar is used to expose an inverted image, that is, the image parts, to form an inverted electrostatic latent image on the surface of photosensitive member 10, as shown in FIG. 19(C). The parts hit by the light from the laser scanner are made conductive and lose their charge. The parts not hit by the light remain as the charged image, that is, the electrostatic latent image.

Figure 19D:
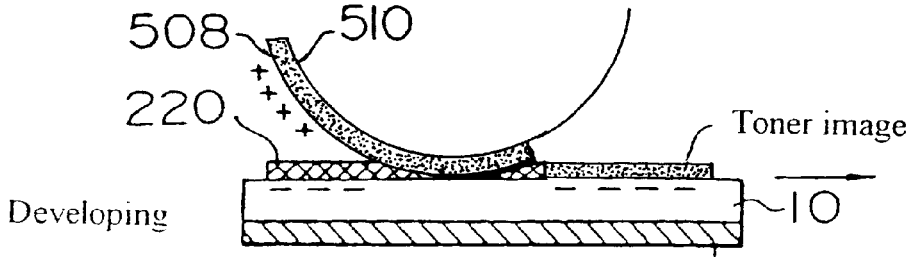
Figure 19E:
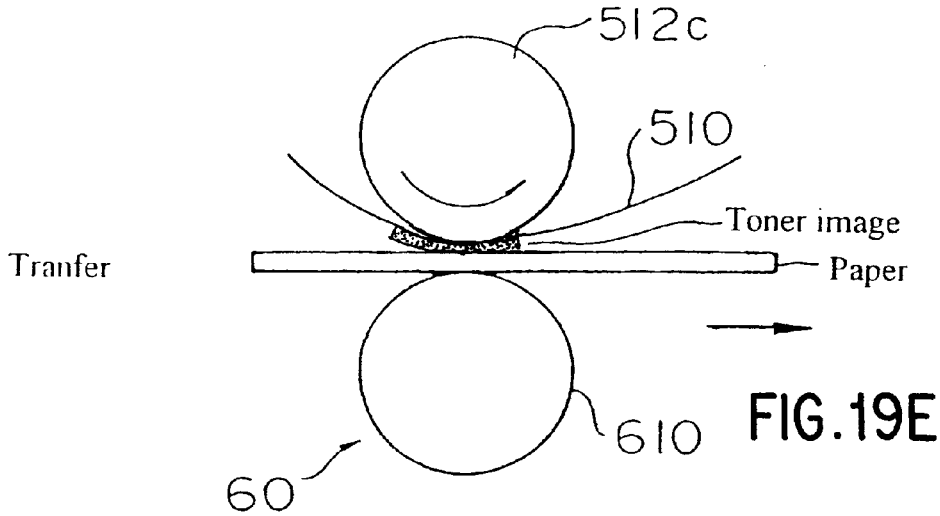

Next, a normal developed image is formed on developing belt 510. The liquid developing agent 508 that is stored in tank 502 is released by release roller 503 and transported to application roller 506 by means of transport rollers 514*a*, 514*b*, and 514*c*. The liquid developing agent 508 that is transported to application roller 506 by means of multiple rollers is applied thinly and evenly to developing belt 510 and forms a thin layer on developing belt 510. The thin layer of liquid developing agent formed on developing belt 510 in this way is brought close to the inverted electrostatic latent image formed on the surface of photosensitive member 10, as shown in FIG. 19(D), such that electrostatic force migrates the charged toner to photosensitive member 10 and forms an inverted developed image on photosensitive member 10. The remaining toner forms a normal developed image on developing belt 510.

Next, transfer apparatus 60 transfers the normal developed image formed on developing belt 510 to the paper that is the substrate. The normal developed image formed on developing belt 510 is separated from developing belt 510 by means of the pushing force of transfer roller 610 against developing belt 50 [Trans note: should be 510] and is moved to the paper that is fed between transfer roller 610 and developing belt 510. The toner on the paper is thermally fused during the fusing process (not illustrated) and fixed to the paper. In this way, the image is formed on the paper. Cleaning apparatus 70 removes the liquid developing agent 508 from photosensitive member 10, then charge removal apparatus 80 neutralises the charge on photosensitive member 10. The above cycle from charging to charge neutralization can then be used again repeatedly. Note that, if the liquid developing agent is not transferred properly and remains on developing belt 510, the remaining liquid developing agent 508 is removed by scraper blade 516.

Figure 20:
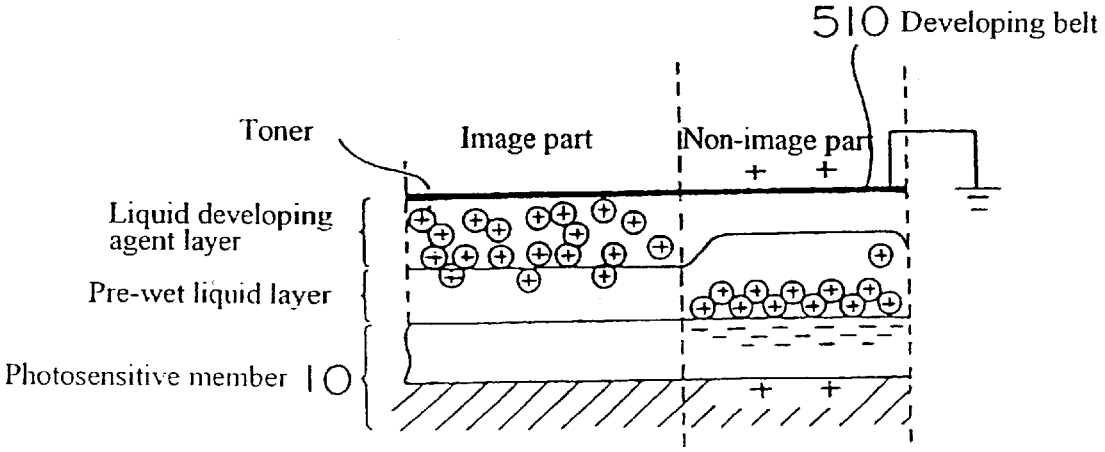
FIG. 20 shows the details of the toner migration process in the image formation device in the fourth embodiment of this invention.

Since, in this embodiment, an inverted image is exposed on the photosensitive member, the toner on developing belt 510 at the non-image parts is moved through the pre-wet liquid layer to the surface of the latent image by means of the Coulomb force of the electric field formed between the charge on photosensitive member 10 and developing belt 510 during the toner migration process part of the developing process, as shown in FIG. 20. At the image parts, the surface of photosensitive member 10 and the liquid developing agent layer are separated by the pre-wet liquid layer and, therefore, the toner on developing belt 510 does not migrate to the surface of photosensitive member 10.

Accordingly, during the separation process, the liquid developing agent remaining on the developing belt forms the image parts, and the liquid developing agent that migrates to the surface of the photosensitive member forms the non-image parts. In this way, a normal developed image is formed on the developing belt.

In addition, since the developed image formed on developing belt 510 is transferred to the substrate in the fourth embodiment, the transfer is easier than when a developed image formed on photosensitive member 10 that is the electrostatic latent image bearing member is transferred to the substrate. Since the photosensitive member does not withstand pressure or heat well, transfer methods that use pushing force from the transfer member against the photosensitive member, and also transfer methods that use pushing force from the transfer member against the photosensitive member and that also use a fusing heater to add heat to the transfer member to simultaneously fix the image, cannot be used. A developing agent bearing member withstands pressure and heat better than a photosensitive member. Therefore, transfer methods that use pushing force from the transfer member against the developing agent bearing member, and also transfer methods that use pushing force from the transfer member against the developing agent bearing member and that also use a fusing heater to add heat to the transfer member to simultaneously fix the image, can be used.

Furthermore, developing belt 510 that is formed from a flexible belt-type element is used in the fourth embodiment. Therefore, the contact force can be distributed when the liquid developing agent layer that has been applied to developing belt 510 touches the pre-wet liquid layer formed on photosensitive member 10 and, as a result, disturbance of the normal developed image formed on developing belt 510 can be prevented. In addition, since a rigid body such as a drum can be used for the photosensitive member and the transfer member, belt tracking control need only be provided for developing belt 510. Therefore, operations are easier to control than when a drum or other rigid body is used as the developing agent bearing member and a flexible belt-type material is used for the photosensitive member and transfer member, and the size of the apparatus can be smaller.

For example, apparatus in which the transfer roller is charged with a charge of opposite polarity to the toner and the resulting electrostatic force is used to transfer to the paper the normal developed image that has been formed on developing belt 510 and that then fixes the image may be used. Alternatively, apparatus in which a bias voltage is applied to the transfer roller and the resulting electrostatic force is used to transfer to the paper the normal developed image that has been formed on developing belt 510 and that then fixes the image may be used. Note that the pushing force of transfer roller 610 against photosensitive member 10 and heating from a fusing heater disposed separately inside drive roller 512*c* can be used to transfer to the paper the normal developed image that has been formed on developing belt 510 and to fix the image at the same time. Alternatively, a fusing heater may be disposed inside transfer roller 610. Note that the electrostatic force acting between developing belt 510 and the toner on developing belt 510 is weaker than the electrostatic force acting between photosensitive member 10 and the toner on photosensitive member 10. Therefore, when electrostatic force is used to transfer a developed image formed on developing belt 510 to the substrate, the transfer voltage can be lower than when electrostatic force is used to transfer a developed image formed on a photosensitive member 10 to the substrate.

Figure 21:
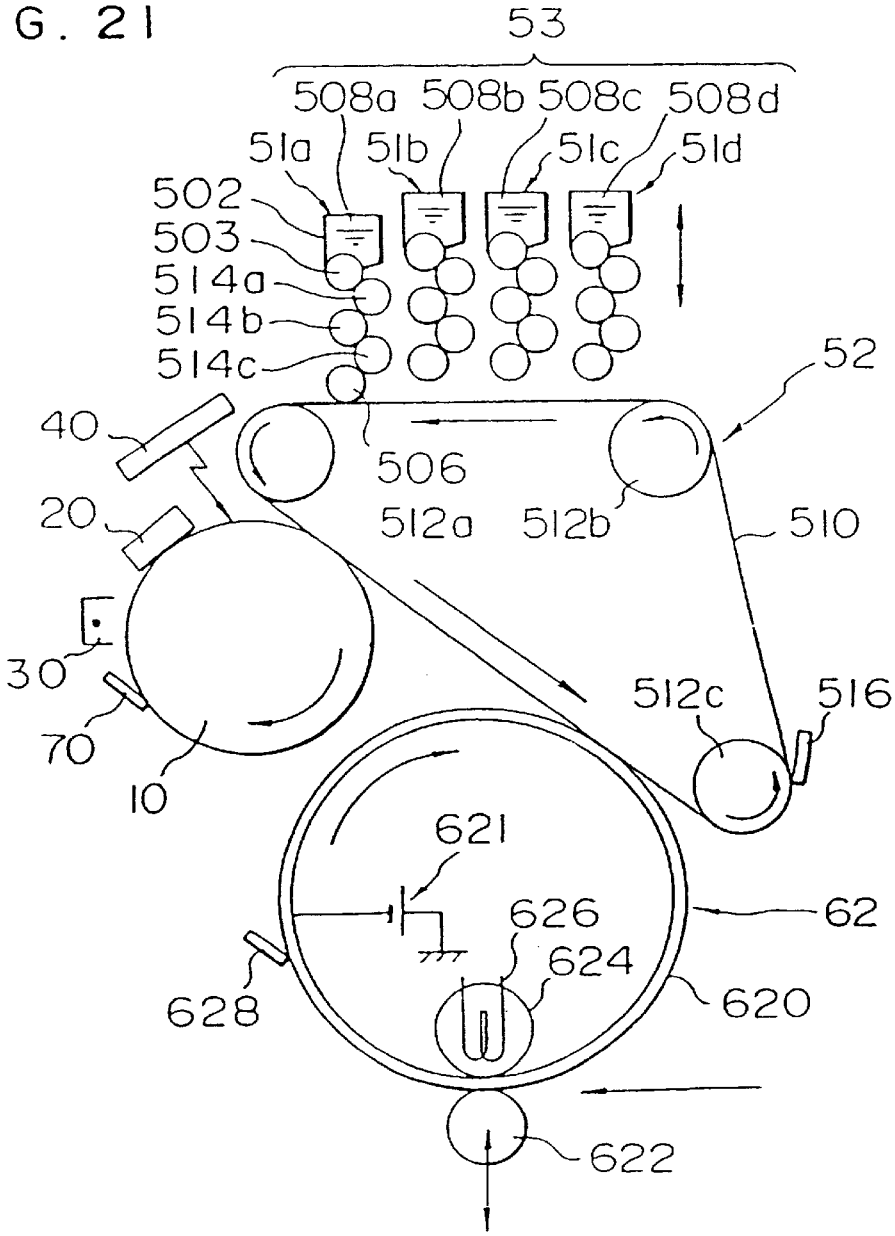
FIG. 21 is an overview of the structure of a multi-color image formation apparatus that uses the fourth embodiment of this invention.
Figure 22:
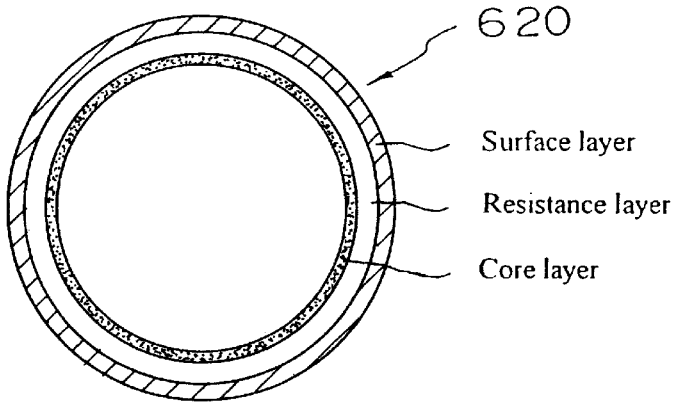
FIG. 22 is a cross-section outlining an intermediate transfer drum that can be used by the image formation apparatus shown in FIG. 21.

Next, multi-color image formation apparatus based on the fourth embodiment of this invention is explained with reference to FIGS. 21 to 23. FIG. 21 is an overview of the structure of the multi-color image formation apparatus of this invention, FIG. 22 is a cross-section outlining an intermediate transfer drum that can be used by the image formation apparatus shown in FIG. 21, and FIG. 23 shows the operation of the image formation apparatus shown in FIG. 21. Note that the components in the image formation apparatus shown in FIG. 21 that have the same function as components in the fourth embodiment are given the same or related reference numbers and detailed explanations for those functions are omitted.

Multi-color image formation apparatus 2 based on the fourth embodiment of this invention, as shown in FIG. 21, is provided with photosensitive member 10 that is the electrostatic latent image bearing member, pre-wet apparatus 20 that applies pre-wet liquid to photosensitive member 10, charging apparatus 30 that charges photosensitive member 10, exposure apparatus 40 that exposes the inverted image on photosensitive member 10, developing apparatus 52 that supplies to the parts of photosensitive member 10 where an inverted electrostatic latent image is formed the liquid developing agent that has been applied to the developing belt 510 that is the developing agent bearing member, transfer apparatus 62 that transfers the normal developed image from developing belt 510 to the specified paper, cleaning apparatus 70 that removes the toner on photosensitive member 10, and charge removal apparatus 80 that neutralizes the charge on the charged photosensitive member 10.

Developing apparatus 52 is provided with developing belt 510, which is the developing agent bearing member, drive rollers 512*a,* 512*b,* and 512*c* that provide the rotational drive for developing belt 510 and that also support developing belt 510 such that part of the belt contacts photosensitive member 10, supply apparatus 53 that supplies liquid developing agent 508 to developing belt 510, and scraper blade 516 that scrapes off the liquid developing agent 508 adhering to developing belt 510.

Supply apparatus 53 is provided with four developing cartridges, 51*a,* 51*b,* 51*c,* and 51*d.* Liquid developing agent 508*a* containing yellow toner is stored in tank 502 of developing cartridge 51*a,* liquid developing agent 508*b* containing magenta toner is stored in tank 502 of developing cartridge 51*b,* liquid developing agent 508*c* containing cyan toner is stored in tank 502 of developing cartridge 51*c,* and liquid developing agent 508*d* containing cyan [Trans note: Probably should say "black".] toner is stored in tank 502 of developing cartridge 51*d.* Supply apparatus 53 uses a movement device (not illustrated) to bring the application roller 506 of one of the developing cartridges into contact with developing belt 510 and thereby can apply liquid developing agent containing toner of a specific color to developing belt 510.

Transfer apparatus 62 is provided with intermediate transfer drum 620, which is the intermediate transfer member for the first-stage transfer step, power supply apparatus 621 that applies a bias voltage to intermediate transfer drum 620, second-stage transfer roller 662, which is the second-stage transfer member of the second-stage transfer step, disposed such that it contacts intermediate transfer drum 620, fusing roller 624 disposed such that it contacts the inner surface of intermediate transfer drum 620 at the position of contact between second-stage transfer roller 622 and intermediate transfer drum 620, and scraper blade 628 that scrapes off the toner remaining on intermediate transfer drum 620 after the second-stage transfer.

Intermediate transfer drum 620 is disposed such that it contacts developing belt 510 and is rotated in the opposite direction to the direction of rotation of developing belt 510. As shown in FIG. 22, intermediate transfer drum 620 has a core layer formed from a conductive material, a resistance layer formed on the core layer, and a surface layer formed on the resistance layer. The surface layer is formed from teflon, silicone, or other material that has good release properties. The core layer is formed from a conductive material in order to allow a bias voltage to be applied to intermediate transfer drum 620. Since a developing bias is applied to developing belt 510, the resistance layer is required in order to insulate intermediate transfer drum 620 from developing belt 510. The electric resistance value of the resistance layer must be from $10^8$ to $10^{13}\Omega$ cm. The purpose of the good release properties of the surface layer is to weaken the physical adhesive force between the toner and intermediate transfer drum 620 and to facilitate the movement of the toner to the paper. Note that, if a surface layer that has an electric resistance value of $10^8$ to $10^{13}\Omega$ cm can be formed, the resistance layer is not required.

Second-stage transfer roller 622 rotates in the opposite direction to the direction of rotation of intermediate transfer drum 620 and thereby feeds the specified paper between intermediate transfer drum 620 and second-stage transfer roller 622. At this time, second-stage transfer roller 622 is pressed against intermediate transfer drum 620 through the medium of the paper. Fusing heater 624 that adds heat to intermediate transfer drum 620 is disposed inside fusing roller 624. Note that the fusing heater may be disposed inside the second-stage transfer roller and add heat to the second-stage transfer roller.

Figure 23A:
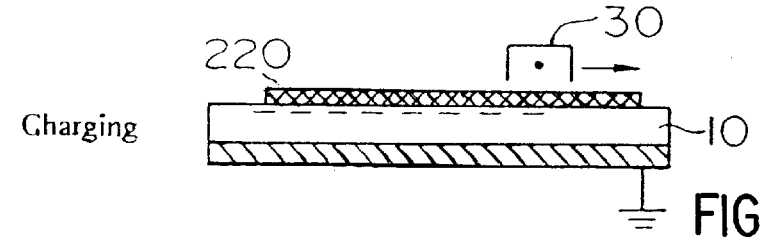
FIGS. 23(A)–23(F) show the operation of the image formation apparatus shown in FIG. 21.
Figure 23B:
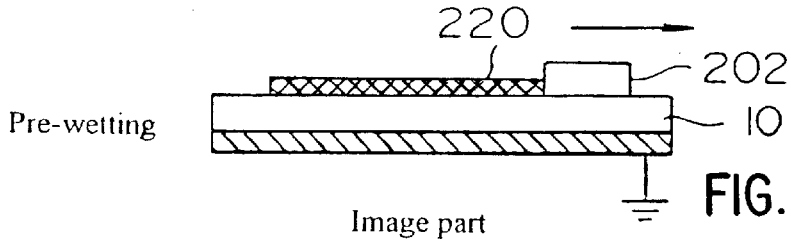

The operation of the multi-color image formation apparatus of this embodiment is explained next. First, as shown in FIG. 23(A), the surface of photosensitive member 10 is charged by charging apparatus 30. Then, as shown in FIG. 23(B), pre-wet apparatus 20 applies pre-wet liquid 220 to photosensitive member 10.

Figure 23C:
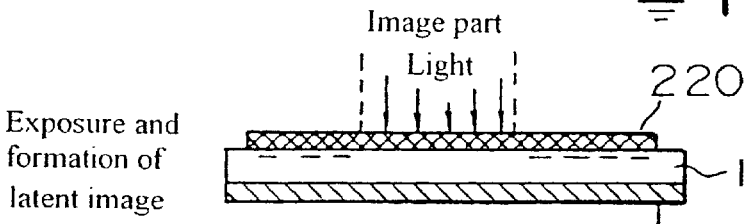
Figure 23D:
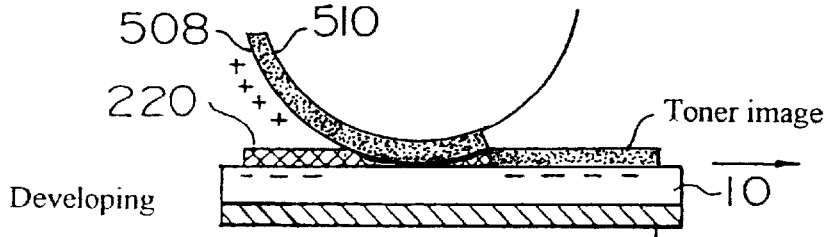

Next, as shown in FIG. 23(C), exposure apparatus 40 exposes the inverted image on the charged photosensitive member 10 to form an inverted electrostatic latent image on the surface of photosensitive member 10. Then, as shown in FIG. 23(D), the liquid developing agent layer formed on developing belt 510 is brought close to the inverted electrostatic latent image that has been formed on the surface of photosensitive member 10 such that electrostatic force moves the charged toner to photosensitive member 10. This forms an inverted developed image on photosensitive member 10 and forms a normal developed image on developing belt 510. Note that supply apparatus 53 uses a movement device (not illustrated) to bring the application roller 506 of one of the developing cartridges into contact with developing belt 510 and thereby applies liquid developing agent containing toner of a specific color to developing belt 510, as shown in FIG. 21. In this way, a normal developed image of the required color can be formed on developing belt 510.

Figure 23E:
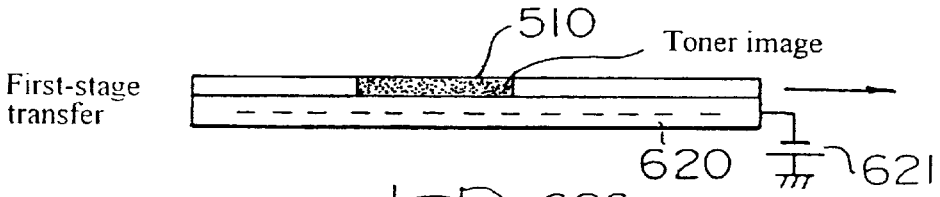

Next, transfer apparatus 60 performs the first-stage transfer in which the normal developed image that has been formed on developing belt 510 is transferred to intermediate transfer drum 620. For this first-stage transfer, the electrostatic force generated by the bias voltage that is applied to intermediate transfer drum 620 by power supply apparatus 621 is used to migrate the normal developed image formed on developing belt 510 to intermediate transfer drum 620, as shown in FIG. 23(E). Cleaning apparatus 70 then removes the liquid developing agent 508 remaining on photosensitive member 10, and charge removal apparatus 80 neutralises the charge on photosensitive member 10. Then, the above movement apparatus switches the developing cartridge that is in contact with developing belt 510. The above cycle, from charging to charge neutralization, is then repeated such that the yellow, magenta, cyan, and black normal developed images are successively transferred and superimposed on each other on intermediate transfer drum 620. In this way, a full-color developed image is formed on intermediate transfer drum 620. Note that, if the liquid developing agent is not transferred properly and remains on developing belt 510, the remaining liquid developing agent 508 is removed by scraper blade 516.

Figure 23F:
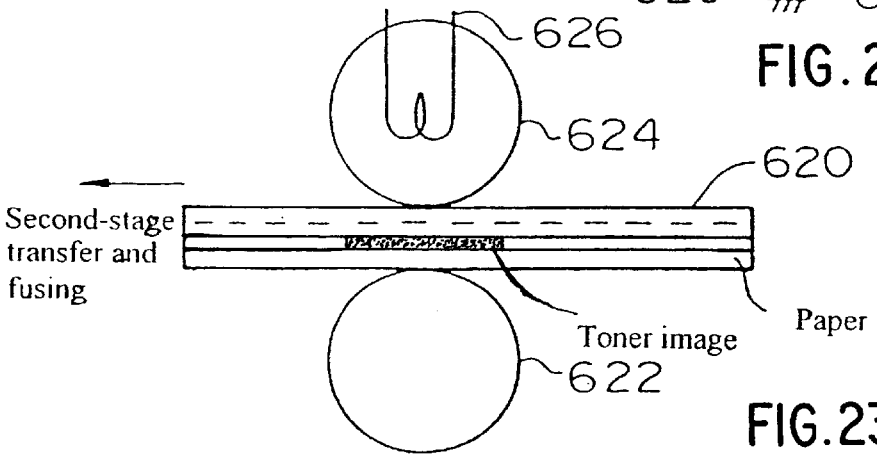

Next, transfer apparatus 60 performs the second-stage transfer in which the full-color developed image that has been formed on intermediate transfer drum 620 is transferred to the paper used as the substrate and, at the same time, fixes the image to the paper. To achieve the second-stage transfer, the full-color developed image that has been formed on intermediate transfer drum 620 is separated from intermediate transfer drum 620, which has a surface layer with good release properties, by means of the pushing force of second-stage transfer roller 622 against intermediate transfer drum 620 and is moved to the paper that is fed between intermediate transfer drum 620 and second-stage transfer roller 622, as shown in FIG. 23(F). At the same time, fusing roller 624 adds heat by means of fusing heater 626 and, thereby, the image is thermally fused and fixed to the paper. In this way, a color image can be formed on the paper.

The multi-color image formation apparatus of this embodiment uses a first-stage transfer step that successively transfers to and superimposes on intermediate transfer drum 620 each of the normal developed images of specified colors that are formed on developing belt 510, thereby forming a full-color developed image on intermediate transfer drum 620, then uses a second-stage transfer step to transfer the full-color developed image that has been formed on intermediate transfer drum 620 to the paper that is the substrate. As a result, proper registration of the color image formed on the paper is simplified.

In addition, since developing belt 510 that is formed from a flexible belt-type element is used as the developing agent bearing member in this embodiment, a rigid body such as a drum can be used for the photosensitive member and the intermediate transfer member. Consequently, belt snaking control need only be provided for developing belt 510. Therefore, operations are easier to control than when a drum or other rigid body is used as the developing agent bearing member and a flexible belt-type material is used for the photosensitive member and intermediate transfer member, and the size of the apparatus can be smaller.

Note that the description for the first-stage transfer performed by the transfer apparatus of this embodiment explains use of a bias voltage applied to intermediate transfer drum 620 by power supply apparatus 621 to transfer the normal developed images formed on developing belt 510 to intermediate transfer drum 620 in the first-stage transfer, but this invention is not restricted in this matter. For the first-stage transfer, the transfer apparatus may, for example, use a corona discharge device to charge the intermediate transfer drum at the point of transfer with a charge of opposite polarity to the toner and thereby transfer the normal developed image that has been formed on the developing belt to the intermediate transfer drum. In this case, the electric resistance value of the intermediate transfer drum must be $10^{12}\Omega$ cm or higher in order to insulate the intermediate transfer drum and the developing belt from each other. Note that earthing rollers 712 must be disposed on both sides of corona discharge device 710 on the inside of intermediate transfer drum 720 to neutralise the charge.

Figure 24:
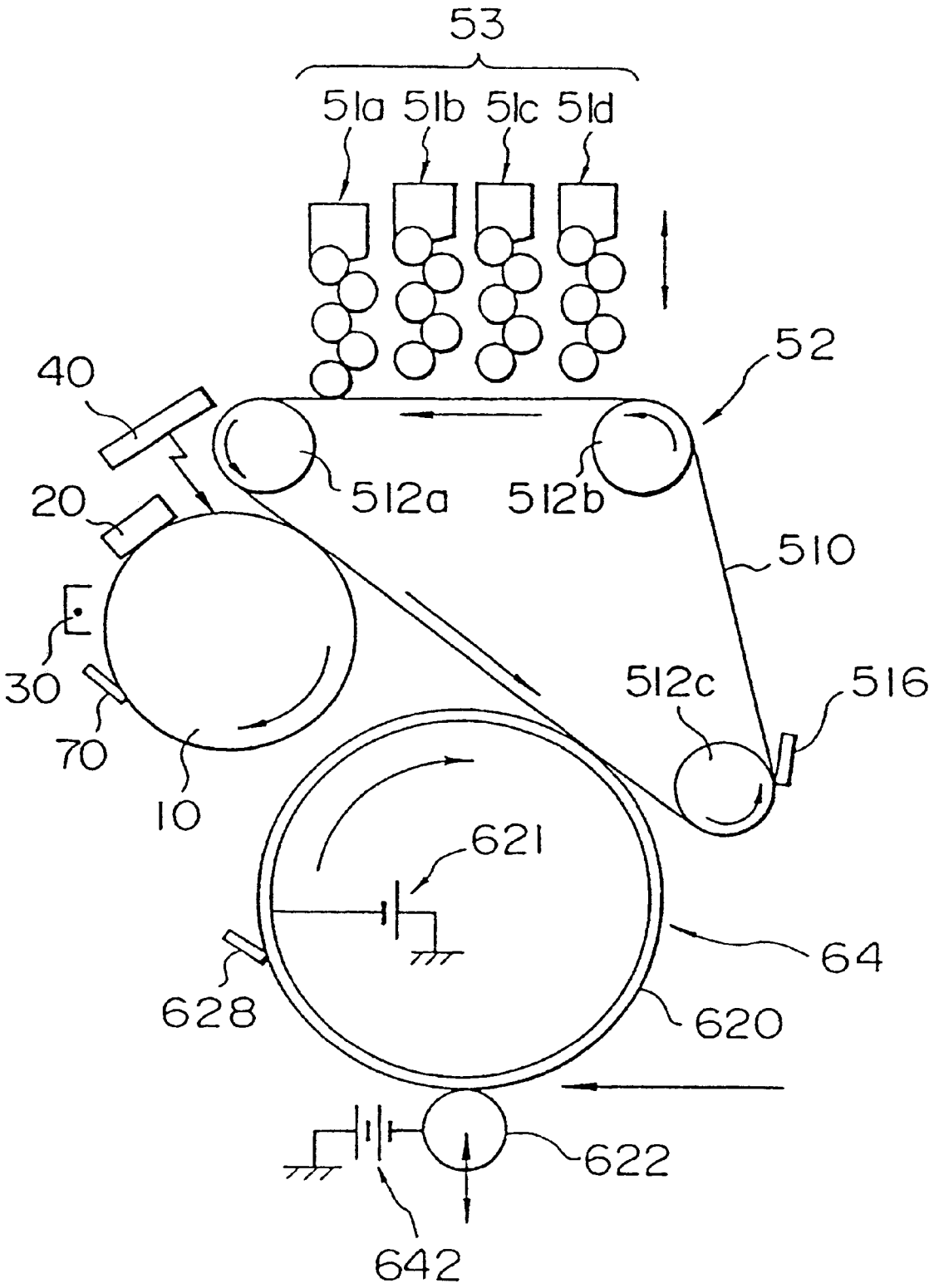
FIG. 24 shows an example of a modification to the multi-color image formation apparatus of the fourth embodiment of this invention.
Figure 25:
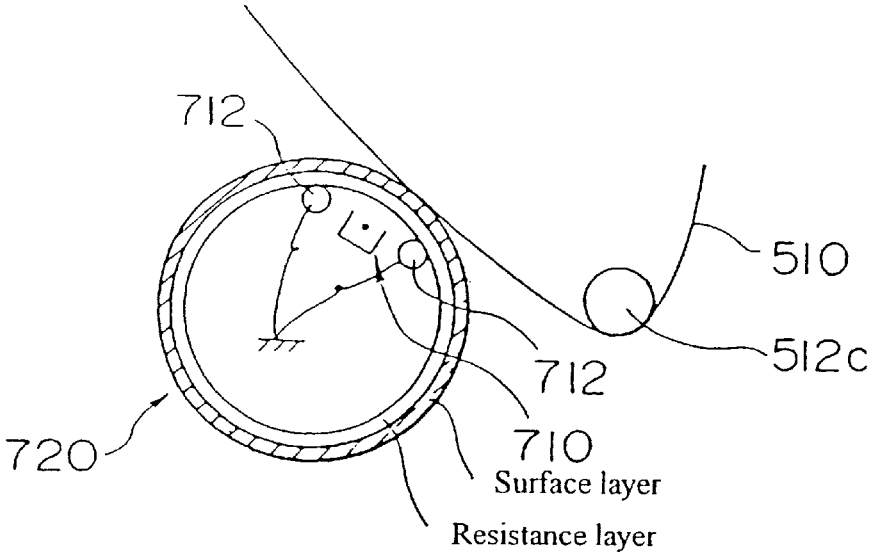
FIG. 25 shows a modified example of transfer apparatus that can be used by the multi-color image formation apparatus of the fourth embodiment of this invention.

The description for the second-stage transfer performed by the transfer apparatus of the fourth embodiment explains use of the pushing force of second-stage transfer roller 622 against intermediate transfer drum 620 through the medium of the paper and use of fusing roller 624 that adds heat from fusing heater 626 to simultaneously transfer and fix to the paper the full-color developed image that has been formed on intermediate transfer drum 620, but this invention is not restricted in this matter. Apparatus such as transfer apparatus 64 shown in FIG. 24, for example, may use power supply apparatus 642 to apply a bias voltage to second-stage transfer roller 622 and thereby achieve the second-stage transfer to the paper of the full-color developed image that has been formed on intermediate transfer drum 620, and may subsequently fix the developed image to the paper.

In addition, for the fourth embodiment, use of intermediate transfer drum 620 as the intermediate transfer member is described, but this invention is not restricted in this matter. A flexible belt-type material, for example, may be used for the intermediate transfer member.

For the supply apparatus of the fourth embodiment, provision of developing cartridge 51*a* that supplies liquid developing agent containing yellow toner to the developing belt, developing cartridge 51*b* that supplies liquid developing agent containing magenta toner to the developing belt, developing cartridge 51*c* that supplies liquid developing agent containing cyan toner to the developing belt, and developing cartridge 51*d* that supplies liquid developing agent containing black toner to the developing belt is described, but this invention is not restricted in this matter. The supply apparatus may provide only two or three developing cartridges, as required, to supply liquid developing agent containing toner of the required colors to the developing belt.

Figure 26:
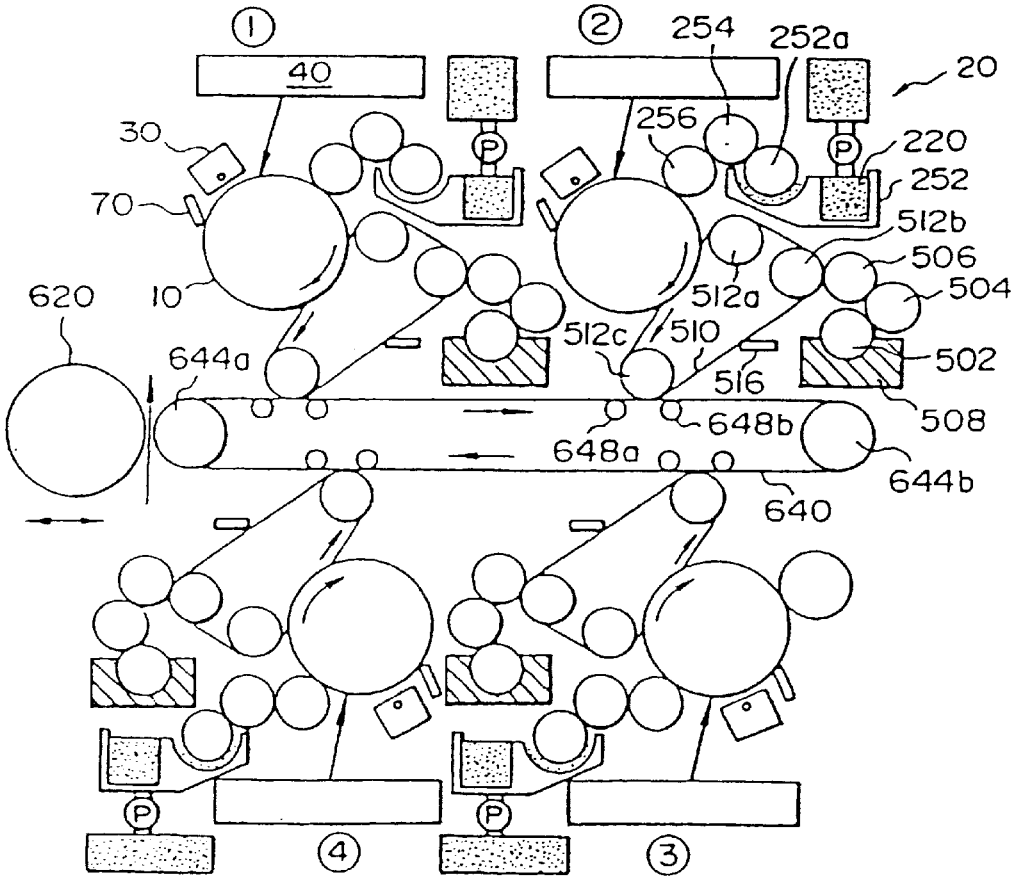
FIG. 26 is an overview of the structure of the multi-color image formation apparatus that is the fifth embodiment of this invention.

FIG. 26 is an overview of the structure of the multi-color image formation apparatus that is the fifth embodiment of this invention. In the apparatus of the fourth embodiment, multiple image formation processes, one for each of the required base colors, share use of a single photosensitive member 10. Therefore, developing belt 510 needs to rotate at least as many times as the number of base colors used in order to complete a color image on the surface of intermediate transfer member 620. In contrast, the multi-color image formation apparatus of the fifth embodiment provides a photosensitive member 10 for each color and, therefore, a color image can be completed on the intermediate belt and transferred to a medium during one revolution of intermediate transfer belt 640.

The multi-color image formation apparatus of the fifth embodiment shown in FIG. 26 provides an image formation device for each color. The image formation devices for each of the colors each comprise photosensitive member 10, pre-wet apparatus 20 that applies pre-wet liquid to photosensitive member 10, charging apparatus 30 that charges photosensitive member 10, exposure apparatus 40 that exposes the inverted electrostatic latent image on photosensitive member 10, developing belt 510 on the surface of which a normal developed image remains when the liquid developing agent is moved to the electrostatic latent image parts on photosensitive member 10, and developing apparatus 50 that applies liquid developing agent evenly to the surface of developing belt 510.

The multi-color image formation apparatus additionally comprises intermediate transfer belt 640 to which the normal developed images, each of which has been formed in toner of a single base color on one of the developing belts, are transferred during the first-stage transfer, thereby forming a color image, and second-stage transfer roller 620 that presses against the paper fed between it and intermediate transfer belt 620 and thereby moves the normal developed image from the intermediate transfer belt to the surface of the paper. Pre-wet apparatus 20 of this embodiment has the same functions as in the multi-color image formation apparatus of the third embodiment, already explained with reference to FIGS. 16 and 17, and is provided with supply roller 252*a* that is immersed in the pre-wet liquid 220 in tank 252, rotating transport roller 254 that contacts the supply roller, and application roller 256 that contacts the transport roller and photosensitive member 10. Pre-wet apparatus 20 uses the pre-wet liquid pump to supply a fixed quantity of pre-wet liquid to photosensitive member 10 and to form an even film of liquid on the surface of the photosensitive member.

Supply roller 502 draws up the liquid developing agent from a receptacle and transport roller 254 transport the liquid developing agent to application roller 506. The application roller then applies a uniform thin film of liquid developing agent to developing belt 510. Developing belt 510 is rotated and maintained at the appropriate tension by drive rollers 512*a,* 512*b,* and 512*c*. The developing belt is brought into soft contact with photosensitive member 10 such that the liquid developing agent touches the electrostatic latent image parts on photosensitive member 10. At this time, the liquid developing agent is drawn to the negative voltage at the latent image parts on the photosensitive member such that a shape corresponding to the parts other than the latent image parts remains as a developed image on the surface of developing belt 510. Accordingly, if the exposure apparatus uses a negative image to illuminate the photosensitive member, the above developed image is the required image. The single-color color image formed on developing belt 510 is transferred to intermediate transfer belt 640. At this time, support rollers 648*a* and 648*b* press intermediate transfer belt 640 against developing belt 510 and apply a negative voltage to move the image to the intermediate transfer belt reliably.

Developing belt 510 is rotated by drive rollers 512*a,* 512*b,* and 512*c* such that it touches photosensitive member 10, intermediate transfer belt 640, and developing agent application roller 506 with the pressure appropriate to each. In addition, scraper blade 516 is provided to scrape off toner remaining on the surface of the developing belt.

Four base colors, yellow, magenta, cyan, and black, are used, but the time required to form one color image is markedly shorter than with the multi-color image formation apparatus of the fourth embodiment. Note that, if the four image formation devices corresponding to the four base colors are positioned such that two are above and two are below intermediate transfer belt 640, they can fit inside a small capacity, as clearly shown in FIG. 26, and the apparatus as a whole can be compact. Naturally, the toner colors are determined on the basis of the color analysis method and are not restricted to the above four colors.

Note that the descriptions for the fourth and fifth embodiments are for examples of exposure of an negative or reversal image and normal development, but this invention is not restricted in this matter. Various modifications, such exposure of a normal image and reversal development, are possible. Any modification in which the desired print image can be obtained on the developing agent bearing member and formed on the substrate can be used.

Figure 27:
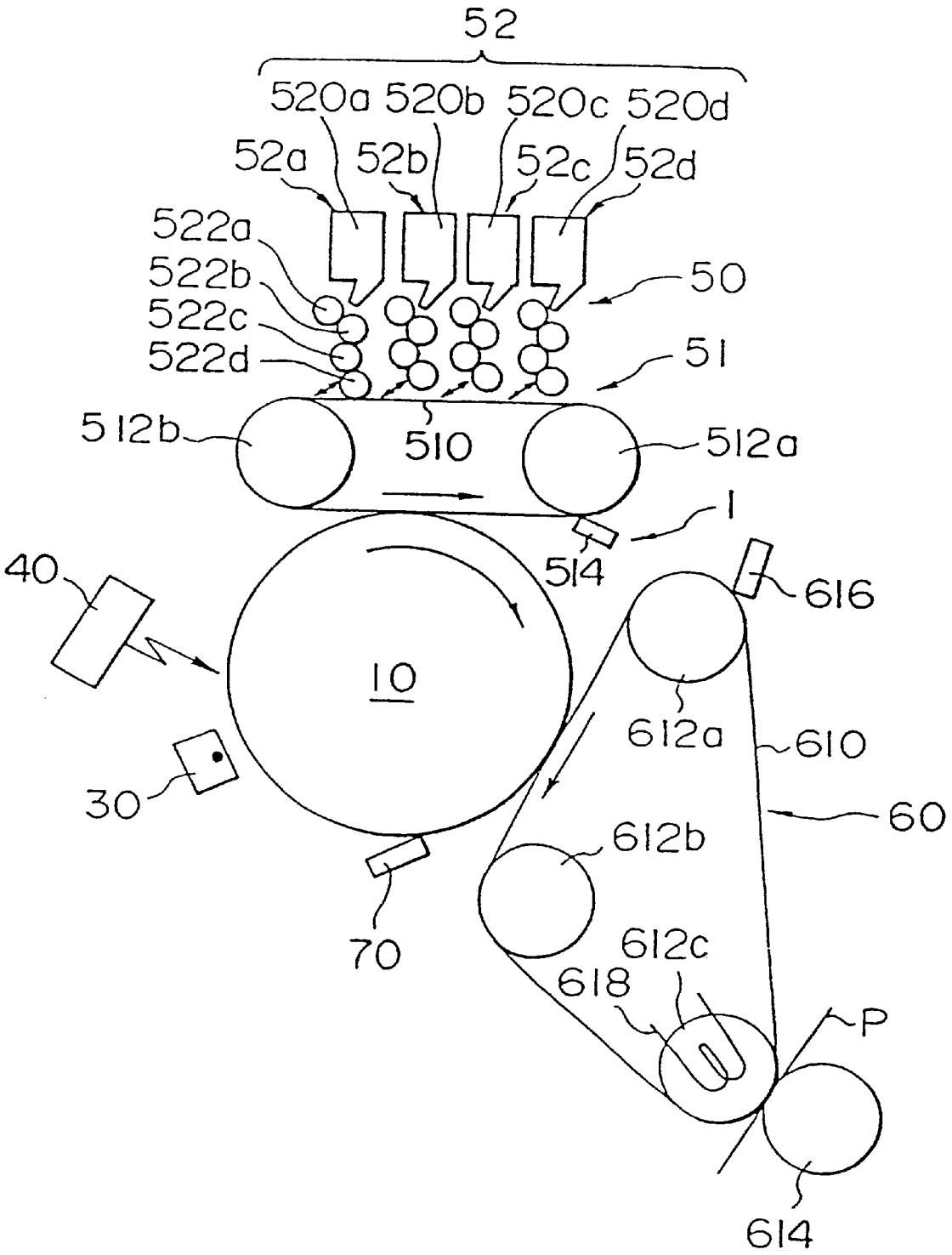
FIG. 27 is an overview of the structure of the electrostatic latent image liquid development type of multi-color image formation apparatus that is the sixth embodiment of this invention.

The sixth embodiment of this invention is explained next, with reference to FIGS. 27 and 28. FIG. 27 is an overview of the structure of the electrostatic latent image liquid development type of multi-color image formation apparatus that is the sixth embodiment of this invention, and FIG. 28 shows the operation of the electrostatic latent image multi-color image formation apparatus shown in FIG. 27.

As shown in FIG. 27, electrostatic latent image liquid development type multi-color image formation apparatus 1 that is the sixth embodiment of this invention is provided with a photosensitive member 10, which is the image bearing member, charging apparatus 30 that gives an electric charge to photosensitive member 10, exposure apparatus 40 that exposes the image on photosensitive member 10, developing apparatus 50 that makes a visible image from an electrostatic latent image by means of supplying toner to the parts on photosensitive member 10 where the electrostatic latent image is formed, transfer apparatus 60 that transfers the toner from photosensitive member 10 to the specified paper P and fixes the toner to the paper, cleaning apparatus 70 that removes the liquid developing agent remaining on photosensitive member 10, and charge removal apparatus (not illustrated) that neutralizes the charged photosensitive member 10.

The related technology used for the electrophotographic type of printers in related art can, in most cases, be used for charging apparatus 30, exposure apparatus 40, cleaning apparatus 70, and the charge removal apparatus. Therefore, for this embodiment, explanations are omitted for the above types of apparatus, but the main parts of this invention, that is, photosensitive member 10, developing apparatus 50, and transfer apparatus 60, are explained.

The surface of the organic photosensitive member 10 that is the image bearing member in this embodiment is provided with a release layer formed from a material that has a lower surface energy then the surface energy of the liquid developing agent described later. The purpose of this layer is to weaken the physical adhesive force between the liquid developing agent (described later) and photosensitive member 10 and to prevent adhesion of the liquid developing agent to the non-image parts on photosensitive member 10. A material such as a fluorocarbon resin or silicone may be used as the material that has a lower surface energy than the surface energy of the liquid developing agent described later.

Developing apparatus 50 is comprised of developing part 51 and application part 52. Development part 51 is provided with developing belt 510, which is the developing agent bearing member, drive rollers 512*a* and 512*b* that provide the rotational drive for the developing belt and that support developing belt 510 such that part of the belt is in contact with photosensitive member 10, and scraper blade 514 that removes the liquid developing agent remaining on developing belt 510. Application part 52 is provided with application devices 52*a*, 52*b*, 52*c*, and 52*d* that apply liquid developing agent to the surface of developing belt 510.

Developing belt 510 is rotated in the opposite direction to the direction of rotation of photosensitive member 10 by drive rollers 512*a* and 512*b*. A flexible belt-type element, such as a seamless nickel belt or a polyimide or other resin belt, is used for developing belt 510. Note that developing belt 510 must be formed such that a developing bias can be applied. Thus, if a resin belt is used, a conductive process for the belt surface or addition of minute conductive particles to the belt raw material is required in order to lower the electric resistance value.

Application devices 52*a* to 52*d* are each provided with bellows pump 520 that stores and also releases the liquid developing agent, transport rollers 522*a*, 522*b*, 522*c*, and 522*d* that transport to developing belt 510 the liquid developing agent released by bellows pump 520, and separating apparatus (not illustrated) that separates transport roller 522*a* from developing belt 510. Bellows pump 520*a* of application device 52*a* stores liquid developing agent containing yellow toner, bellows pump 520*b* of application device 52*b* stores liquid developing agent containing magenta toner, bellows pump 520*c* of application device 52*c* stores liquid developing agent containing cyan toner, and bellows pump 520*d* of application device 52*d* stores liquid developing agent containing black toner.

Transport roller 522*d* is disposed such that it contacts transport roller 522*c*, transport roller 522*c* is disposed such that it contacts transport roller 522*b*, and transport roller 522*b* is disposed such that it contacts transport roller 522*a*. Transport roller 522*d* is rotated in the opposite direction to the direction of rotation of developing belt 510, transport roller 522*c* is rotated in the opposite direction to the direction of rotation of transport roller 522*d*, transport roller 522*b* is rotated in the opposite direction to the direction of rotation of transport roller 522*c*, and transport roller 522*a* is rotated in the opposite direction to the direction of rotation of transport roller 522*b*.

Transfer apparatus 60 is provided with intermediate transfer belt 610, which is the intermediate transfer member, drive rollers 612*a*, 612*b*, and 612*c* that provide the rotational drive for intermediate transfer belt 610 and that support intermediate transfer belt 610 such that part of the belt is in contact with photosensitive member 10, second-stage transfer roller 614, which is the second-stage transfer member, disposed such that it contacts intermediate transfer belt 610, and scraper blade 616 that removes the toner remaining on intermediate transfer belt 610.

Drive rollers 612*a*, 612*b*, and 612*c* provide the rotational drive for intermediate transfer belt 610 and rotate it in the opposite direction to the direction of rotation of photosensitive member 10. Second-stage transfer roller 614 presses against intermediate transfer belt 610 through the medium of paper P. While a four-color developed image is being formed on intermediate transfer belt 610, second-stage transfer roller 614 does not touch intermediate transfer belt 610. Then, during the second-stage transfer, the negatively charged second-stage transfer roller 614 touches intermediate transfer belt 610 through the medium of recording paper P. Note that fusing heater 618 is disposed inside drive roller 612*c* and adds heat to the developed image on intermediate transfer belt 610.

Figure 28A:
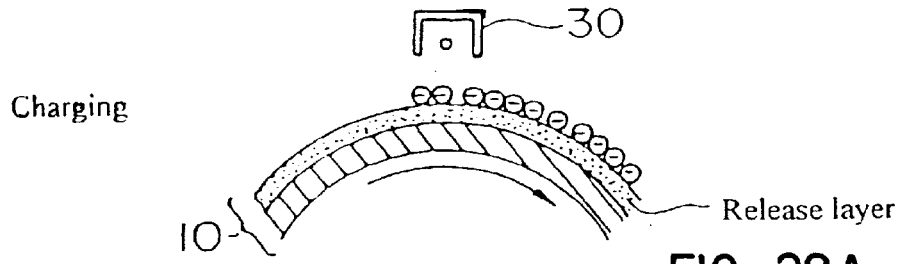
FIGS. 28(A)–28(E) show the operation of the multi-color image formation apparatus shown in FIG. 27.
Figure 28B:
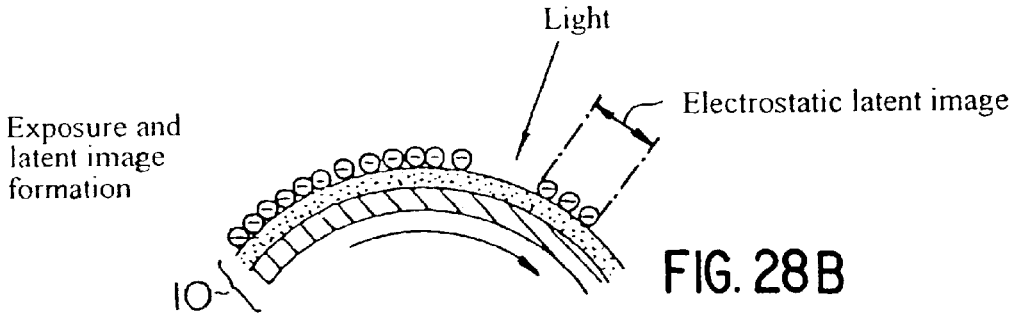

The operation of the electrostatic latent image multi-color image formation apparatus that is the sixth embodiment of this invention is explained next. Firstly, as shown in FIG. 28(A), photosensitive member 10 that has a release layer formed on the surface is charged by charging apparatus 30. Generally, a corona discharge device is used as charging apparatus 30. Then, the image on charged photosensitive member 10 is exposed. A laser scanner or similar is used to expose the image and to form an electrostatic latent image on the surface of photosensitive member 10. The parts hit by the light from the laser scanner are made conductive and lose their charge, as shown in FIG. 28(B). The parts not hit by the light remain as the charged image, that is, the electrostatic latent image.

Next, developing apparatus 50 makes a visible image from the electrostatic latent image. The liquid developing agent released from bellows pump 520 is applied thinly and evenly to the surface of developing belt 510 by means of the multiple transport rollers 522*a* to 522*d*. As a result, a thin layer of liquid developing agent is formed on developing belt 510. Developing apparatus 50 uses the separating apparatus (not illustrated) to bring one of application devices 52*a* to 52*d* into contact with developing belt 510. In this way, a thin uniform film of liquid developing agent containing either yellow, magenta, cyan, or black toner can be applied to developing belt 510.

Figure 28C:
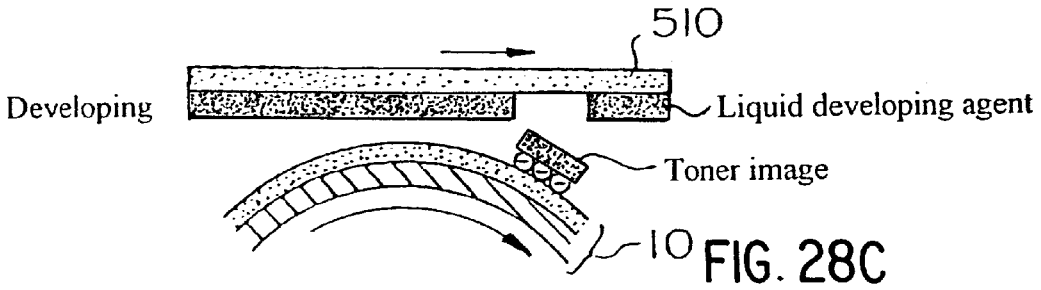

Then, the layer of liquid developing agent formed on developing belt 510 is brought close to the electrostatic latent image that has been formed on the surface of photosensitive member 10, as shown in FIG. 28(C), such that electrostatic force migrates the charged toner to photosensitive member 10 and forms a developed image on photosensitive member 10.

Figure 28D:
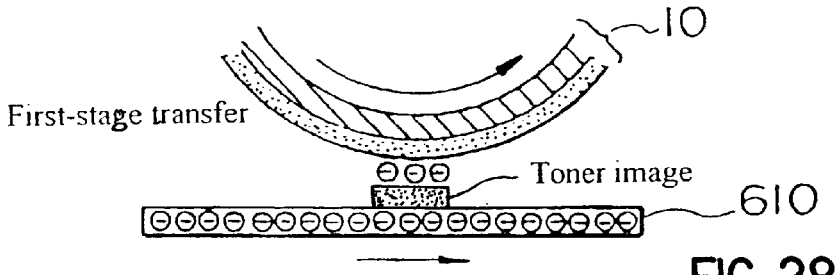
Figure 28E:
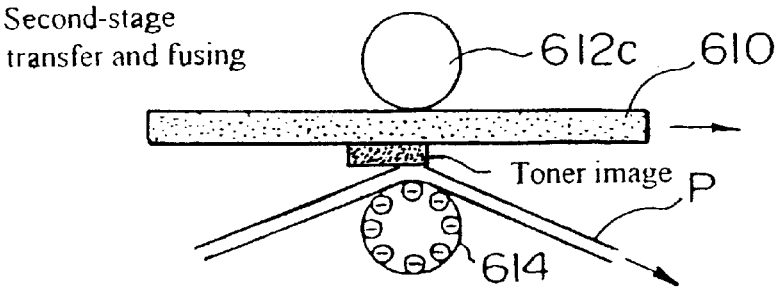

Next, transfer apparatus 60 uses electrostatic force or other means to transfer the developed image formed on photosensitive member 10 to intermediate transfer belt 610 in the first-stage transfer, as shown in FIG. 28(D). Then, cleaning apparatus 70 removes the liquid developing agent remaining on photosensitive member 10 and charge removal apparatus (not illustrated) neutralizes the charge on photosensitive member 10. Next, the separating mechanism (not illustrated) is used to change which application apparatus, 52*a*, 52*b*, 52*c*, or 52*d*, is in contact with developing belt 510. The cycle described above, from charging through to charge neutralization, can then be repeated to transfer and successively superimpose yellow, magenta, cyan, and black developed images on intermediate transfer belt 610. In this way, a full-color developed image is formed on intermediate transfer belt 610.

Transfer apparatus 60 transfers the full-color developed image that has been formed on intermediate transfer belt 610 to the substrate, paper P, in the second-stage transfer and uses separate fusing apparatus (not illustrated) to fix the image to the paper. In the second-stage transfer, the full-color developed image formed on intermediate transfer belt 610 is moved to paper P by means of the pushing force of second-stage transfer roller 614 against intermediate transfer belt 610 and by electrostatic force. Then, the fusing device thermally fuses the toner and fixes the image to the paper. In this way, a color image can be formed on paper P.

Figure 35:
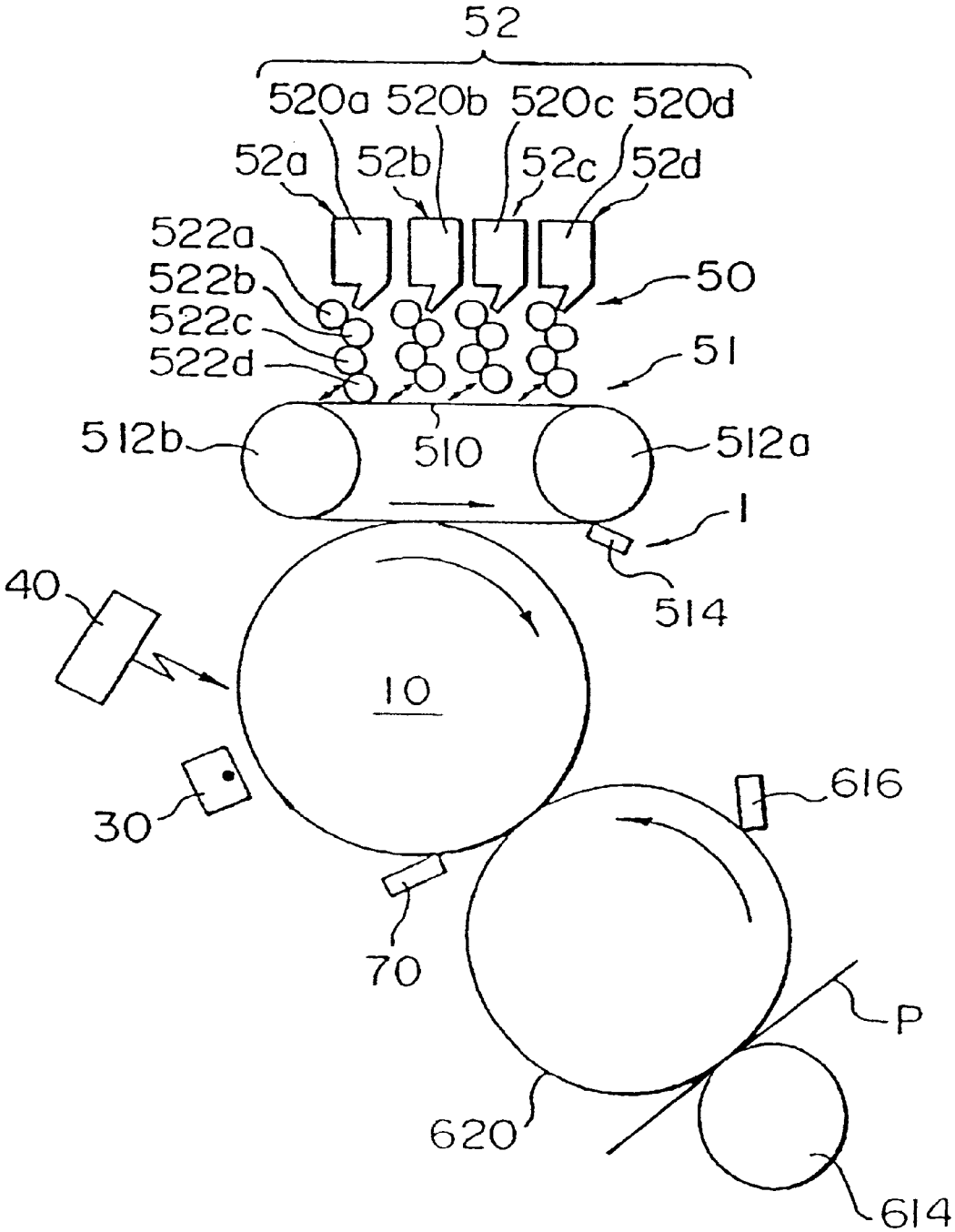
FIG. 35 is an overview of the structure of the electrostatic latent image liquid development type of multi-color image formation apparatus that is the sixth embodiment of this invention but shows different operational characteristics.

Note that, if electrostatic force is not used, a heater may be disposed inside drive roller 612. In that case, the pushing force of second-stage transfer roller 614 against intermediate transfer belt 610 and the heat from the heater are used to move the toner to paper P in the second-stage transfer and, at the same time, to thermally fuse and fix the toner to paper P. Intermediate transfer drum 620 may be used instead of intermediate transfer belt 610, as shown in FIG. 35. Use of intermediate transfer drum 620 provides greater running stability.

Note that the other components in FIG. 35 are the same as in FIG. 27.

Figure 29:
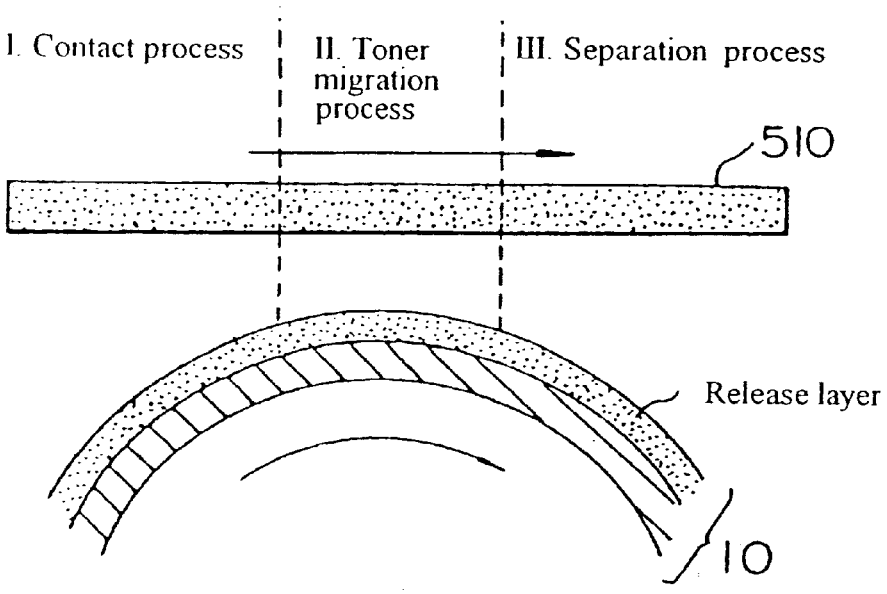
FIG. 29 shows an overview of the developing process used by the multi-color image formation apparatus in the sixth embodiment of this invention.
Figure 30:
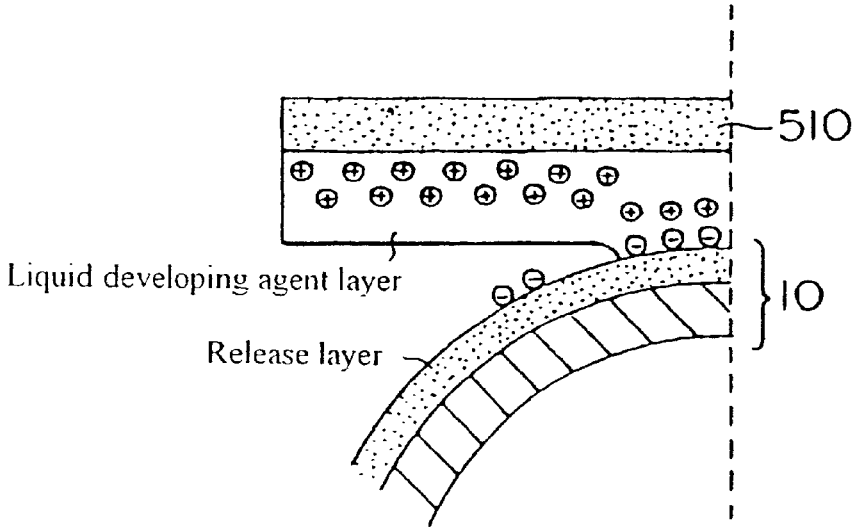
FIG. 30 shows details of the contact process used by the multi-color image formation apparatus in the sixth embodiment of this invention.
Figure 31:
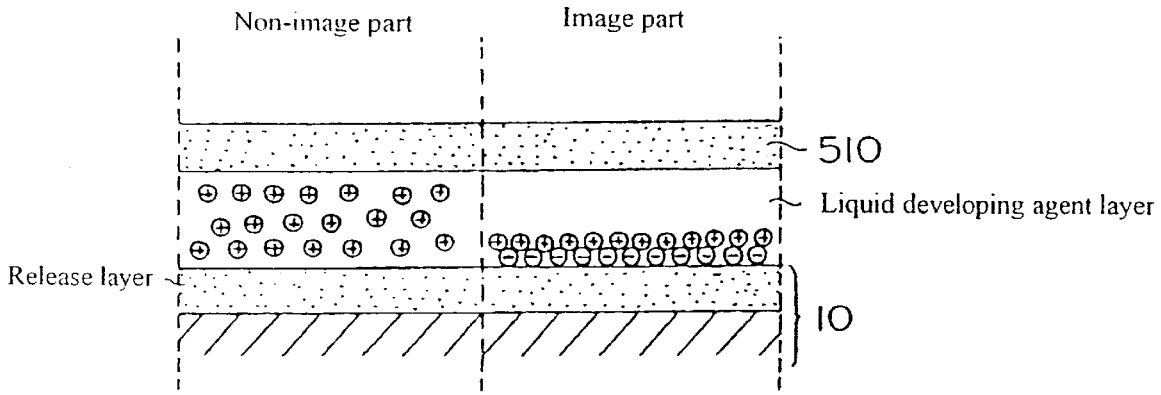
FIG. 31 shows details of the toner migration process used by the multi-color image formation apparatus in the sixth embodiment of this invention.
Figure 32:
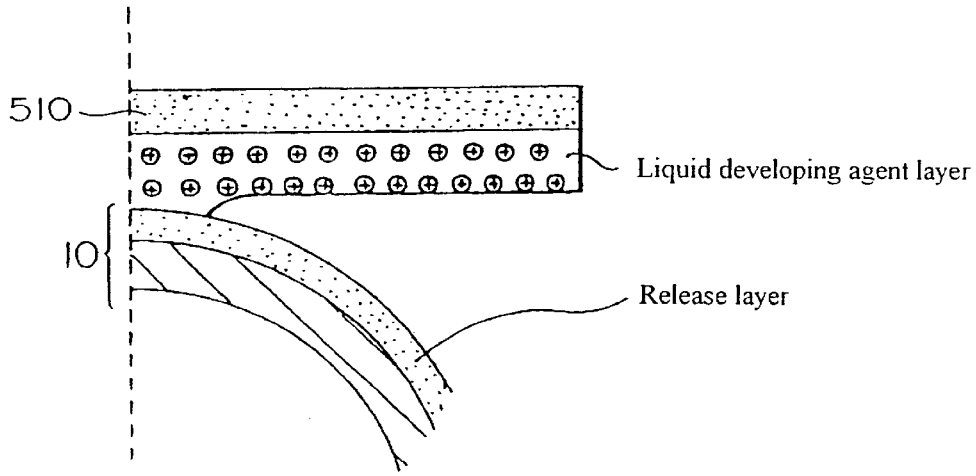
FIG. 32 shows the separation process used at non-image parts by the multi-color image formation apparatus in the sixth embodiment of this invention.
Figure 33:
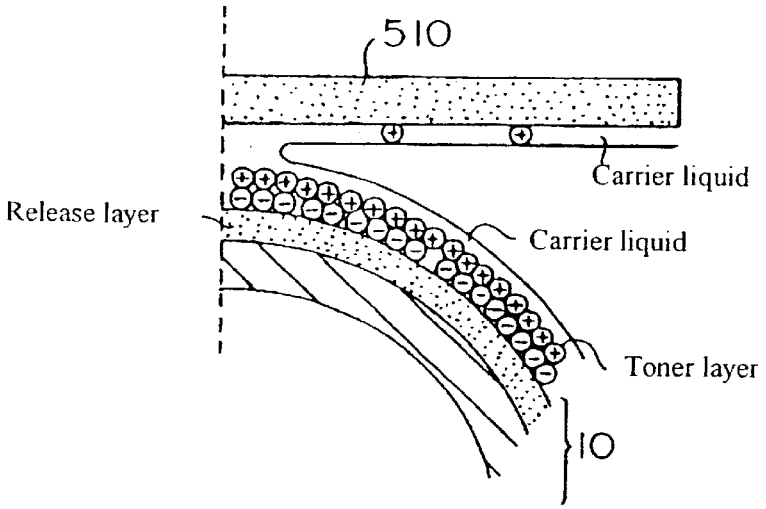
FIG. 33 shows the separation process used at image parts by the multi-color image formation apparatus in the sixth embodiment of this invention.

FIGS. 29 to 33 show details of the developing process in the sixth embodiment of this invention. FIG. 29 shows an overview of the developing process, FIG. 30 shows details of the contact process, FIG. 31 shows details of the toner migration process, FIG. 32 shows the separation process used at non-image parts, and FIG. 33 shows the separation process used at image parts. The developing process of this embodiment can be thought of as consisting of the following three processes, as shown in FIG. 29: the contact process in which developing belt 510 contacts photosensitive member 10 and the liquid developing agent contacts the surface of photosensitive member 10; the toner migration process in which the liquid developing agent layer and the release layer of photosensitive member 10 make soft contact, allowing the toner to migrate; and the separation process in which developing belt 510 separates from photosensitive member 10 and the toner adhering to developing belt 510 separates from the toner adhering to photosensitive member 10.

Developing belt 510 is constructed as a flexible belt-type element. Therefore, during the contact process, the contact force is distributed when the liquid developing agent layer on developing belt 510 and the release layer of photosensitive member 10 touch, as shown in FIG. 30. Thus the layer of highly viscous liquid developing agent, comprised of a carrier liquid and toner, and the release layer of photosensitive member 10 form a soft contact.

During the toner migration process, the Coulomb force acting between the electric charge on photosensitive member 10 and the charged toner causes the toner on developing belt 510 to migrate and adhere to the latent image surface at the image parts, as shown in FIG. 31. At the non-image parts, the Coulomb force does not act on the charged toner and the toner on developing belt 510 does not migrate to the surface of photosensitive member 10. In addition, since the release layer formed on the surface of photosensitive member 10 has a lower surface energy than the surface energy of the liquid developing agent, physical adhesive force does not cause the toner to adhere to the surface of photosensitive member 10.

During the separation process, the liquid developing agent layer remains on developing belt 510 at the non-image parts, as shown in FIG. 32. Since, at the interface between the release layer of photosensitive member 10 and the liquid developing agent layer, the surface energy of the release layer is lower than the surface energy of the liquid developing agent, physical adhesive force does not cause the liquid developing agent to adhere to the surface of photosensitive member 10. At the image parts, the toner that has migrated to the surface of photosensitive member 10 pushes the carrier liquid away such that a carrier liquid layer is formed on top of the toner layer. Then, the carrier liquid layer is separated in two, with some of the carrier liquid remaining on developing belt 510 and some being moved to photosensitive member 10.

Figure 34:
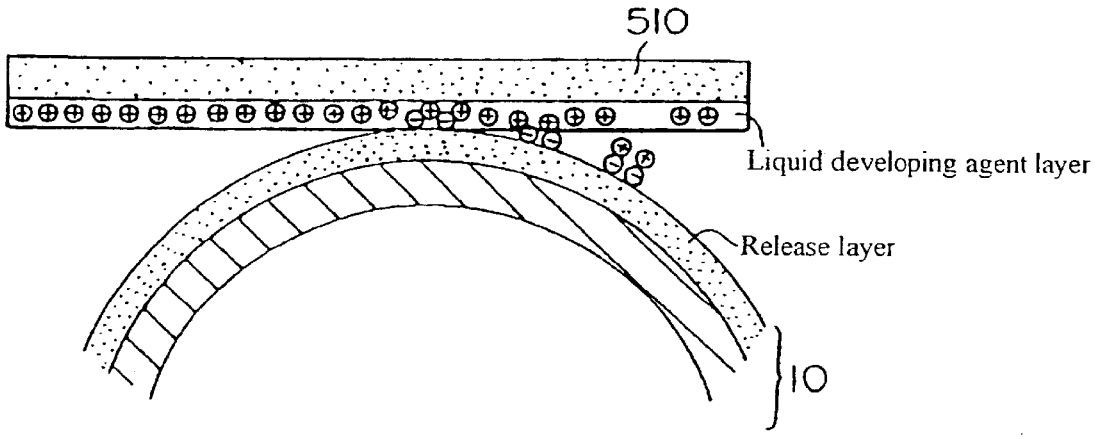
FIG. 34 shows the significance of the use of the liquid developing agent as a thin film by the multi-color image formation apparatus in the sixth embodiment of this invention.

FIG. 34 shows the significance of the liquid developing agent being in the form of a thin film. If the layer of liquid developing agent applied to developing belt 510 is too thick, the high viscosity of liquid developing agent 508 causes excessive toner migration, causes inaccuracies in the developed image formed on photosensitive member 10, and produces image noise. This is because the excessive viscosity between the toner selection that should be moved from developing belt 510 to the surface of photosensitive member 10 by the electrostatic force forms a cluster with the surrounding toner and the cluster moves to photosensitive member 10. To suppress the formation of such clusters, the value of the minimum layer thickness of liquid developing agent layer that will provide good developing results must be determined, but the developing agent layer must be kept sufficiently thick to provide good image density.

In addition, since this embodiment uses a photosensitive member 10 on which a release layer is formed such that the surface energy on the surface of photosensitive member 10 is lower than the surface energy of the liquid developing agent, the physical adhesive force between the liquid developing agent and photosensitive member 10 can be weakened. As a result, this embodiment can prevent the adhesion of toner to the non-image parts on photosensitive member 10 and can prevent image noise being generated by, for example, toner adhesion at the non-image parts.

Note that, instead of a release layer being provided on the surface of photosensitive member 10, a chemically inactive dielectric liquid that has good release properties may be applied as a pre-wet liquid on photosensitive member 10 in order to prevent the adhesion of toner to the non-image parts on photosensitive member 10. However, this necessitates addition of a pre-wet process that applies pre-wet liquid to the surface of photosensitive member 10 at the start of the developing process, and pre-wet apparatus that performs this process is required. Accordingly, in comparison with apparatus that includes a pre-wet process, this embodiment enables reductions in the apparatus size and running costs.

The use of an organic photosensitive member 10 as the image bearing member in this embodiment has been explained, but this invention is not restricted in this matter. Provided that a release layer that has a lower surface energy than the surface energy of the liquid developing agent is provided on the surface of the image bearing member, the image bearing member may be any of the photosensitive members used with the Carlson method, may be the type of member used with ionographic or similar methods in which an insulating layer is formed on a conductive body that forms the electrostatic latent image directly, or may be the type of electrostatic recording paper used with electrostatic plotters.

Application apparatus that applies liquid developing agent to developing belt 510 by means of multiple transport rollers 522*a* to 522*d* was explained for this embodiment, but this invention is not restricted in this matter. Any method may be used provided that a thin layer of liquid developing agent can be formed on developing belt 510. For example, a rubber or rigid blade may be used to regulate the thickness of the layer of liquid developing agent applied to developing belt 510 such that a thin layer of liquid developing agent is formed on developing belt 510.

Further, for this embodiment, use developing belt 510 constructed from a flexible belt-type element as the developing agent bearing member has been described, but this invention is not restricted in this matter. An elastic roller formed from an elastic material or a rigid roller formed from metal or other rigid material may be used as the developing agent bearing member. However, in order to bring a hard roller into contact with the image bearing member without squashing the liquid developing agent layer formed on the rigid roller, an image bearing member belt constructed from a flexible belt element must be used as the image bearing member or, alternatively, the rigid roller must be positioned such that a minute gap is formed between the rigid roller and the image bearing member.

In addition, the transfer apparatus described for this embodiment transfers the developed image formed on photosensitive member 10 to intermediate transfer belt 10, which is the intermediate transfer member, during the first-stage transfer, then performs a second-stage transfer which transfers to paper P the developed image that was transferred to intermediate transfer belt 610 during the first-stage transfer, thereby forming an image on paper P, but this invention is not restricted in this matter. Any apparatus that can transfer the developed image formed on the image bearing member to the substrate may be used. Monochrome liquid developing apparatus, for example, in which the developed image formed on the image bearing member is transferred directly to the substrate without performing a first-stage transfer to an intermediate transfer member may be used.

This invention is not restricted to the embodiments described above, and various modifications are possible within the scope of the main elements.

Note that pre-wet apparatus that uses pre-wet liquid supply element 202 to apply pre-wet liquid 220 to the surface of photosensitive member 10 has been described, but this invention is not restricted in this matter. Any pre-wet apparatus that can apply a fixed quantity of pre-wet liquid evenly to the surface of photosensitive member 10 may be used. For example, the pre-wet apparatus may use multiple radial nozzles to discharge and apply the pre-wet liquid, or a sponge roller or similar may be used to apply the pre-wet liquid.

In addition, pre-wet apparatus 20 described above applies pre-wet liquid 220 to the electrostatic latent image bearing member, and then exposure apparatus 40 exposes the image on the charged electrostatic latent image bearing member, but this invention is not restricted in this matter. Pre-wet apparatus 20 may apply pre-wet liquid 220 to the electrostatic latent image bearing member after exposure apparatus 40 exposes the image on the charged electrostatic latent image bearing member.

Developing apparatus that uses developing belt 510, constructed from a flexible belt element, as the developing agent bearing member has been described, but this invention is not restricted in this matter. The developing apparatus may use a developing roller formed from a metal or other conductive element as the developing agent bearing member. However, in this case, an electrostatic latent image bearing member constructed from a flexible element must be used, or the developing roller must be positioned such that a minute gap is formed between the developing roller and the electrostatic latent image bearing member, such that the two-layer structure of the liquid developing agent layer formed on the developing roller and the pre-wet liquid layer formed on the electrostatic latent image bearing member is maintained when the layers touch and such that the two layers can be separated at a point inside the pre-wet liquid layer.

Furthermore, in the developing cartridge described for the developing apparatus, the liquid developing agent released by release roller 503 is supplied to application roller 506 by means of transport rollers 514*a* and 514*b* then applied to developing belt 510, but this invention is not restricted in this matter. Any developing cartridge that can apply the highly viscous liquid developing agent thinly and evenly to the developing agent bearing member may be used.

The use of an organic photosensitive member as the electrostatic latent image bearing member has been explained, but this invention is not restricted in this matter. The electrostatic latent image bearing member may be any of the photosensitive members used with the Carlson method, may be the type of member used with ionographic or similar methods in which an insulating layer is formed on a conductive body that forms the electrostatic latent image directly, or may be the type of electrostatic recording paper used with electrostatic plotters.

In addition, this invention is not restricted to the embodiments described above. If a release layer is formed and the thickness of the layer of liquid developing agent is from 5 to 40 $\mu$m, the viscosity of the highly viscous developing agent may be 10,000 mPa•s. Currently, if a highly viscous developing agent has a viscosity of 6,000 mPa•s or more, the carrier liquid and toner are difficult to stir. Therefore, such viscosities are considered unsuitable for cost reasons. However, developing agents with viscosities over 6,000 mPa•s may be used if they can be obtained cheaply. Use of viscosities in excess of 10,000 mPa•s is not realistic. Note that the carrier liquid in the liquid developing agent is not restricted to silicone fluid. Furthermore, if a developed image that amply meets requirements can be formed on the developing agent bearing member without a pre-wet liquid, pre-wet liquid need not be applied to the electrostatic latent image bearing member.

INDUSTRIAL FIELD OF UTILISATION

In the multi-color image formation apparatus of this invention, described above, the above structure enables formation of a developed image of a specified color, such as yellow, magenta, cyan, or black, on the corresponding image bearing member and enables sequential transfer to the substrate of the developed images, each formed on one of the image bearing members. This enables high-speed image printing. In addition, high resolutions can be achieved due to use of a highly viscous liquid developing agent in which the toner is dispersed at a high concentration. Moreover, this invention provides a low-pollution multi-color image formation apparatus.

Note that, if a transfer member formed as a thin flexible belt-type element is used, the contact pressure can be distributed when the developed image on the image bearing member touches the substrate, enabling prevention of developed image inaccuracies. Thus, this invention provides a multi-color image formation apparatus capable of transferring developed images to the substrate without the image spreading.

If an elastic cylindrical transfer member is used in the multi-color image formation apparatus of this invention, even higher image printing speeds can be achieved and the intimacy of contact between the substrate and the intermediate transfer member can be improved. Thus, this invention provides a multi-color image formation apparatus that transfers images well.

Other multi-color image formation apparatus of this invention is provided with a first-stage transfer step that sequentially transfers the developed images, each formed on one of the image bearing members, to an intermediate transfer member and thereby forms a full-color developed image on the intermediate transfer member, and a second-stage transfer step that performs the second-stage transfer to the substrate of the full-color image formed on the intermediate transfer member. Thus, matters such as paper alignment that must be considered when the developed images, each formed on one of the image bearing members, are transferred directly to the substrate do not apply. Thus, in addition to the benefits of the type of multi-color image formation apparatus described above, this invention provides a multi-color image formation apparatus that can easily achieve proper registration of the color image transferred to the paper.

Note that, in other multi-color image formation apparatus of this invention, if an intermediate transfer member formed as a thin flexible belt-type element is used, the contact pressure can be distributed when the intermediate transfer member touches the developed image formed on the surface of latent image on the image bearing member, enabling prevention of developed image inaccuracies. Thus, this invention provides a multi-color image formation apparatus capable of achieving the first-stage transfer without the developed image on the intermediate transfer member spreading.

In addition, if an elastic cylindrical intermediate transfer member is used in the multi-color image formation apparatus of this invention, even higher image printing speeds can be achieved and the intimacy of contact between the substrate and the intermediate transfer member can be improved. Thus, this invention provides a multi-color image formation apparatus that transfers images well.

If a pre-wetting step, in which a chemically inactive dielectric liquid that has good release properties is applied as a pre-wet liquid to the image bearing member, is provided for the above multi-color image formation apparatus, this invention provides a multi-color image formation apparatus that can prevent the adhesion of toner to the non-image parts of the image bearing member.

In addition, if a pre-wetting step in which at least one roller is used to apply pre-wet liquid to the image bearing member is used, this invention provides a multi-color image formation apparatus that can supply the required quantity of pre-wet liquid to the image bearing member even when the image bearing member is rotated at high speeds.

The multi-color image formation apparatus of this invention, which forms on the developing agent bearing member a developed image that corresponds to the desired print image and then transfers this image to the substrate, uses a highly viscous liquid developing agent in which the toner is dispersed at a high concentration. Therefore, this invention can easily produce high resolution images from compact apparatus and can prevent the release of polluting gases. In addition, inaccuracies do not occur easily in the developed image formed on the developing agent bearing member and, therefore, transfer of these developed images to the substrate forms images with very little image spread on the substrate.

The multi-color image formation apparatus of this invention in which a release layer is formed on the surface of the image bearing member and in which the release layer has a lower surface energy than the surface energy of the liquid developing agent can prevent the adhesion of toner to the non-image parts of the image bearing member and, therefore, can prevent the occurrence of image noise.

What is claimed is:

1. An image formation apparatus having at least one image formation station, said at least one image formation station comprising an image bearing member, an electrostatic latent image formation stage that forms an electrostatic latent image on said image bearing member, and a developing stage comprising an applicator that supplies a thin layer of a highly viscous liquid developing agent using a flexible developing agent bearing member to the surface of the latent image on said image bearing member, the highly viscous liquid developing agent having a viscosity from 100 to 10,000 mPa•s and having charged developing particles dispersed at a high concentration in a non-conductive liquid, so as to form a developed image on a developed image bearing member being either the image bearing member or the flexible developing agent bearing member and a transfer stage in which the developed image is transferred to a further member, the transfer stage being characterized by a distributed contact pressure between the developed image bearing member and the further member whereby the developed image can be transferred to the further member without the developed image spreading.

2. An image formation apparatus as in claim 1 wherein the further member is a substrate upon which the developed image is finally fixed.

3. An image formation apparatus as in claim 1 wherein the further member is an intermediate transfer member and comprising a second transfer stage wherein the developed image is further transferred to a substrate from the intermediate transfer member.

4. The image formation apparatus of claim 1 wherein said further member is formed from a flexible thin sheet-type element.

5. The image formation apparatus of claim 4 wherein the flexible thin sheet-type element is a seamless nickel belt.

6. The image formation apparatus of claim 4 wherein the flexible thin sheet-type element has a release layer formed from a fluorocarbon resin.

7. The image formation apparatus of claim 1 wherein said further member is a substrate upon which the developed image is finally fixed and the substrate is supported on an elastic cylindrical member.

8. The image formation apparatus of claim 1 wherein said further member is an elastic cylindrical member.

9. An image formation apparatus as in claim 1 comprising a plurality of image formation stations each adapted to apply a liquid developing agent of a selected color and the image formation apparatus is adapted for multi-color image formation.

10. An image formation apparatus as in claim 9 wherein the transfer stage sequentially transfers the respective developed images to a substrate transported by the further member, and thereby forming a multi-color image on said substrate.

11. An image formation apparatus as in claim 9 wherein the respective developed image bearing members are the image bearing members and the respective developed images formed on the image bearing members are sequentially transferred to the substrate.

12. An image formation apparatus as in claim 11 wherein the image bearing member is formed from a flexible thin sheet-type element.

13. An image formation apparatus as in claim 9 wherein the transfer stage comprises a first transfer stage that sequentially transfers the respective developed images to an intermediate transfer member, and thereby forming a multi-color developed image on said intermediate transfer member, and a second transfer stage that transfers the multi-color developed image formed on said intermediate transfer member to a substrate.

14. An image formation apparatus as in claim 13 wherein said intermediate transfer member is formed from a flexible thin sheet-type element.

15. An image formation apparatus as in claim 13 wherein said intermediate transfer member is an elastic cylindrical member.

16. An image formation apparatus as in claim 13 wherein the second transfer stage comprises a fusing heater inside a drive roller.

17. An image formation apparatus as in claim 13 wherein the transfer stage comprises a corona discharge device to charge the intermediate transfer member with a charge of opposite polarity to that of the charged developing particles and earthing rollers disposed on both sides of the corona discharge device.

18. An image formation apparatus as in claim 9 wherein the transfer stage comprises a first transfer stage that sequentially transfers each developed image to an intermediate transfer member, and a second transfer stage that sequentially transfers the developed image on the intermediate transfer member to a substrate, thereby forming a multicolor image on said substrate.

19. An image formation apparatus as in claim 18 wherein said intermediate transfer member is formed from a flexible thin sheet-type element.

20. An image formation apparatus as in claim 18 wherein said intermediate transfer member is an elastic cylindrical member.

21. An image formation apparatus as in claim 1 wherein said developing agent bearing member is formed from a flexible thin sheet-type element.

22. An image formation apparatus as in claim 1 wherein said developing agent bearing member is an elastic cylindrical member.

23. An image formation apparatus as in claim 1 further comprising a pre-wetting stage in which a pre-wet liquid, being a chemically inactive dielectric liquid that has good release properties, is applied on said image bearing member.

24. An image formation apparatus as in claim 15 wherein said pre-wetting stage applies said pre-wet liquid on said image bearing member by means of at least one roller.

25. An image formation apparatus as in claim 24 wherein said roller is formed from a material that has good lyophilic properties.

26. An image formation apparatus as in claim 23 wherein said pre-wet liquid has a viscosity from 0.5 to 5 mPa•s, an electric resistance of $10^{12}\Omega$ cm or more, a boiling point from 100 to 250° C., and a surface tension of 21 dyne/cm or less.

27. An image formation apparatus as in claim 23 wherein the pre-wet liquid comprises silicone fluid.

28. An image formation apparatus as in claim 23 wherein the developing stage comprises provides a distributed contact pressure between the image bearing member and the developing agent bearing member which provides a development contact area in which the pre-wet liquid layer on said image bearing member and the thin layer of the highly viscous color liquid developing agent on the flexible developing agent bearing member maintain a two-layer structure throughout said contact area.

29. An image formation apparatus as in claim 1 wherein the ion-conductive liquid of said liquid developing agent has a viscosity from 0.5 to 1,000 mPa•s, an electric resistance of $10^{12}\Omega$ cm or more, a surface tension of 21 dyne/cm or less, and a boiling point of 100° C. or more.

30. An image formation apparatus as in claim 1 wherein the non-conductive liquid in said liquid developing agent comprises silicone fluid.

31. An image formation apparatus as in claim 1 wherein said liquid developing agent contains toner with an average particle diameter of 0.1 to 5 $\mu$m at a concentration of 5 to 40% by weight.

32. An image formation apparatus as in claim 1 comprising a release layer on the image bearing member that has a lower surface energy than the surface energy of the liquid developing agent formed on the surface of the image bearing member.

33. An image formation apparatus as in claim 20 wherein the release layer on said image bearing member is formed from a fluorocarbon resin.

34. An image formation apparatus as in claim 20 wherein the release layer on said image bearing member is formed from silicone.

35. An image formation apparatus as in claim 1 wherein the distributed contact pressure between the developed image bearing member and the further member provides a transfer contact area in which the developed image touches the further member.

36. An image formation apparatus as in claim 1 wherein the transfer stage comprises a fusing heater inside a drive roller.

37. An image formation apparatus as in claim 1 further comprising a cleaning apparatus adapted to clean the image bearing member after the transfer stage, the cleaning apparatus comprising a removal roller in contact with the image bearing member and a power supply apparatus adapted to apply a voltage to the cleaning roller of opposite polarity to that of the charged developing particles.

38. An image formation apparatus as in claim 1 wherein the electrostatic latent image formation step forms an electrostatic latent image on the electrostatic latent image bearing member such that a toner image that corresponds to the desired print image remains on the developing agent bearing member and the transfer stage transfers the developed image from the developing agent bearing member to the further member.

39. An image formation apparatus having at least one image formation station, said at least one image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, so as to form a developed image on a developed image bearing member being either the image bearing member or the flexible developing agent bearing member and a transfer stage in which the developed image is transferred to a further member, the transfer stage being characterized by a distributed contact pressure between the developed image bearing member and the further member whereby the developed image can be transferred to the further member without the developed image spreading and a release layer on the image bearing member that has a lower surface energy than the surface energy of the thin layer of liquid developing agent formed on the surface of the image bearing member.

40. An image formation apparatus as in claim 39 wherein the release layer on said image bearing member is formed from a fluorocarbon resin.

41. An image formation apparatus as in claim 39 wherein the release layer on said image bearing member is formed from silicone.

42. An image formation apparatus as in claim 39 wherein the transfer stage comprises a fusing heater inside a drive roller.

43. An image formation apparatus having at least one image formation station, said at least one image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, so as to form a developed image on the image bearing member and a transfer stage in which the developed image is transferred to a substrate, the transfer stage being characterized by a distributed contact pressure between the developed image bearing member and the substrate whereby the developed image can be transferred to the substrate without the developed image spreading and a release layer on the image bearing member that has a lower surface energy than the surface energy of the thin layer of liquid developing agent formed on the surface of the image bearing member.

44. An image formation apparatus as in claim 43 wherein the release layer on said image bearing member is formed from a fluorocarbon resin.

45. An image formation apparatus as in claim 43 wherein the release layer on said image bearing member is formed from silicone.

46. An image formation apparatus as in claim 43 wherein the transfer stage comprises a fusing heater inside a drive roller.

47. An image formation apparatus having at least one image formation station, said at least one image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, so as to form a developed image on the image bearing member and a transfer stage in which the developed image is transferred to a substrate, wherein the transfer stage comprises a first transfer stage that transfers the developed image to an intermediate transfer member, and a second transfer stage that transfers the developed image formed on said intermediate transfer member to a substrate, the transfer stage being characterized by a distributed contact pressure between the image bearing member and the intermediate transfer member whereby the developed image can be transferred without the developed image spreading, and a release layer on the image bearing member that has a lower surface energy than the surface energy of the thin layer of liquid developing agent formed on the surface of the image bearing member.

48. An image formation apparatus as in claim 47 wherein the release layer on said image bearing member is formed from a fluorocarbon resin.

49. An image formation apparatus as in claim 47 wherein the release layer on said image bearing member is formed from silicone.

50. An image formation apparatus as in claim 47 wherein the second transfer stage comprises a fusing heater inside a drive roller.

51. A multicolor image formation apparatus having a plurality of image formation stations, each image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, so as to form a developed image on the image bearing member and a transfer stage in which the developed image is transferred to a substrate, wherein the transfer stage comprises a first transfer stage that sequentially transfers the respective developed images to an intermediate transfer member, and thereby forming a multi-color developed image on said intermediate transfer member, and a second transfer stage that transfers the multi-color developed image formed on said intermediate transfer member to the substrate, the transfer stage being characterized by a distributed contact pressure between the image bearing member and the intermediate transfer member whereby the developed image can be transferred to the intermediate transfer member without the developed image spreading and a release layer on the image bearing member that has a lower surface energy than the surface energy of the thin layer of liquid developing agent formed on the surface of the image bearing member.

52. An image formation apparatus as in claim 51 wherein the release layer on said image bearing member is formed from a fluorocarbon resin.

53. An image formation apparatus as in claim 51 wherein the release layer on said image bearing member is formed from silicone.

54. An image formation apparatus as in claim 51 wherein the second transfer stage comprises a fusing heater inside a drive roller.

55. A multicolor image formation apparatus having a plurality of image formation stations, each image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, so as to form a developed image on the image bearing member and a transfer stage in which the developed image is transferred to a substrate, wherein the transfer stage comprises a first transfer stage that sequentially transfers the respective developed images to an intermediate transfer member, and a second transfer stage that sequentially transfers the developed images formed on said intermediate transfer member to the substrate, the transfer stage being characterized by a distributed contact pressure between the image bearing member and the intermediate transfer member whereby the developed image can be transferred to the intermediate transfer member without the developed image spreading and a release layer on the image bearing member that has a lower surface energy than the surface energy of the thin layer of liquid developing agent formed on the surface of the image bearing member.

56. An image formation apparatus as in claim 55 wherein the release layer on said image bearing member is formed from a fluorocarbon resin.

57. An image formation apparatus as in claim 55 wherein the release layer on said image bearing member is formed from silicone.

58. An image formation apparatus as in claim 55 wherein the second transfer stage comprises a fusing heater inside a drive roller.

59. An image formation apparatus having at least one image formation station, said at least one image formation station comprising an image bearing member, an electrostatic latent image formation stage that forms an electrostatic latent image on said image bearing member, and a developing stage comprising an applicator that supplies a thin layer of a highly viscous color liquid developing agent using a flexible developing agent bearing member to the surface of the latent image on said image bearing member, the highly viscous color liquid developing agent having a viscosity from 100 to 10,000 mPa•s and having charged developing particles dispersed at a high concentration in a non-conductive liquid, such that a developed image that corresponds to the desired print image remains on the developing agent bearing member and a transfer stage in which the developed image is transferred to a substrate, the transfer stage being characterized by a distributed contact pressure between the developed image bearing member and the substrate whereby the developed image can be transferred to the substrate without the developed image spreading and a release layer on the image bearing member that has a lower surface energy than the surface energy of the thin layer of liquid developing agent formed on the surface of the image bearing member.

60. An image formation apparatus as in claim 59 wherein the release layer on said image bearing member is formed from a fluorocarbon resin.

61. An image formation apparatus as in claim 59 wherein the release layer on said image bearing member is formed from silicone.

62. An image formation apparatus as in claim 59 wherein the transfer stage comprises a fusing heater inside a drive roller.

* * * * *